US005436715A

United States Patent [19]

Yamada et al.

[11] Patent Number: 5,436,715

[45] Date of Patent: Jul. 25, 1995

[54] AUTOMATIC DOCUMENT FEEDER

[75] Inventors: Yasushi Yamada; Kohji Yoshie; Tetsuo Hirata, all of Hachioji; Tadashi Uematsu, Oizumi; Hiroyuki Hara, Kamifukuoka, all of Japan

[73] Assignee: Konica Corporation, Tokyo, Japan

[21] Appl. No.: 134,804

[22] Filed: Oct. 12, 1993

[30] Foreign Application Priority Data

Oct. 23, 1992 [JP] Japan ..... 4-286230

[51] Int. Cl.[6] ..... G03G 15/00

[52] U.S. Cl. ..... 355/320; 355/24

[58] Field of Search ..... 355/318, 320, 23–25; 271/3.1, 184, 185, 186

[56] References Cited

U.S. PATENT DOCUMENTS

| | | | |
|---|---|---|---|
| 4,912,501 | 3/1990 | Saeki et al. | 271/3.1 X |
| 4,935,775 | 6/1990 | Ueda et al. | 355/320 X |
| 4,974,827 | 12/1990 | Arai et al. | 271/186 X |
| 4,975,749 | 12/1990 | Tsunoda et al. | 355/320 |
| 4,982,241 | 1/1991 | Okamoto et al. | 355/320 |
| 5,022,641 | 6/1991 | Okada | 271/3.1 |
| 5,092,576 | 3/1992 | Takahashi et al. | 271/3.1 |
| 5,280,896 | 1/1994 | Yamada | 271/3.1 |

FOREIGN PATENT DOCUMENTS

| | | |
|---|---|---|
| 56-37536 | 9/1981 | Japan . |
| 1-197246 | 8/1989 | Japan . |
| 0236136 | 9/1989 | Japan . |
| 3-205273 | 9/1991 | Japan . |
| 4-116671 | 4/1992 | Japan . |
| 4-116672 | 4/1992 | Japan . |
| 4-140280 | 5/1992 | Japan . |
| 4-164786 | 6/1992 | Japan . |
| 4-164787 | 6/1992 | Japan . |
| 4-209199 | 7/1992 | Japan . |
| 4-217568 | 8/1992 | Japan . |

*Primary Examiner*—Robert Beatty

*Attorney, Agent, or Firm*—Finnegan, Henderson, Farabow, Garrett & Dunner

[57] ABSTRACT

An automatic document feeder includes a document stacker for holding documents, a first conveyer for feeding the documents one sheet by one sheet to a platen glass for reading an image on a first side of the conveyed document, a second conveyor for conveying the conveyed document so that the conveyed document is turned over and conveyed to the platen glass again to read an image on the second side, and a discharger for discharging the conveyed document from the platen glass and returning the conveyed document to the document stacker. A third conveyer, located over the platen glass, conveys the conveyed document from at least one of the first conveyor and the second conveyer to the platen glass and conveys the conveyed document from the platen glass to at least one of the first conveyer, the second conveyer, and the discharger. A controller controls the movement of the conveyed document by the first, second, and third conveyers and the discharger, and a next conveyed document following the conveyed document is set to a waiting position on the platen glass when a second circulation is executed by the controller following a first circulation. The next conveyed document is then conveyed to the platen glass through the second conveyer after the second side of the conveyed document is read.

22 Claims, 33 Drawing Sheets

| FIG. 11(A) | FIG. 11(B) |
|---|---|

| FIG. 11(A) | FIG. 11(B) |
|---|---|

AUTOMATIC DOCUMENT FEEDER

BACKGROUND OF THE INVENTION

The present invention relates to improvements in an automatic document feeder used for a recording device or an image reading device of an electrophotographic copier, and more particularly relates to improvements in a circulation type automatic document feeder having a document feeding mode (RDH) in which one-sided or two-sided documents stacked on a document stack section are separated from the document stack one by one and fed to an image reading section and then the document is returned to the document stack section so that it can be repeatedly fed, and also having a two-sided document reversal feeding mode (R-RDH).

An automatic document feeder (ADF) that can efficiently and automatically feed a document on which an image is recorded, has already been provided to a recording device of an electrophotographic copier or a recorded image reading apparatus.

An automatic document feeder (RADF) having a reversal function by which a document is reversed, is put into practical use as a copier by which the images on a two-sided document are copied onto one side or both sides of a recording paper and as an image reading apparatus by which the images are read.

Also, a circulation type automatic document feeder (RDH) has been proposed in which the documents stacked on a document stack section are separated one by one and automatically fed onto a platen glass and the document exposed on the platen glass is returned to the document stack section so that the document can be repeatedly processed.

By this circulation type automatic document feeder (RDH), a copy is made when a document is circulated once, so that the document is circulated by the number of required copies.

Moreover, a circulation type automatic document feeder (R-RDH) has been also provided in which a document reversal mechanism is added to the RDH described above (disclosed in Japanese Patent Application Open to Public Inspection No. 197246/1989).

By these circulation type automatic document feeder (RDH and R-RDH), which will be referred to as RDH hereinafter, it is possible to conduct a high speed continuous copying operation and to quickly collate copied recording papers. Moreover, when the circulation type automatic document feeder (RDH) is combined with a finisher device by which stapling and punching operations are conducted on the recording papers, the overall recording operation can be automatically performed.

The aforementioned RDH device is of a bottom-feed-top-return type in which: a plurality of documents are stacked on the document stack section under the condition that the front surfaces of the documents are set upward; and the lowermost document is separated from the document stack one by one and conveyed to the processing section (the platen glass surface).

In the bottom-feed-top-return type apparatus described above, when a document is sent out from the document stack, the front surface of a document and the back surface of another document are rubbed with each other, so that the image on the rubbed document is damaged and further the front and back surfaces of a document are stained. Especially when a document is written with a pencil, the document is remarkably stained.

In order to solve the above problems, a top-feed-bottom-restack type RDH apparatus has been disclosed in Japanese Patent Publication No. 37536/1981. In this apparatus, a processed sheet is inserted under the sheet stack with a cyclic operation type stack lifting means.

The following problems may be encountered in the top-feed-bottom-restack type RDH.

In a sheet accommodation and supply device disclosed in Japanese Patent Application Open to Public Inspection No. 205273/1991, returned documents are reversed and inserted from the bottom portion of a document stack on the downstream side of document feeding in an RDH device, and a vertical presser member is disposed at the rear end position of an upper document stack. Technique disclosed in Japanese Patent Application Open to Public Inspection Nos. 116671/1992 and 116672/1992 is concerned to a reversal document conveyance direction, in which a direction changeover claw to change over between the normal and reverse conveyance is provided so that the conveyance passage can be changed over.

The following problems may be encountered in the top-feed-bottom-restack type RDH.

(1) Structure of the cyclic operation type lifting means is complicated.

(2) In the case where an end portion of a sheet to be inserted under the stack is curled, there is a high possibility that the end portion is caught by the cyclic operation type stack lifting means.

(3) When a sheet is returned at high speed, the operation of a document feeder becomes complicated, so that the operation becomes unstable.

(4) Each time a sheet is returned, the stack lifting means is moved upward and downward, so that noises are caused.

(5) It is difficult to adjust the apparatus when the sheet size is changed.

In order to overcome the above disadvantages, the invention disclosed in Japanese Patent Application Open to Public Inspection No. 217568/1992 is constructed in the following manner: The circulation type top-feed-bottom-return automatic document feeder includes an upper suction fan means, an upper feeding belt type document feeding means, and a lower document return rotation means composed of a plurality of thin belts.

However, in the automatic document feeder constituted in the aforementioned manner, the following problems may be encountered, so that improvements are required.

(1) Noises are made by the suction fan means, and its manufacturing cost is high.

(2) In the structure in which a plurality of thin belts are disposed, a document conveyed on the belts is not uniformly contacted with the belts because there are gaps between the belts, so that the document surface is formed into a wave-shape, and the protruded portions at the leading end of the document on the belts collide with the trailing end of an upper document. As a result, documents are jammed.

In order to overcome the aforementioned disadvantages, the present invention is to provide a circulation type automatic document feeder of an upper-feed-bottom-insertion system stably operated even when documents are fed at high speed and further the document feeder can handle various sizes of documents.

The first object of the present invention is to provide an automatic document feeder, the copying time of which can be reduced when a conveyance interval between a previous and a successive document is shortened to a minimum distance by a simple structure and control, and the copying time can be also reduced when the conveyance time for conveying a plurality of documents to an image reading unit is remarkably reduced by carrying out preparatory paper feeding.

In the circulation type automatic document feeder, documents subjected to image reading processing are circulated onto the document stack unit so that they can be fed again. Therefore, it is necessary to accurately align and stack the documents that have been discharged from the paper discharging means. Also, in the case of the ADF and R-ADF modes, when discharged documents are not aligned on the document stack unit, they are scattered or dispersed out of the tray, which causes problems in the copying operation.

In order to prevent the discharged documents from being scattered or dispersed in the conventional automatic document feeder, the related technique is disclosed in Japanese Patent Publication Open to Public Inspection Nos. 140280/1992, 164786/1992 and 164787/1992, and also disclosed in Japanese Patent Publication Open to Public Inspection No. 217568/1992 and Japanese Patent Application No. 209199/1992 applied by the present inventors.

In the case where the document discharging speed is relatively low, the momentum of the document is small. Therefore, the documents can be properly aligned when they are discharged onto the document stack unit. However, when the document discharging speed is increased, the leading end of a document is not accurately contacted with a stopper provided on the document stack unit when the document is discharged, so that the document overruns. As a result, the document is deformed or bounded, and further the document can not set at a predetermined position. In the case of the ADF mode or R-ADF mode, the discharged documents are scattered out of the discharging tray.

In the case of a high speed type copier in which a plurality of documents are successively fed onto the image reading unit (platen glass) at short intervals so as to improve the copying productivity, the document replacing time is increased when the previous document conveyed by a conveyance means is discharged at a low speed, because the conveyance of the following document conveyed at the same speed is delayed. In the case where only the discharging speed of the previous document is lowered, the successive document closely approaches the previous document, so that the trailing end of the previous document collides with the leading end of the successive document, thereby resulting in defective conveyance. In the case where a document feeder includes a conveyance means that conveys a returned document in synchronization with the leading end of a document, it is difficult to synchronize the leading end with the document.

In the copiers disclosed Japanese Patent Publication Open to Public Inspection No. 217568/1992 and Japanese Patent Application No. 209199/1992, which have been described before, an upper guide for documents returning to the document stack unit is not provided, so that the returned documents are greatly curled, and further they can not be properly aligned. In this case, documents are conveyed, using their own weight. Accordingly, when the number of documents is small, a sufficient conveyance force can not be provided.

The second object of the present invention is to provide a circulation type automatic document feeder in which a top-feed-bottom-return operation is carried out so that a document returning to the document stack unit can be positively returned to a document feed start position.

SUMMARY OF THE INVENTION

An automatic document feeder of the first example of the present invention to accomplish the first object described above, comprises: a first feed means to separate one of the plurality of documents stacked on a document stack unit so as to feed the document to an image reading unit; a second feed means provided on an upstream side of document conveyance direction in said image reading unit, said second feed means inverting a document reversely conveyed from said image reading unit, further said second feed means returning said inverted document to said image reading unit; a conveyance means to convey a document on said image reading means; a first discharge means provided on a downstream side of document conveyance, said first discharge means returning a document conveyed by said conveyance means under the condition that an upper surface of said document located on said image reading unit is maintained upward; a second discharge means to return a document conveyed by said conveyance means to said document stack unit under the condition that an opposite side to the upper surface of said document located on said image reading unit is set upward; a first drive source to drive said first feed means, said second feed means, and said conveyance means; and a second drive source to drive said first and second discharge means. The automatic document feeder of the present invention is characterized in that: when a two-side document reading mode is set in which an image on the first surface of each document is read in the first document circulating operation and then an image on the second surface of each document is read in the second document circulating operation, at least in one of the document circulating operations, a successive document is conveyed to a waiting position on the upstream side of an image reading position while the successive document is being conveyed onto the image reading side sequentially after the document has been fed by said second feed means.

Also, the automatic document feeder of the first example of the present invention is characterized in that: the waiting position of the successive document is located at a predetermined distance from a leading end or a trailing end of the previous document; and the successive document is stopped at the predetermined waiting position in image reading.

Also, the automatic document feeder of the first example of the present invention is characterized in that: a detection means to detect an end portion of a document is provided in the middle of said second feed means; and the successive document is fed and stopped to wait at a predetermined position in accordance with a detection signal of the leading end or trailing end of a document passing through said detection means, while the previous document is inverted by said second feed means.

The automatic document feeder of the first example of the present invention is characterized as follows. While the first document is stopped at the reading unit and the second document is stopped at a waiting position located in the upstream of the reading unit, the successive third document is sent out, and waits for the next operation at a position in the upstream of the confluence of the second feed means, whereby an interval between the second and third documents is maintained to be a predetermined value. After the first document has been read, the first document is conveyed to the first conveyance means, and while the second document is inverted by the second feed means, the third document is sent out and waits for the next operation. Until the reading operation of one side is completed, the aforementioned operations are repeated.

In order to accomplish the aforementioned first object, the circulation type automatic document feeder of the second example of the present invention is a top-feed-bottom-return type automatic document feeder, comprising: at least one pair of document stack units on which a plurality of documents can be stacked; a paper feed means that separates the uppermost document from the plurality of documents stacked on the document stack unit and sends it to an image reading unit; a conveyance means located in the downstream of the paper feed means, wherein the conveyance means conveys the document on the image reading unit; a discharge means and a belt feed means located in the downstream of the image reading unit, wherein the discharge means and belt means return the document conveyed from the conveyance means, to the lowermost layer of the stacked documents on the document stack unit. In the circulation type automatic document feeder, while a fore end of the document sent out from the discharge means is held, the document is fed, and the document is inserted into the lowermost layer of the document stack on the document stack unit, wherein the circumferential speed V1 of the feed belt having a holding unit capable of being moved in the paper feeding direction by a drive means, is set higher than the circumferential speed V2 of a circulation paper discharge roller located in the most downstream portion of the discharge means to return the document to the paper feed belt.

The circulation type automatic document feeder of the second example of the present invention further comprises: a paper feed belt having a holding unit to hold a fore end of the document sent out from the discharge means so as to be moved to the paper feeding direction; a circulation paper discharge roller provided in the most downstream portion of the discharge means to return a document while the document is held by the feed belt moving at a constant speed; and a drive means to generate a relative speed difference between the circumferential speed of the circulation paper discharge roller and that of the feed belt when the rotation of the circulation paper discharge roller is temporarily reduced or stopped by the drive means.

In order to accomplish the second object, the automatic document feeder of the third example of the present invention comprises: a feed unit that separates one of the plurality of documents stacked on a document stack unit and feeds the document to an image reading unit; a conveyance unit that conveys the document in the image reading unit to a predetermined image reading position, and then conveys and discharges the document, the image on which has been read; and a paper discharge unit that discharges the document conveyed from the image reading unit, to the document stack unit. The automatic document feeder of the third example of the present invention further comprises: a conveyance means that conveys a document to the lowermost layer of the documents stacked on the document stack unit synchronously with the fore end portion of the document discharged from the paper discharge unit; a detection means to detect the passage of a body to be detected, the detection means being provided at a predetermined position of the conveyance means; a stop means connected with a drive source to drive the conveyance means in the paper feed direction, wherein the stop means stops the conveyance means at a predetermined position; and a control means to control the operation of the stop means. In the automatic document feeder, after a detection signal of the passage of the body to be detected has been generated by the detection means, a predetermined period of time determined by the control means passes, and then the stop means is activated so that the conveyance means is stopped at a predetermined position.

The automatic document feeder of the second example of the present invention further comprises: a conveyance means that conveys a document to the lowermost layer of the documents stacked on the document stack unit synchronously with the fore end portion of the document discharged from the paper discharge unit; a detection means to detect the passage of a body to be detected, the detection means being provided at a predetermined position of the conveyance means; a stop means connected with a drive source to drive the conveyance means in the paper feed direction, wherein the stop means stops the conveyance means at a predetermined position; a speed changing means to change the conveyance speed of the conveyance means by at least two steps including high and low speeds; and a control means to control the operations of the stop and speed changing means. In the automatic document feeder of the second example of the present invention, the conveyance means is stopped at a predetermined position in the following manner. Before the generation of the detection signal of the passage of a body to be detected by the detection means, the speed changing means is activated by the control means so that the speed of the conveyance means is reduced. Then, after the generation of the signal of the passage of a body to be detected, the stop means is activated by the control means after a predetermined period of time has passed, so that the conveyance means can be stopped at the predetermined position.

In order to accomplish the aforementioned second object, the circulation type automatic document feeder of the fourth example of the present invention is a top-feed-bottom-return circulation type automatic document feeder, comprising: a document stack unit in which at least one set of a plurality of documents can be stacked, the document stack unit including a feed belt to move the documents to a feeding start position; a paper feed unit to separate one document from the plurality of documents stacked on the document stack unit so as to feed the document to an image reading unit; a conveyance unit to convey the fed document to the image reading unit and further to convey the document out of the image reading unit after image reading; and a discharge unit to discharge the documents conveyed from the image reading unit, to the document stack unit. In the circulation type automatic document feeder, stripe-shaped protrusions are formed on the document contacting surface of the feed belt in the direction of document conveyance, and the surfaces of the protrusions are made to be rough so that the friction coefficient is high, and further a document holding member capable of being pressed against the protrusions is provided.

In the circulation type automatic document feeder of the fourth example of the present invention, a position where the document holding member presses against the feed belt is located so that the minimum size document can reach the fore end position of document feeding.

DETAILED DESCRIPTION OF THE INVENTION

With reference to the attached drawings, the first example of the automatic document feeder of the present invention will now be described as follows.

Figure 1:
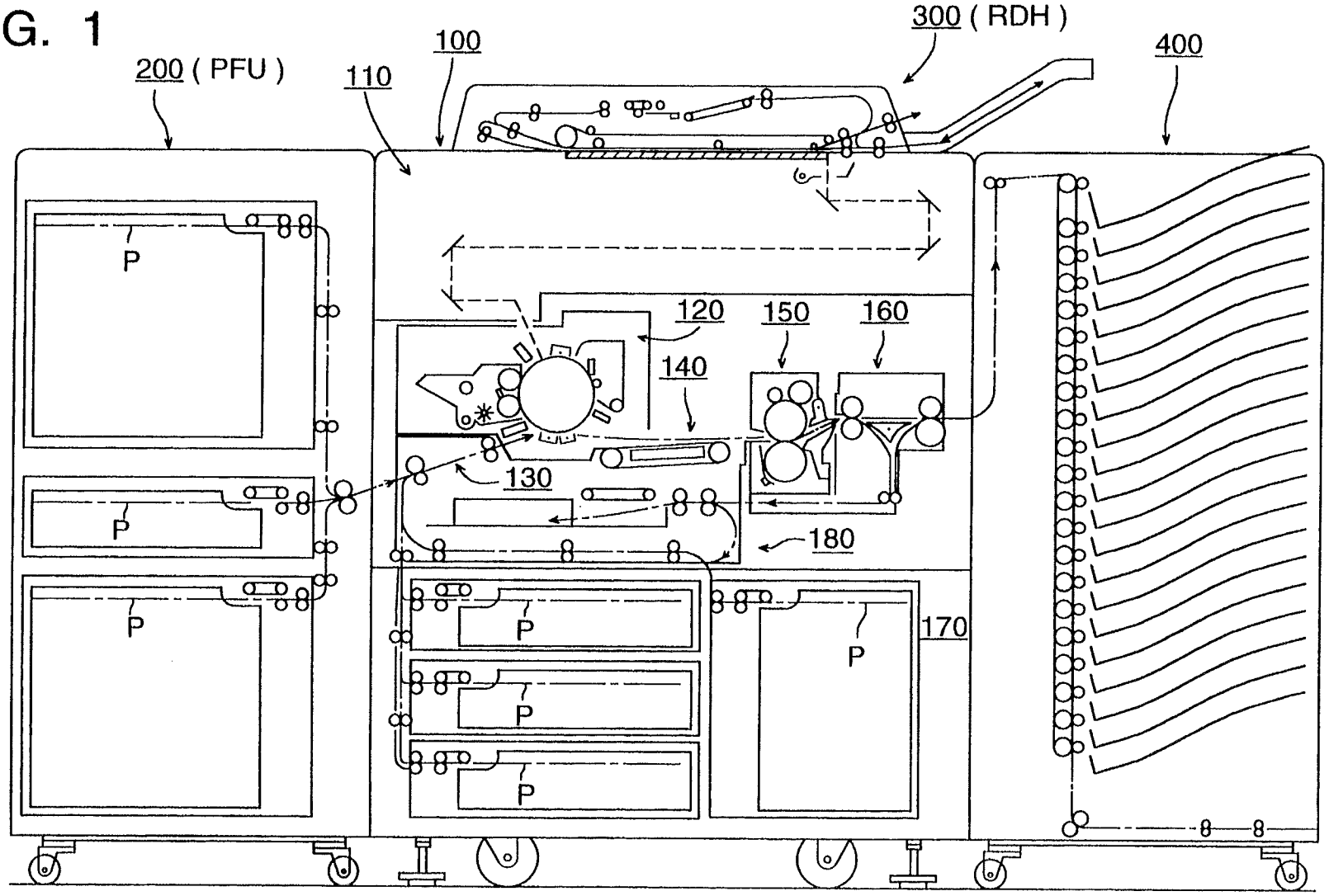
FIG. 1 is an overall arrangement view of a copier provided with an automatic document feeder of the present invention.

FIG. 1 is an overall arrangement view of a copier provided with an automatic document feeder, wherein numeral 100 is a copier body, numeral 200 is a paper feeding unit, numeral 300 is a circulation type automatic document feeder (RDH device), and numeral 400 is a copy paper after-processing device (a finisher, that is, a sorter having a stapler, which will be referred to as an FNS device, hereinafter).

The copier body 100 includes a scanning exposure section 110, image forming section 120, paper feeding section 130, conveyance section 140, fixing section 150, discharged paper switching section 160, a plurality of paper feeding cassettes 170, and copy paper refeeding device (ADU device) 180 for two-sided copying.

In the drawing, a one-dotted chain line shows a conveyance passage for copy papers P. As illustrated in the drawing, the conveyance passage is composed of a main route and a circulation route. According to the main route, an image is formed on a copy paper P accommodated in the paper feed cassette 170 provided in the lower portion of the copier body 100 or accommodated in the paper feed unit (PFU) 200, and then the copy paper P passes through the conveyance section 140, fixing section 150 and discharged paper switching section 160 and is accommodated in the FSN device 400. According to the circulation route, the copy paper P branches from the main route by the action of the discharged paper switching section 160, and is temporarily stored in the ADU device 180 and then conveyed to the paper feed section 130 of the copier body 100 again.

Figure 2:
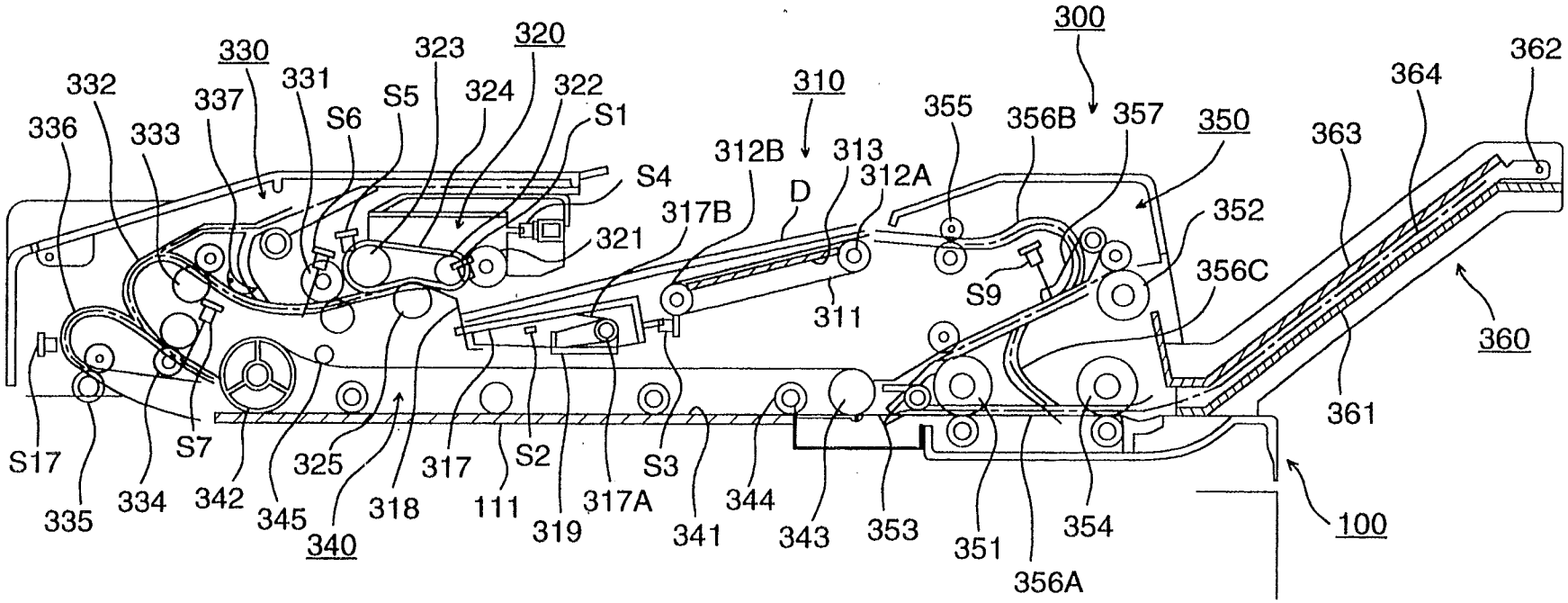
FIG. 2 is a sectional view of the automatic document feeder.

FIG. 2 is a sectional view of an automatic document feeder 300 attached to the upper portion of the copier body 100. The automatic document feeder 300 to which the present invention can be applied is provided with the functions of circulation types of RDH and R-RDH devices in which a plurality of documents (one-sided or two-sided documents) are conveyed to the exposure section on the platen glass 111 of the copier body 100 from the document stack section 310 and then conveyed again onto the document stack section 310. Also, the automatic document feeder 300 to which the present invention can be applied is provided with the functions of the ADF and R-ADF devices.

The automatic document feeder 300 includes the document stack section 310, feed section 320, intermediate conveyance section 330, conveyance section 340 and paper discharging and reversal section 350.

When a document stack D is set on the document stack section 310, the existence of documents is detected by a document set detection sensor S1, and ADF mode is displayed on the control panel according to the result of the detection. When the document stack D is set at a predetermined position, the document size (55 to A3) is detected by a document size sensor S2 and inputted into the control section of the copier body 100.

At the end of the document stack section 310 on the downstream side of document flow, a movable pushing plate 317 is pivotally provided around an oscillation shaft 317A. A drive plate 319 is secured to the oscillation shaft 317A with screws. Accordingly, the drive plate 319 can be oscillated integrally with the oscillation shaft 317A. A resilient deformation member (for example, a torsion spring) 3175 is wound around the oscillation shaft 317A, so that the drive plate 319 can be pushed by both ends of the oscillation shaft 317A, and the movable pushing plate 317 can be pushed by the central portion of the oscillation shaft 317A.

An actuator section attached to the drive plate 319 turns on and off the optical path of the pressure home position sensor S3 secured to the fixed bottom plate, so that the home position of the drive plate 319 is detected.

Figure 3:
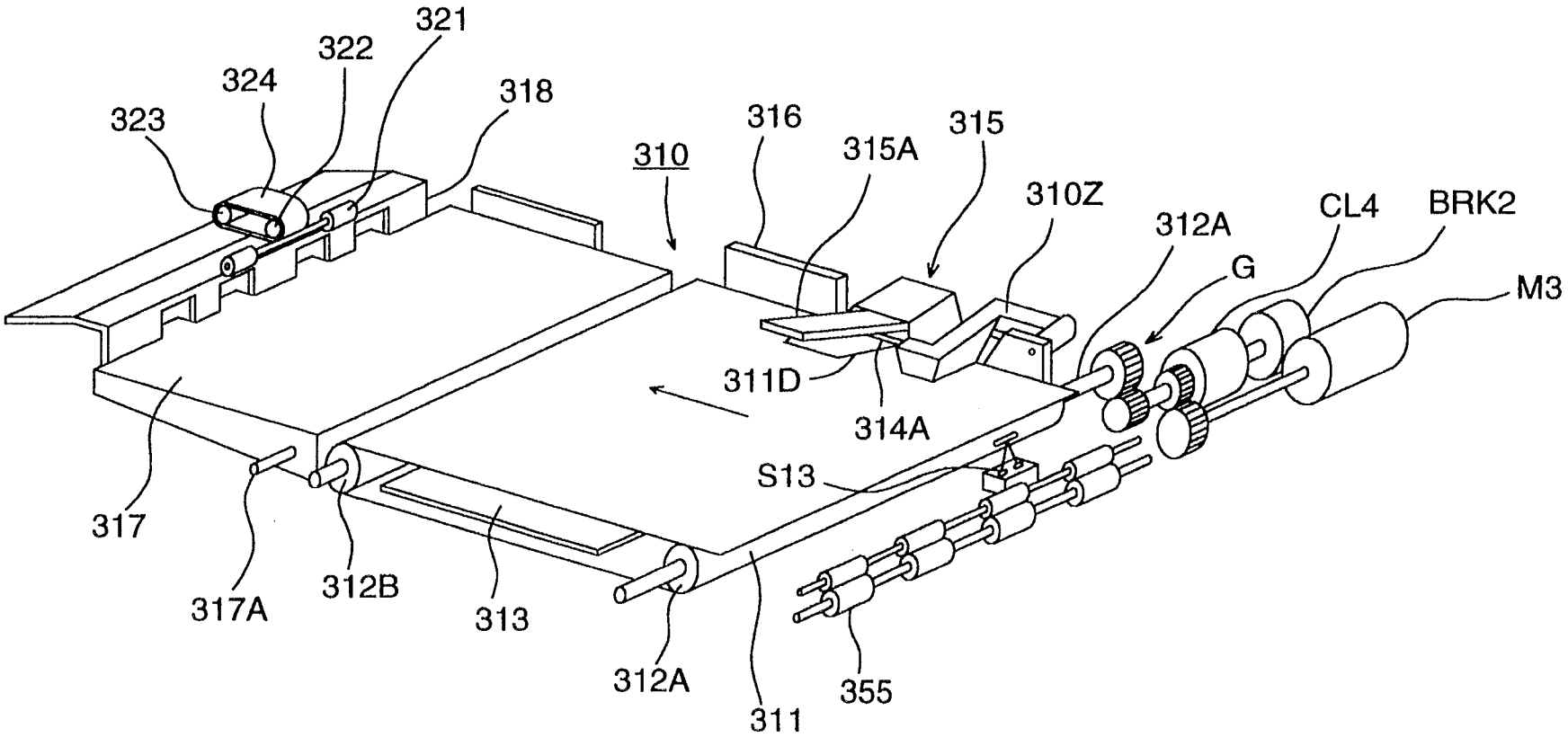
FIG. 3 is a perspective view of a primary portion of a document stack.

FIG. 3 is a perspective view of the primary portion of the document stack section 310. Document D is loaded and supported by the feed belt 311 that is a rotatable wide endless belt and wound around the drive roller 312A and the idle roller 312B.

Figure 4:
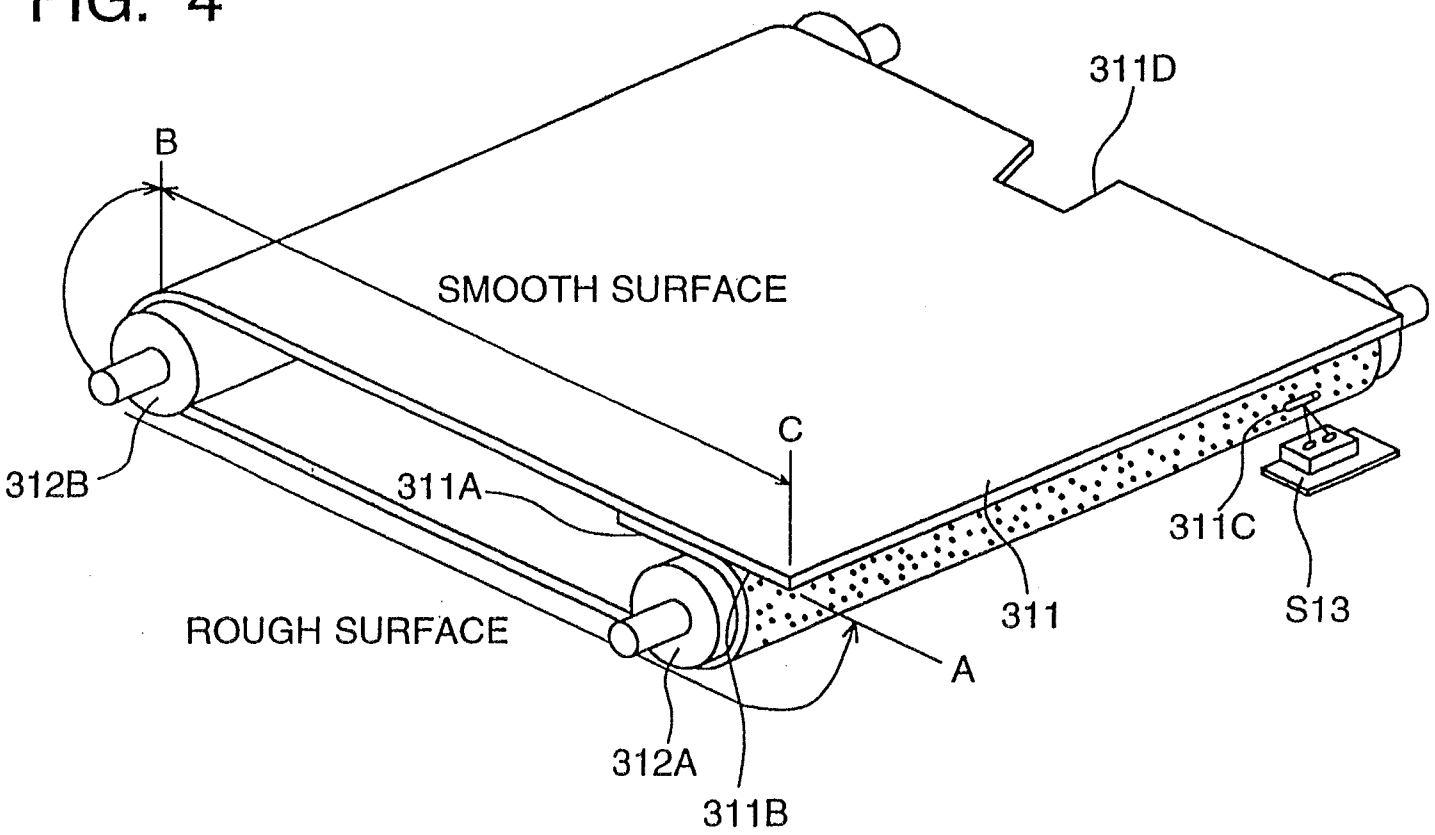
FIG. 4 is a perspective view of a paper feed belt and other related members of the document stack unit.

FIG. 4 is a perspective view of the feed belt 311. One end portion of the feed belt 311 is joined by a joint section 311A so that the feed belt 311 is formed into a loop, and the other end portion of the feed belt 311 is extended outside of the joint section 311A so that the extended portion is formed into a protruding gripper section 311B. The feed belt 311 is a cloth belt coated with resin, or a belt made of a polyethylene terephthalate (PET) film. The inner surface of the gripper section 311B of the feed belt 311 and a portion of the outer surface of the feed belt 311 (a portion between "A" and "B" illustrated in FIG. 4) are made rough so that the friction coefficients of the rough surfaces are higher than those of other surfaces, and the friction coefficient of other portion of the outer surface (a portion between "B" and "C" in FIG. 4) is low so that the surface is slippery. In this case, a portion of the feed belt 311A between "A" and "B" may be partially made to be a rough surface. For example, a portion of the outer surface of the feed belt 311 (a portion between "A" and "B") may be partially made to a rough surface composed of a plurality of small protrusions 311E, and further the surfaces of the small protrusions 311E may be made rough so that the friction coefficient is high. In this case, numeral 311C is a hole used for detection. When a reflection type sensor S13 for home position detection detects the hole 311C, the home position of the feed belt 311 can be detected, and the stop position of the gripper section 311B of the feed belt 311 can be controlled in accordance with the result of detection.

As shown in FIG. 3, an electromagnetic brake BRK2 and an electromagnetic clutch CL4, which are connected with a paper discharging drive motor M3, are provided at the end of the rotational shaft of the drive roller 312A. A fixed plate 313 is secured inside the feed belt 311 between the drive roller 312A and the idle roller 312B. Due to the fixed plate 313, document stack D on the feed belt 311 can be supported on a plane.

Numeral 315 is a separation means that separates a document stack stacked on the feed belt 311 from a document stack inserted below the lowermost document of the document stack, wherein the inserted documents have been circulated and conveyed after image reading processing. A separation lever 315A of the separation means 315 is pushed by a spring, and operated by the action of solenoids SL3 and SL4 so that it can be moved vertically and further in a direction perpendicular to the paper forward direction and moreover it can be lowered diagonally.

Numeral 311D is a cutout portion formed on the side of the feed belt 311 so that the separation lever 315A can be withdrawn under the feed belt 311.

A document stack first stacked on the document stack section 310 is loaded on the feed belt 311 and the movable pushing plate 317 that will be described later. Then, the document stack is aligned by a width stopper plate 316 that regulates the document stack in the width direction, and at the same time the leading ends of the documents come into contact with a document leading end stopper 318 so that the leading ends of the documents are aligned. At this time, the separation lever 315A is pushed downward by the weight of the document stack, so that the lowermost layer of the document stack is lightly pushed upward. An oscillatory paper holding lever 310Z provided upstream of the separation lever 315A helps a returned document to be positively inserted below the document stack, and the document surface is lightly pressed by the weight of the paper holding lever 310Z. The paper holding lever 310Z is effective to stabilize the operation of the separation lever 315A when curled documents or a small number of documents are conveyed.

Figure 5:
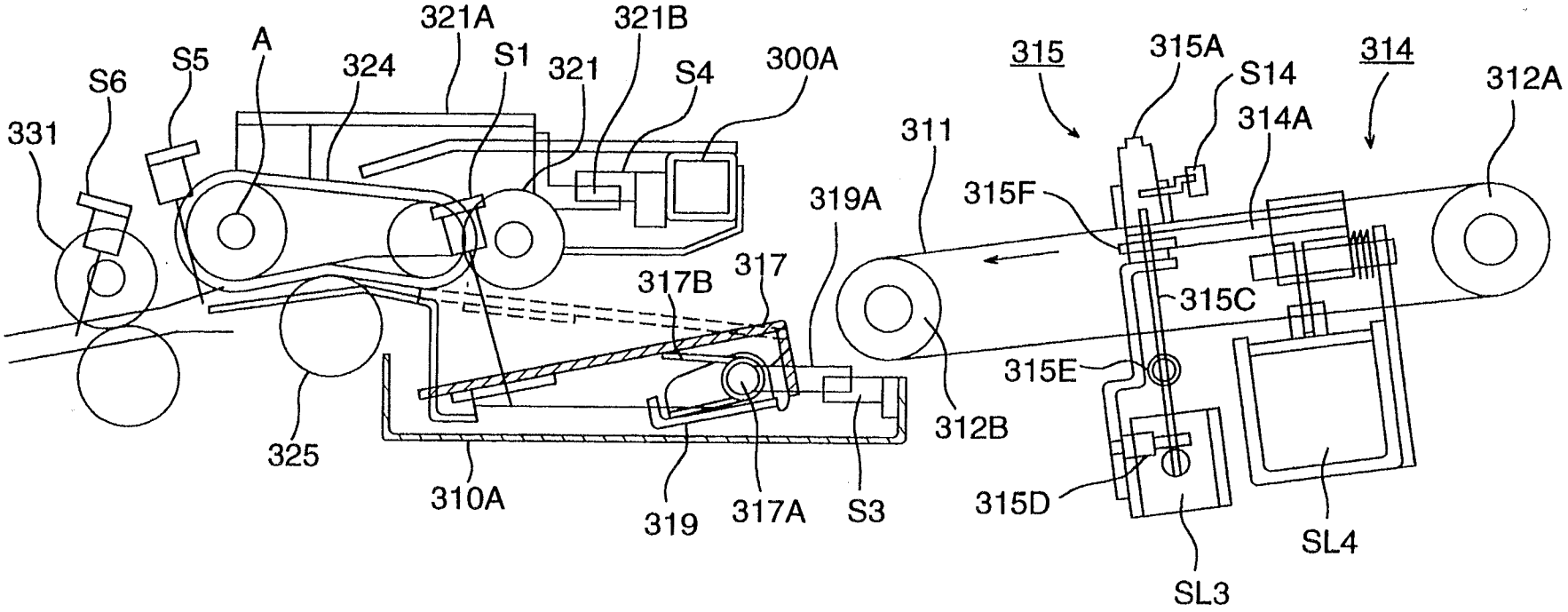
FIG. 5 is a front sectional view of the document stack unit and the feeding unit.
Figure 6:
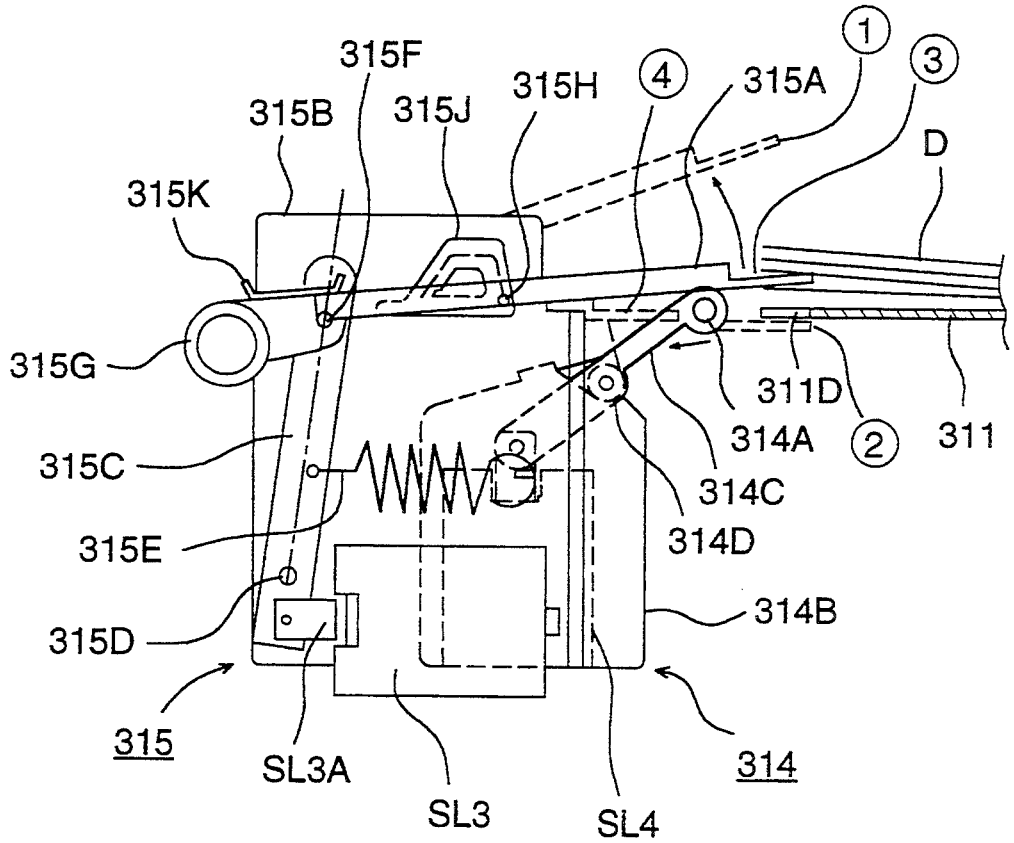
FIG. 6 is a side view of a number of copies separation means and a pushing means.

FIG. 5 is a front sectional view of the document stack section 310 and the feed section 320, FIG. 6 is a side view showing the separation means 315 and the separation lever pushing means (referred to as a pushing means hereinafter) 314. As shown in these drawings, the separation means 315 and the lifting means 314 are secured to the fixed side plate 310A to which the drive roller 312A and the idle roller 312B attached. That is, in a position close to the one side of the feed belt 311, the lifting means 314 is secured on the upstream side, and the separation means 315 is secured on the downstream side.

Solenoid SL3 is secured to the lower portion of the base plate 315B of the separation means 315, and one end of the plunger SL3A of the solenoid SL3 is connected with the lower portion of the oscillating lever 315C through a pin. The oscillating lever 315C can be oscillated around the shaft 315D implanted in the base plate 315B, and is pushed in one direction by the action of the spring 315E. The upper end portion of the oscillatory lever 315C is connected with the separation lever 315A through the pin 315F. The separation lever 315A can be oscillated around the pin 315F, and the separation lever 315A can be inclined so that the left end portion of the separation lever 315A can be lowered by the action of the weight 315C when any regulating force is not applied.

A pin 315H is implanted in the middle portion of the separation lever 315A, and the pin 315H can be moved along the D-shaped cam groove 315J formed on the base plate 315B. Numeral 315K is a circular leaf spring attached to the base plate 315B, which slidably comes into contact with the upper surface of the separation lever 315A and serves as a guide surface when the separation lever 315A is horizontally moved.

Solenoid SL4 is fixed to the lower portion of the base plate 314B of the separation lever pushing means 314. One end of the plunger SL4A of the solenoid SL4 is connected with one end portion of the oscillatory lever 314C through a pin. The oscillatory lever 314C can be oscillated around the shaft 314D implanted in the upper portion of the base plate 314B, and is pushed in one direction by the torsion spring 315E. The base portion of a long rod-shaped pushing lever 314A is engaged with the other end of the oscillatory lever 314C, and the end portion of the lever is protruded. The pushing lever 314A comes into contact with the lower surface of the end of the separation lever 315A, and the separation lever 315A is supported so that it can be raised or lowered.

In an initial unloaded condition in which a document stack is not loaded on the feed belt 311 of the document stack section 310, the separation lever 315A is inclined by the weight 315C, so that the right end of the separation lever is raised (the position (1) in FIG. 6). In this case, the pin 315H is located at an upper dead point of the cam groove 315J, and stopped in this position. When the separation lever 315A is located in this raised position, the separation sensor S14 is turned off.

A document stack D is loaded on the feed belt 311 of the document stack section 310 and the end portion of the separation lever 315A is lowered by the weight of the document stack D. In this case, the pin 315H of the separation lever 315A is lowered along the passage "a" of the cam groove 315J, and passes through the cutout portion 311D of the feed belt 311, and then stops when it comes into contact with the pushing lever 314A that is under a stop condition (the position (2) in the drawing). When the separation lever 315A is lowered in the aforementioned manner, the separation sensor S14 is turned on. At this time, the end portion of the paper holding lever 310Z presses the upper surface of the document stack by its weight.

When the documents of the document stack provided on the document stack section 310 are conveyed out by the top-feed-bottom-return system, the end of the separation lever 315A is pinched between the last page of the document stack and the first page of the returned documents, and as the returned documents are increased, the end of the separation lever is gradually raised (the position (3) in the drawing). When the first page of the returned documents has reached the uppermost position, the separation lever jumps up (the position (1) in the drawing). At this time, the separation sensor S14 is turned off.

The separation lever 315A is withdrawn to the left by the attracting action of the solenoid SL3 (the position (4) in the drawing). When a voltage is impressed upon the solenoid SL3, the plunger SL3 is attracted, so that the oscillatory lever 315C is oscillated around the shaft 315D counterclockwise in the arrowed direction. Therefore, the separation lever 315A connected by the pin 315F is moved to the left. The pin 315H implanted in the separation lever 315A is moved downward along the passage "c" of the cam groove 315J, and comes into contact with the left end of the cam groove 315J and the movement of the pin is stopped. At this time, the leaf spring 315K is slidably contacted with the upper surface of the separation lever 315A, so that the separation lever 315A can be prevented from jumping up.

After a predetermined period of time has passed, the solenoid SL3 is turned off. Then, the oscillatory lever 315c is rotated clockwise around the fulcrum 315D by the action of the spring 315E, so that the lever 315A is moved to the right (the position (2) in the drawing). At this time, the leaf spring 315K maintains the lever 315A horizontal, so that the pin 315H is moved to the right in the passage "b". Therefore, the end portion of the lever enters the cutout portion 311D of the feed belt 311, and the lever is rotates being raised by its weight. Accordingly, the lever comes into contact with the lower surface of the document.

On one side of the feed belt 311, the cutout portion 311D is formed for the purpose of allowing the separation lever 315A to withdraw downward. When the feed belt 311 is rotated conveying a document stack loaded on it, there is a possibility that failure in conveyance occurs when the cutout portion 311D collides with the lower layer of the document stack. In order to prevent the occurrence of conveyance failure, one side of the document stack is pushed upward before the cutout portion 311D passes through the upstream side of document conveyance so that the document stack can not interfere with the feed belt 311. That is, when the first exposed document is discharged and returned to the bottom of the document stack on the feed belt 311 of the document stack section 310, the separation lever 315A is raised by a predetermined height so that the separation lever 315A can be positively located above the feed belt 311, that is, the separation lever 315A can be positively located above the cutout portion 311D preceding the protruding gripper section 311B. In this way, the related portion of the document stack is withdrawn upward. For that reason, the solenoid SL4 is operated by a signal of document replacement so that the plunger SL4A is attracted and the oscillatory lever 314C is oscillated around the shaft 314D. In this way, the pushing lever 314A is raised. When the pushing lever 314A is oscillated, the separation lever 315A is raised by a predetermined height and stopped. Due to the foregoing, one end of the document stack is raised, so that the cutout portion 311D of the feed belt 311 is allowed to pass through.

As shown in FIGS. 2 and 3, the movable pushing plate 317 of the movable pushing means is secured on the downstream side of document flow of the feed belt 311, and the drive plate 319 is secured with screws to the oscillatory shaft 317A supported by a bearing attached on both side plates that are integrated with the fixed bottom plate 310A, and accordingly they can be integrally oscillated. The resilient deformation member (for example, a torsion spring) 317B is wound around the oscillatory shaft 317A, and both end portions are respectively contacted with the drive plate 319 and the movable pushing plate 317 so that they are pushed by the spring force. At this time, the movable pushing plate 317 and the drive plate 319 are pushed in a direction in which the torsion spring 317B is opened, however, the lower end portion of the movable pushing plate 317 comes into contact with an end of the drive plate 319 in order to regulate the opening angle between the two not to be larger than a predetermined value. The force of the torsion spring 317B is adjusted to a predetermined value.

An actuator section (a shading plate section) 319A is protruded from one end of the oscillatory shaft 317A. The actuator section 319A turns on and off the optical path of the pushing home position sensor (for example, a photointerrupter) S3 so that the home position of the drive plate 319 can be detected. The actuator section 319A can be oscillated around the oscillating shaft 317A. A gear G1 is secured to one end of the oscillatory shaft 317A, and connected with a gear G2 secured to the drive shaft of the pushing motor M1.

The document leading end stopper 318 is secured to the automatic document feeder body at a position close to the end portion of the document flow of the movable pushing plate 317.

A feed section 320 is provided above the movable pushing plate 317. The feed section 320 includes a delivery roller 321, drive roller 323, idle roller 322, feed belt 324 provided around both rollers, and reverse roller 325 for preventing double feeding, wherein the reverse roller 325 is located below the feed belt 324. The drive force of the drive motor M2 is transmitted to the drive roller 322 through the electromagnetic clutch CL1.

A frame 321A supporting the delivery roller 321 can be freely oscillated around a shaft A. The actuator section 321B is integrated with the frame 321A and protruded from its end. The actuator section 321B turns on and off an optical path of the detection sensor S4 fixed at a predetermined position of a fixed stay member 300A of the automatic document feeder 300.

Figure 7:
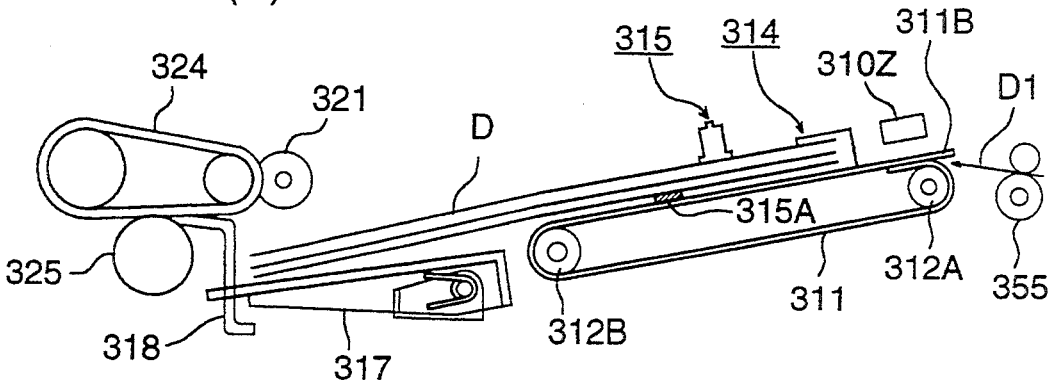
FIGS. 7(A) to 7(C) are schematic illustrations showing a condition of conveyance of a returned document on the document stack unit in the document circulation mode.
Figure 7:
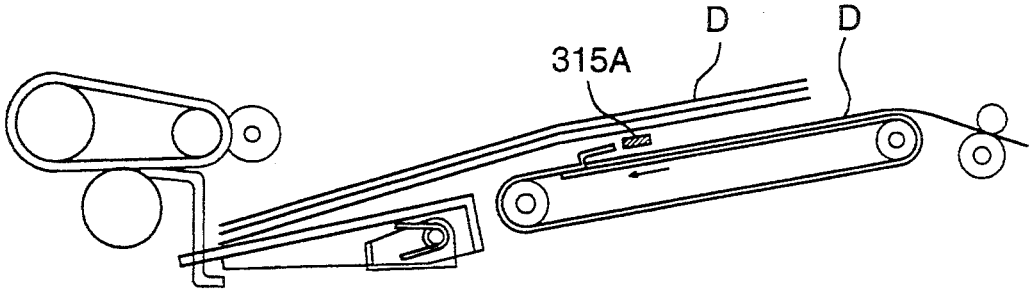
Figure 7:
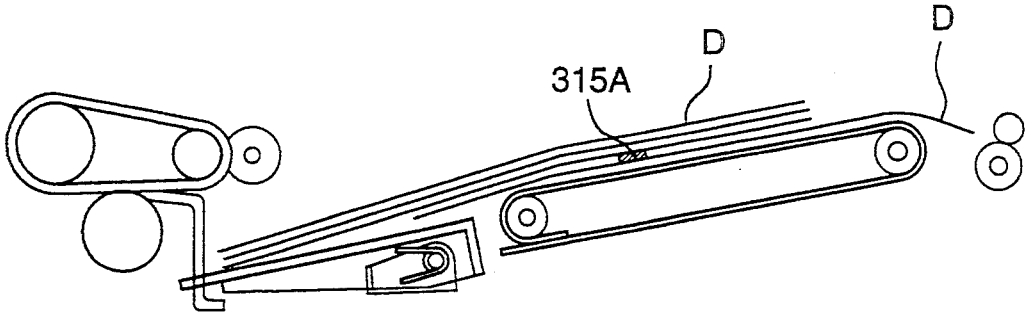

FIGS. 7(A) to 7(C) are schematic illustration showing a conveyance condition of documents D conveyed from the paper discharging and reversal section 350 to the feed belt 311 and the movable pushing plate 317 of the document stack section 310.

After the leading end of document D1 has been detected by the leading end passage sensor S9, the clutch is connected, and the leading end of the document D is held by the gripper section 311B of the feed belt 311 that starts rotating from the home position. When the feed belt 311 is further rotated, the document D is held on the rough surface of the feed belt 311, and conveyed to the left and inserted below the lowermost layer of the document stack that has not been processed yet (shown in FIGS. 7A and 7B). As described before, the separation lever 315A passes through the cutout portion 311D of the feed belt 311 by the action of the pushing lever 314A being driven by the solenoid SL4. Accordingly, the document stack is raised to a predetermined height by the separation lever 315A.

At this time, the movable pushing plate 317 is located at a lower position, and the leading ends of the document stack D are separated from the delivery roller 321. In this case, the surface speed of the feed belt 311 is set slightly faster than that of the circulation discharging roller (deviation correction roller) 355 of the paper discharge and reversal section 350, or the surface speed of the feed belt 311 is set equal to that of the circulation discharging roller 355 of the paper discharge and reversal section 350. In this case, since the surface of the feed belt 311 that comes into contact with the document D is rough, the document is pressed against the feed belt 311 by its weight and positively held and conveyed by the feed belt 311.

Moreover, the surface of the feed belt 311 that comes into contact with the lowermost layer of the document stack D is slippery. Therefore, the feed belt 311 smoothly slides coming into contact with the lower surface of the document stack.

The document D held by the feed belt 311 is conveyed in the following manner. When the conveyance direction of the gripper section 311B of the feed belt 311 is changed downward when the feed belt 311 rotates along the idle roller 312B, the document D separates from the gripper section 311B and slides on the movable pushing plate 317 located a little lower than the upper surface of the feed belt 311. Then the document D collides with the document leading end stopper 318, and the document D is stopped. Accordingly, when the overall circumferential length of the feed belt 311 is set to be longer than the maximum length of the document D to be conveyed in the forward direction, the document returning operation can be smoothly performed.

With reference to FIG. 2, the intermediate conveyance section 330 is provided downstream of document conveyance of the feed section 320. The intermediate conveyance section 330 includes a pair of first intermediate conveyance rollers 331 that are normally rotated, curved guide plate 332, a pair of second conveyance rollers 333 that are normally and reversely rotates, and a pair of third intermediate conveyance rollers 334. These units form a conveyance passage to convey a document D sent out from the feed section 320, to one end of the platen glass 111.

A reversal means is provided on the left of the platen glass 111 on the left of the third intermediate conveyance rollers 334. A pair of reversal conveyance rollers 335 are always normally rotated by the action of the one-way clutch CL5. Numeral 336 is a curved guide connecting the nip position of the third conveyance rollers 334 with that of the reversal conveyance rollers 335, and the guide 336 forms a document reversal feed passage. A reversal detection sensor is provided in a portion of the document reversal feed passage so as to detect the passing of a reversed document. Numeral 337 is a changeover claw.

On the platen glass 111, there is provided a conveyance belt 341 that winds around the drive roller 342, idle roller 343, four document holding rollers 344, and tension roller 345. Therefore, the belt 341 can be rotated around the rollers. A clutch and brake are mounted on the shaft of the drive roller 342, and the drive roller 342 is driven by the drive force of the drive motor M2.

The paper discharge and reversal section 350 includes paper discharge rollers 351, 352, changeover claws 353, 357, reversal conveyance roller 354, circulation paper discharge roller 355, and guide plates 356A, 356B, 356C. The paper discharge rollers 351, 352, paper reversal discharge roller 354 and circulation paper discharge roller 355 are driven by the paper discharge motor M3. The paper discharge roller 353 and the circulation paper discharge roller 355 are normally driven by the paper discharge motor M3, and the reversal conveyance rollers 351, 354 are driven normally and reversely. The changeover claw 353 is driven by the changeover solenoid SL1. The changeover claw 357 is driven by the changeover solenoid SL2.

A paper discharge tray section 360 is provided in the upper portion of the copier body 100 at a position close to the paper discharge opening of the paper discharge reversal section 350 of the automatic document feeder 300. The paper discharge tray section 360 includes a fixed tray 361 having an inclined surface secured to the upper surface of the casing of the copier body 100 with screws, and a movable tray (resin tray) 363 pivotally mounted on the fulcrum shaft 362 provided at one end of the fixed tray 361 so that the movable tray 363 can be oscillated. Under the condition that the movable tray 363 is folded, the inclined upper surface of the fixed tray 361 and the inclined lower surface of the movable tray 363 maintains a predetermined interval and forms a reversal paper discharge passage 364. A document D sent from the reversal paper discharge roller 354 goes up in the reversal paper discharge passage 364 and temporarily stops, and is successively introduced into the automatic document feeder 300 by the reverse rotation of the reversal paper discharge roller 354. In the RADF mode of two-sided documents, the document D passes through the guide 356c, and is discharged outside by the paper discharge roller 352 of the paper discharge reversal section 350, and the discharged document is stacked on the upper surface of the movable tray 363.

Under the condition that the movable tray 363 of the paper discharge tray section 360 is oscillated and developed, the upper surface side of the fixed tray 361 is extended onto the upper surface side of the movable tray 363. Consequently, a large-sized document such as a document of A2 and a fan-folding paper (CCF) can be discharged.

In the reversal circulation mode (R-RDH) of two-sided documents, the changeover claws 357 is changed over downward, and the document D conveyed into the reversal paper discharge passage 364 passes through the reversal paper discharge roller 354, guide plate 356C, 356B and circulation paper discharge roller 355, and is returned to the document stack section 310.

Figure 8:
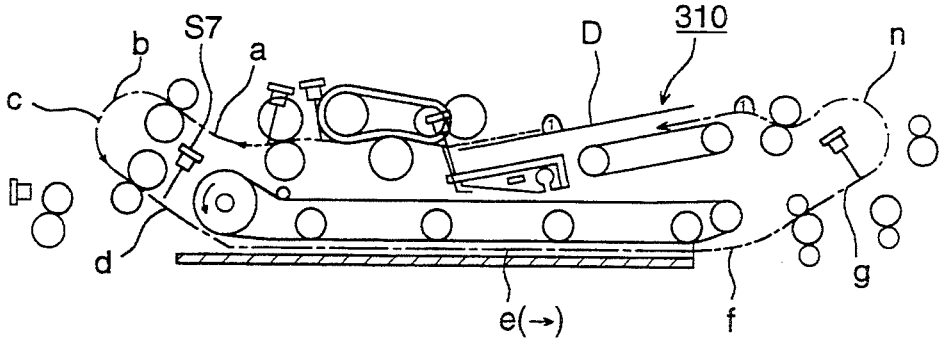
FIGS. 8(A) and 8(B) are schematic illustrations showing a document conveyance passage in the RDH and R-RDH modes.
Figure 8:
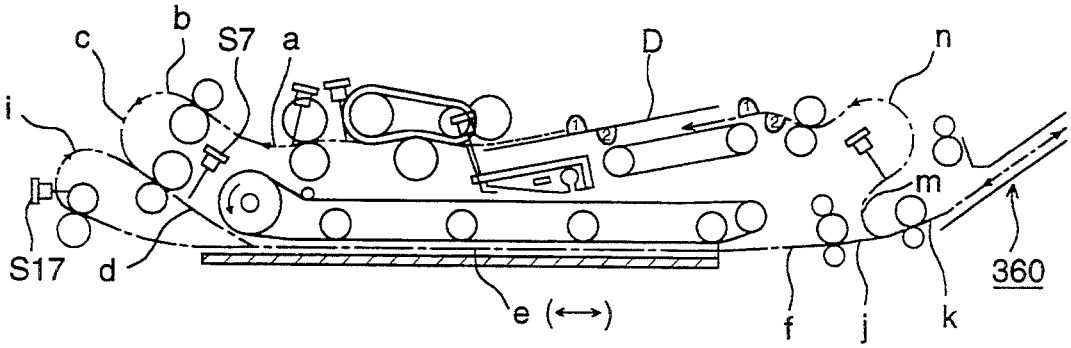

FIGS. 8(A) and 8(B) are schematic illustrations showing a document conveyance path (shown by a one-dotted chain line) in the RDH-mode and the RDH mode.

FIG. 8(A) is a schematic illustration of the RDH mode showing the document circulation conveyance of one-side document and one-side copy. One-side document D is conveyed through the normal circulation paths a, b, c, d and e. After exposure, the document is conveyed through the paths f, g and h, and enters the gripper section 311B. Then the document is conveyed by the feed belt 311 so that it is returned to the lowermost layer of the document stack in the manner of bottom-return.

FIG. 8(B) is a schematic illustration of the R-RDH mode showing the document circulation conveyance of two-side document and two-side copy. The paths of two-side documents in the case where the odd-numbered surfaces are exposed, are the same as those in the aforementioned RDH mode. The sheets, one side of which has already been copied, are stacked in ADU 180. Then the document is sent out again, and conveyed through the paths a, b, c and d. Then the surfaces of the document are inverted in path i. After exposure, the document D is conveyed through f, j and k, and switched back here. After that, the document D is returned to the document stack section 310 through the paths m and n while the surfaces of the document are set in the same manner as when the document was fed.

Figure 9:
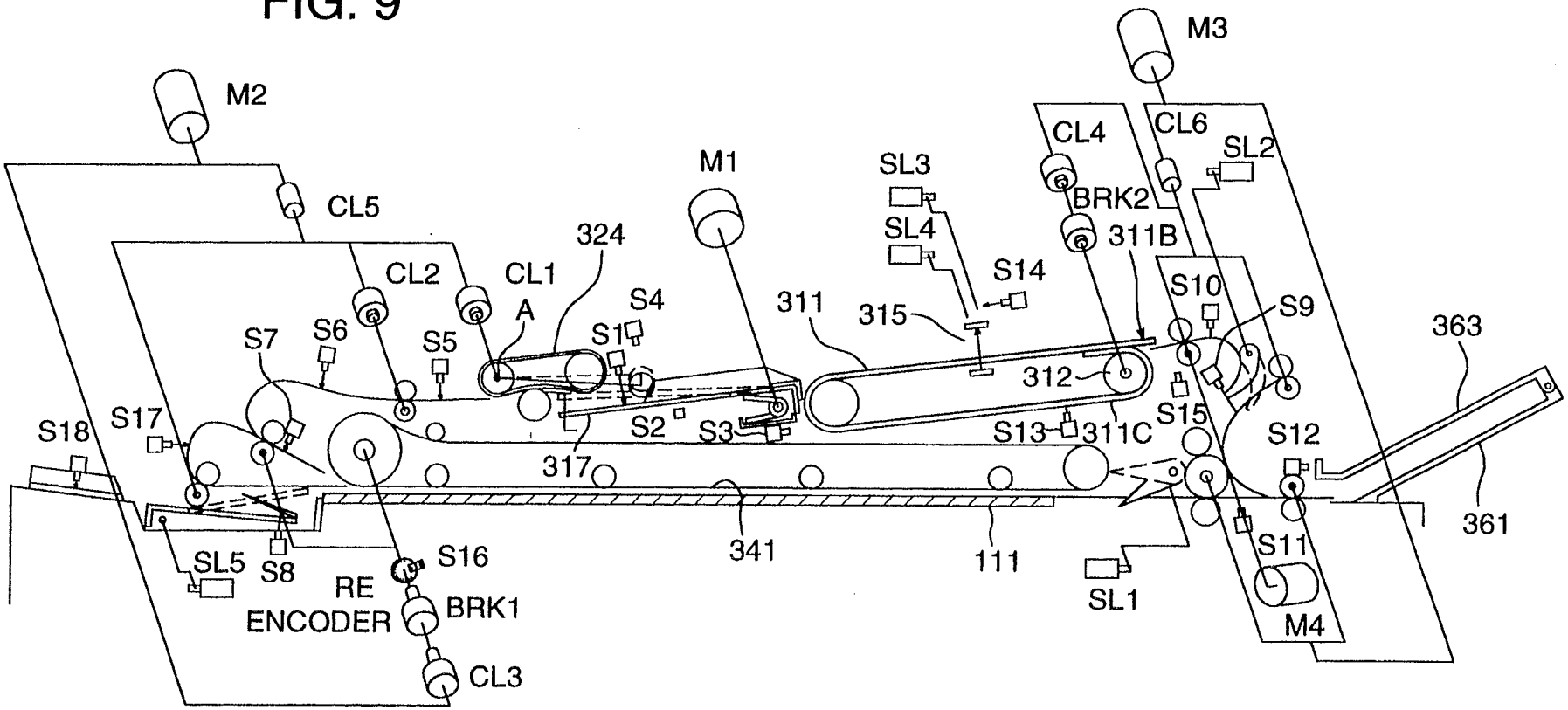
FIG. 9 is an arrangement view showing a drive system of the automatic document feeder.
Figure 10:
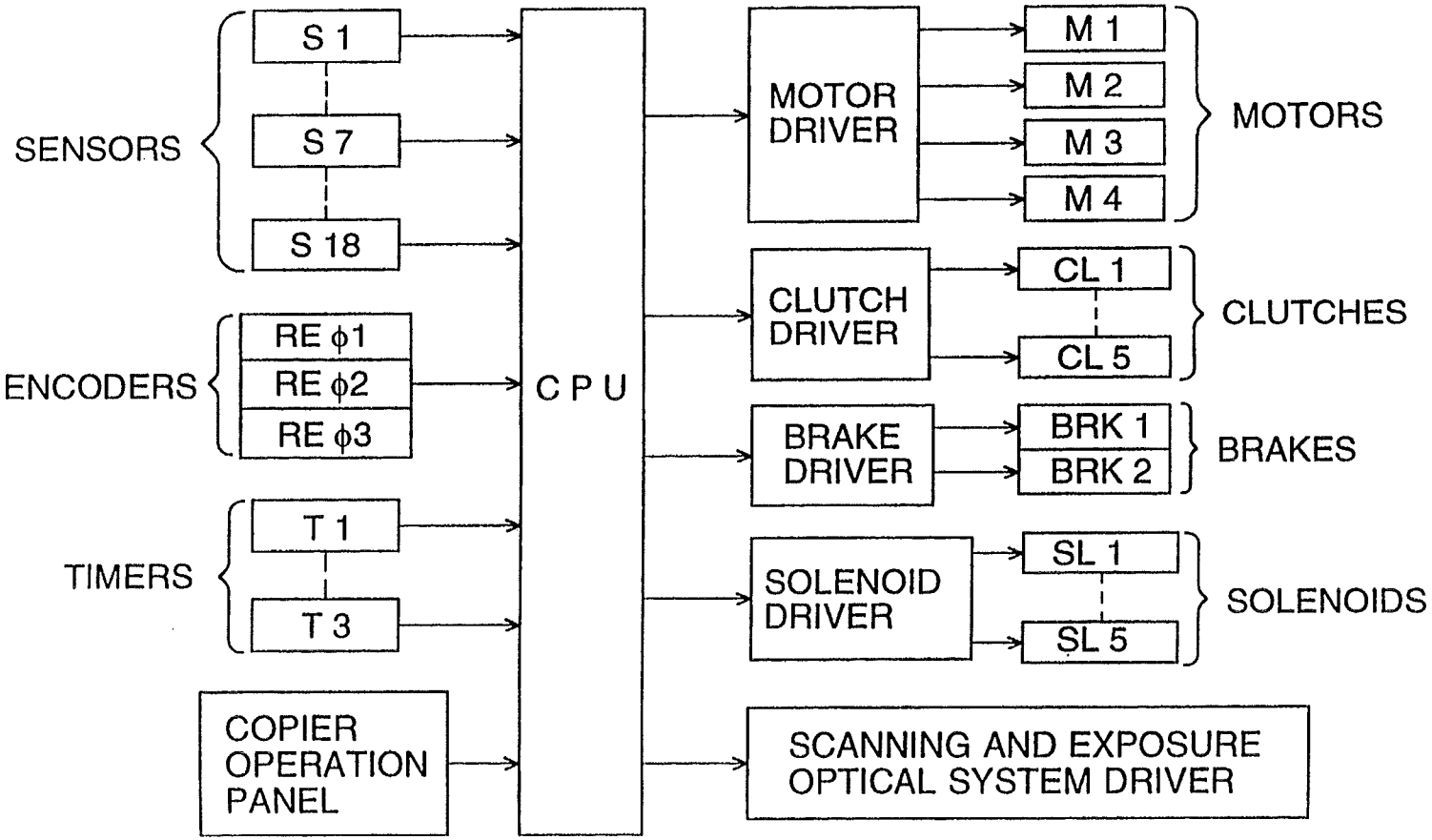
FIG. 10 is a block diagram of the drive system.
Figure 11:
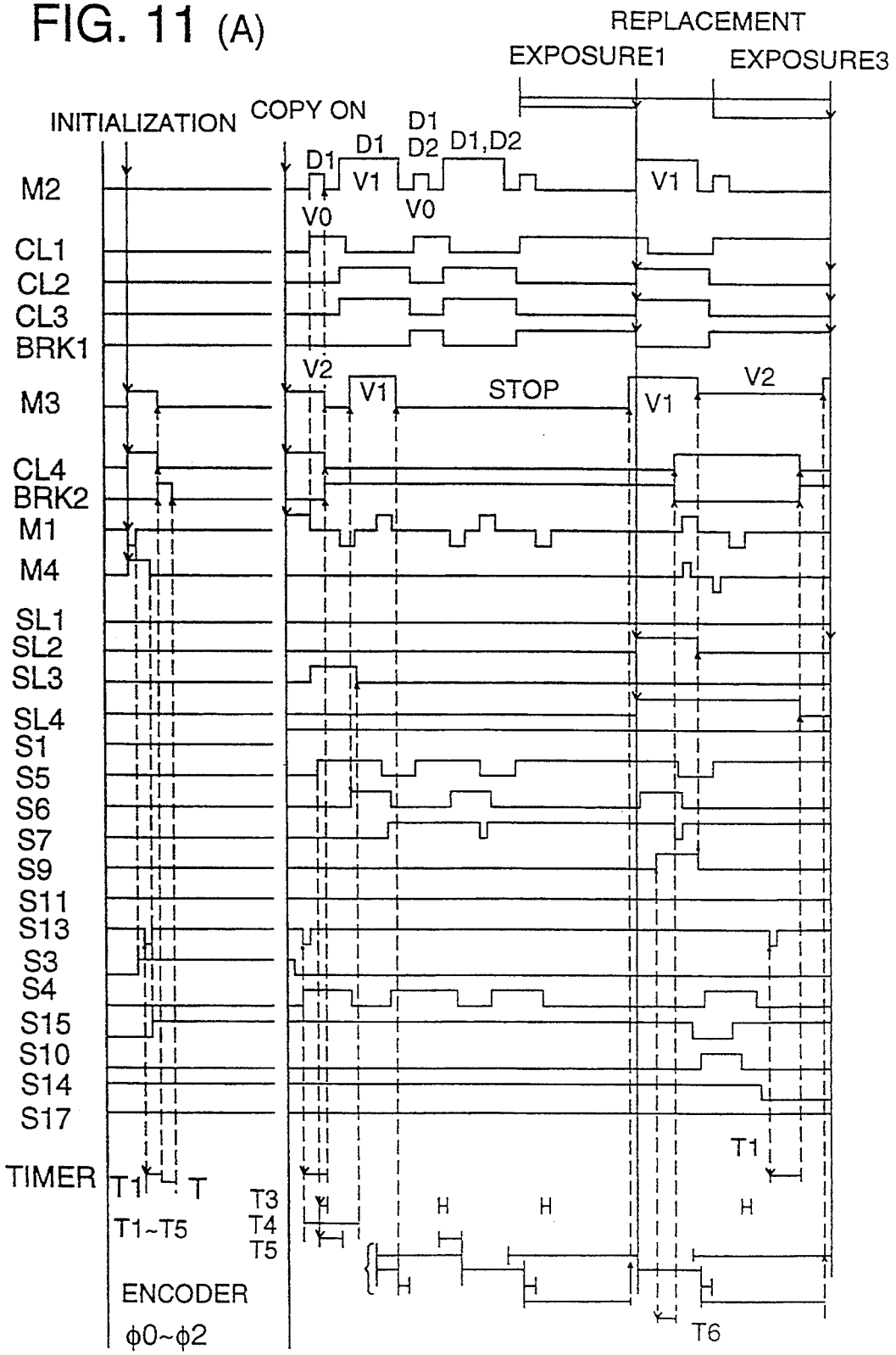
FIGS. 11(A) and 11(B) are timing charts of the drive system.
Figure 11:
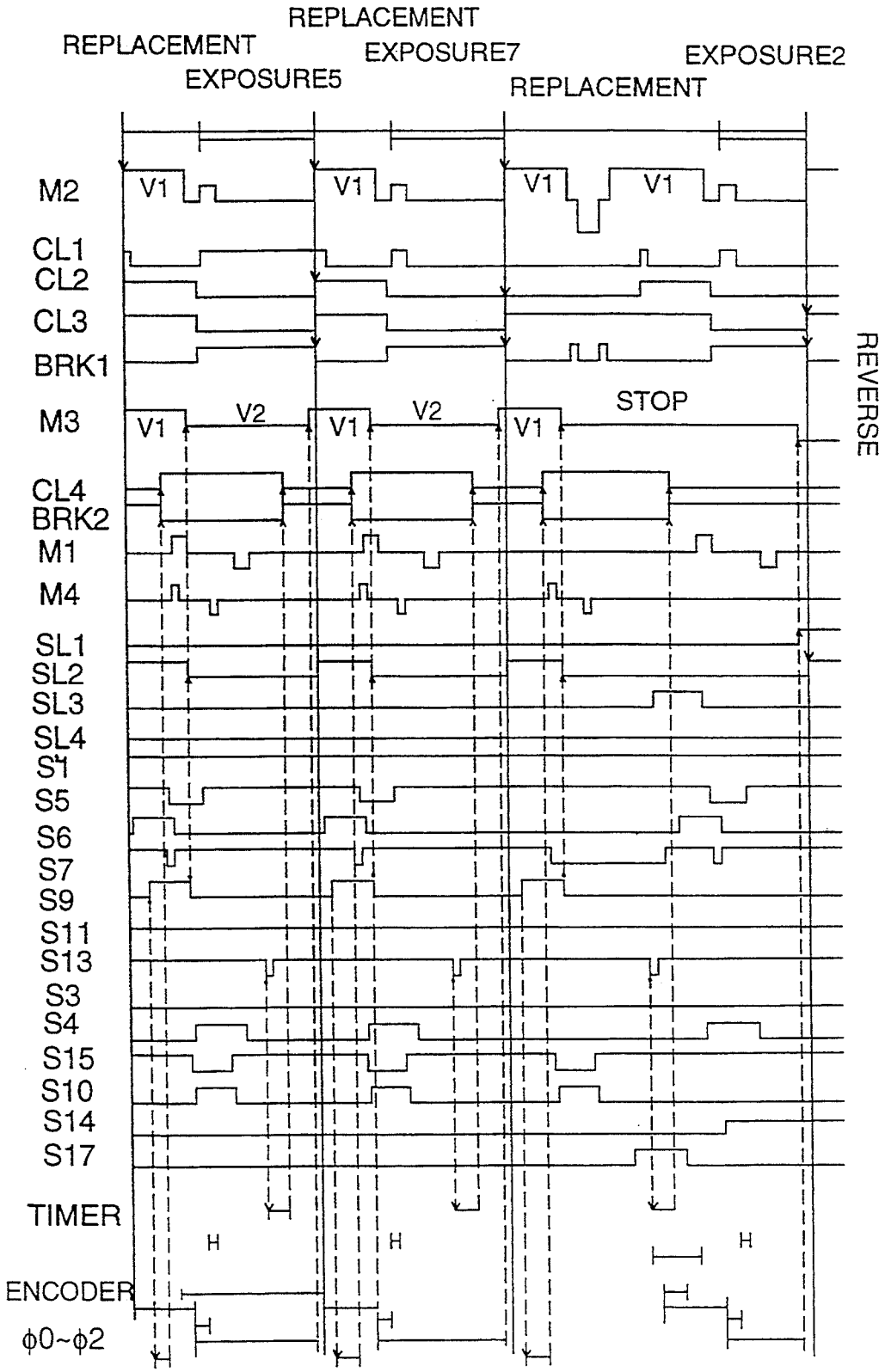

FIG. 9 is an arrangement view showing the drive system (the power transmission system) of the automatic document conveyance apparatus 300. FIG. 10 is a block diagram of the drive system. All the operations of paper feed and conveyance in the process of document circulation and document reversal circulation are controlled by a CPU. FIGS. 11(A) and 11(B) are timing charts of document conveyance operations in the RDH mode of the automatic document feeder.

The one-sided document circulation conveyance mode (RDH) is described as follows with reference to FIGS. 12(A) to 12(F).

(1) Initialization (1A) A main switch of the copier body 100 is turned on, and then the pushing motor M1 is reversed and the deviation correction motor M4 is normally rotated. At the same time, the paper discharge motor M3 and the bottom-return clutch CL4 are turned on, so that the drive roller 312A is rotated.

(1B) When the movable pushing plate home position stop main switch is turned on, the pushing motor (stepping motor) M1 is reversed, so that the drive plate 319 is oscillated. Accordingly, the actuator section 319A fixed to the oscillatory shaft 317A turns on the pushing home position sensor S3. By the detection signal, the reverse rotation of the pushing motor M1 is stopped, so that the drive plate 319 and the movable pushing plate 317 are stopped at the lowest initial position (home position), which is effective to absorb the time lag of the drive gear and sensor. At this home position stop position, a clearance is provided to accommodate the predetermined maximum amount of document stack D.

(1C) Document Stacking

When the document stack D is stacked on the feed belt 311 and the movable pushing plate 317, the setting detection sensor S1 is turned on, and the mode is set at the ADF mode. At the same time, the size detection sensor S2 is turned on, so that the document size is detected. Then, the R-RDH mode is selectively inputted.

(1D) Home Position Searching Operation of the Deviation Correction Roller

The deviation correction roller 355 can be moved in a direction perpendicular to the paper conveyance direction, and driven by the deviation correction motor M4 that is rotated when the main switch is turned on. The deviation home position sensor S15 to detect the roller position is provided outside of the paper passage of the deviation correction roller 355.

In the case where the sensor S15 is turned off when the main switch has been turned on, the deviation correction motor M4 is rotated, so that the deviation correction roller 355 is moved to a side opposite to the viewer's side, and when the sensor S15 is turned on, the motor M4 is stopped. The motor M4 is a step motor, and after it has been stopped, a predetermined voltage is impressed upon the motor, so that the motor is set in a holding condition. In the case where the sensor S15 is turned on, the motor M4 is reversed, so that the roller 355 is moved to the viewer's side and the sensor S15 is once turned off. After that, the motor M4 is normally rotated again, and when the sensor S15 is turned on, the motor M4 is stopped and held. When the above operations are performed, the roller 355 can be always accurately stopped at a predetermined position irrespective of the play in the units from the motor M4 to the roller 355. Usually, an adjustment operation is conducted so that this predetermined position can be located almost in the middle of a capable range of the roller 355.

(1E) Bottom-return Feed Belt Home Position Search Operation

As shown in FIGS. 3 and 4, a through-hole 311C for detecting the home position is formed on the bottom-return feed belt 311 having the gripper section 311B, wherein the belt 311 is provided between the drive roller 312 and the idle roller 313. When the main switch is turned on, the paper discharge motor M3 and the bottom-return clutch CL4 are turned on, so that the drive roller 312 is rotated. The drive roller 312 is driven through the one-way clutch CL6, and always rotated in a direction shown by a solid line irrespective of the rotational direction of the motor M4.

When the home position detection hole 311C on the feed belt 311 passes through the belt home position sensor S13, the sensor S13 is turned off, and after a predetermined period time has passed, the bottom-return clutch CL4 is turned off, and at the same time the paper discharge brake BRK2 is turned on, so that the drive roller 312A is suddenly stopped. In this way, a timed relation is adjusted so that the gripper section 311B of the bottom-return belt 311 can be located on the extension of the deviation correction rollers 355 and the cut-out portion 311D can agree with a position of the separation lever 315A.

(2) Document Circulation Conveyance

According to the above initializing operation, document feed preparation work is completed, and successively a document feed operation starts. FIGS. 13(A) to 13(F) are schematic illustrations showing the document conveyance process of odd number pages.

(2A) When the copy button is turned on, the pushing motor M1, paper discharge motor M3 and bottom-return clutch CL4 are turned on, so that an ADF and copy operation can be started.

(2B) When the copy button has been turned on, the bottom-return clutch CL4 is turned on so that a low speed operation of the paper discharge motor M3 is started. Due to the foregoing, the drive roller 312A is rotated, and the feed belt 311 is driven. When the detection hole 311C of the feed belt 311 passes through the belt home position sensor S13, a detection signal is sent from the sensor. According to the detection signal, the feed belt 311 is stopped by the brake BRK2 after a predetermined period of time has passed. After that, the number of copies separation solenoid SL3 is turned on, and the separation lever 315A passes through the cut-out portion 311D and comes into contact with the lowermost layer of the document stack.

(2C) When the copy button is turned on, the pushing motor (stepping motor) M1 is driven, and the movable pushing plate 317 is oscillated through the drive plate 319 fixed to the oscillatory shaft 317A, and the torsion spring 317B. Therefore, an end portion of the movable pushing plate 317 is raised, so that the document stack D is lifted. In this ascent process, the oscillation angle of the oscillatory shaft 317A is converted into a signal by a rotary encoder so that the pulse is counted by the count C1.

(2D) When an upper surface of the document stack D stacked on the movable pushing plate 317 is lightly contacted with the outer circumferential surface of the delivery roller 321 that has been lowered to a predetermined position by its weight, the movable pushing plate 317 raises the delivery roller 321 while holding the document stack. After the delivery roller 321 has been raised by a predetermined amount, the pushing detection sensor S4 mounted on the end is turned on, so that a counting operation is started. When the delivery roller 321 is further raised, a frame to hold the discharge roller 321 comes into contact with a fixed member not shown, so that the ascending motion of the delivery roller 321 is stopped. However, the drive plate 319 is further rotated counterclockwise while compressing the torsion spring 317B. Accordingly, an interval between the movable pushing plate 317 and the drive plate 319 is reduced. When the pushing detection sensor S4 is turned on, the pushing force becomes the initial setting force (for example, the roller weight 50 g), and the counting operation of the count C1 is stopped.

(2E) Stack thickness of the document stack D is detected by the output of the count C1, and a designation pulse is determined according to the document size detected by the size sensor S2 and the pushing pulse table that has previously been determined by the setting input of a thick or thin paper.

When the document stack thickness is detected by a value provided by the count C1, this document stack thickness is classified to, for example, three steps of "large", "middle" and "small".

The document size is set to be, for example, one of B5 to A3, and detected by the size detection sensor S2. In the case where several sizes of documents are mixed and stacked on the stack section, an operator presses a mixed document button on the operation panel so that the mixed several sizes of documents can be designated. Thickness of a single sheet of document can be designated by pressing a thin paper or a thick paper button provided on the operation panel.

As described above, the document stack thickness and the document size are automatically detected by the sensors, and the mixed several sizes of document and the document paper thickness are manually set by the operator.

In accordance with the aforementioned detected values and the manually set values, a pushing pulse table is previously set and stored in a nonvolatile memory. The count C2 is determined by the above sheet condition inputting means.

(2F) The count C2 is inputted by the aforementioned designated pulse, and further when the drive plate 319 is driven, the counting operation of the count C2 is continued. The drive plate 319 is oscillated until the designated count C2 is counted up. Then, a winding amount of the torsion spring 317B is increased, so that the resilience is approximately linearly varied and the pushing force is increased.

When the count C2 is counted up, the movable pushing plate 317 pushes out the document D by a predetermined pushing force (for example, 100 g), and comes into contact with the roller 321 with pressure, and the pushing motor M1 is stopped.

(2G) Concurrently when the pushing motor M1 is stopped due to the completion of counting, the delivery clutch CL1 and the drive motor M2 are turned on, and rotated at low speed, so that a document feed operation is started. That is, the document feed operation is carried out in the following manner: the feed belt 324 is rotated by the drive motor M2 that is driven at low speed; upper documents are sent out by the feed belt 324; and only the uppermost document D1 is separated from other documents by the reverse roller 325.

(2H) The leading end of the aforementioned separated document D1 is detected by the skew correction sensor S5. After a predetermined period time (timer T1) has passed from the generation of the leading end detection signal, the drive motor M2 is turned off, and the registration clutch CL2 is turned off. Due to the foregoing, the document D1 collides with the first intermediate conveyance roller (registration roller) 331, and a loop is formed. During the formation of the loop, the skew of the document D1 can be corrected. (Refer to FIG. 12A.)

(2I) Before the completion of the time measuring operation performed by the timer T1, the paper discharge motor M3 and the paper discharge brake BRK2 are turned off by the action of the timer T2, so that the rotation of the drive roller 312A is suddenly stopped, and the home position of the gripper section 311B of the feed belt 311 is determined.

(2J) When a predetermined period of time has passed after the start of detection of the detection hole 311C of the feed belt 311, wherein the passage of time is measured by the timer T3, the drive motor M2 is driven again. At this time, the drive motor M2 is driven at high speed, and the registration clutch CL2 and the conveyance clutch CL3 are turned on concurrently when the delivery clutch CL1 is turned on, so that the document D1 is conveyed downstream. When the leading end of the document D1 crosses the passage detection sensor S6, the delivery clutch CL1 driving the drive roller 323 is turned off, and the feed belt 324 is idly rotated until the trailing end of the document D1 passes through the sensor S6 and then the feed belt 324 is stopped. However, the document D1 is successively conveyed by the first intermediate conveyance rollers 331 that are driven by the drive motor Mi.

(2K) When the timer T3 has counted up, the pushing motor M1 is changed over so that it can be reversed, and the drive plate 319 and the movable pushing plate 317 are lowered so that the pushing action is released. When the home position detection sensor S3 detects that the drive plate 319 has returned to the initial position, the pushing motor M1 is stopped. In the case where a plurality of documents are successively fed, the drive plate 319 and the movable pushing plate 317 are not returned to the home position but stopped at an intermediate position in accordance with a detection signal of the pushing detection sensor S4 and a drive start signal of the drive means.

(2L) After the sensor S13 has detected the passage of the home position detection hole 311C of the feed belt 311, the timer T3 counts the passage of a predetermined period of time. Then, the separation solenoid SL3 of the lifting means 314 is turned off and the lifting lever 314A is lowered. As a result of the foregoing, the separation lever 315A held by the lifting lever 314A is also lowered by its weight, so that the lifting action of one end of the document stack is released, and the lever 314A is withdrawn under the lowermost document of the document stack, and the stopping position of the lever is detected by the sensor S14.

In the case where the document stack is set below the separation lever 315A of the document stack section 310, or the document stack is set into the document stack, the number of copies separation sensor S14 does not detect the stopping position. According to the signal, the pushing lever 314A is lowered when the solenoid SL3 is turned off, and when solenoid SL4 is turned on, the separation lever 315A is slid down along the path C shown in FIG. 7A, so that it is withdrawn to a position shown in FIG. 7C. Successively, when the solenoid SL4 is turned off, the separation lever 315A is advanced being pushed by the spring 315E, and reaches a position shown in FIG. 7B. As a result, the separation lever 315A is inserted below the cutout portion **311*d* of the feed belt 311**.

(2M) Next, when the leading end of the document D1 passes through the registration sensor S7 and a signal is sent, a counting operation is started by the encoder sensor S16 directly connected with the drive roller 342 of the conveyance belt 341 and the third intermediate conveyance rollers (registration rollers) 334. After the encoder RE has counted a predetermined number of counts ($\phi$1), the drive motor M2 is turned off. Further, at this time, the encoder plate RE starts a counting operation, and after a predetermined number of counts ($\phi$2) has been counted, the registration clutch CL2 and the conveyance clutch CL3 are turned off, and the conveyance brake BRK1 is turned on. In this way, the conveyance belt 341 and the third intermediate conveyance rollers 334 are stopped. At this time, the leading end of the document D1 reaches a predetermined waiting position (a position separate from the stop position by L1, for example 236 mm) on the platen glass 111 and stops (shown in FIG. 12B).

When the leading end of the first document D1 passes through the registration sensor S7 and a detection signal is generated, the pushing motor M1 starts a pushing operation of the drive means according to the detection signal, so that the drive plate 319 and the movable pushing plate 317 are raised, and successively the document D2 is pushed.

(2N) After a predetermined period time has passed from the completion of counting of the encoder plate RE ($\phi$2), the drive motor M2 and the delivery clutch CL1 are turned on, and the delivery roller 321 and the feed belt 324 are rotated at low speed. Therefore, the document D2 is fed at low speed, and in the same manner as the document D1, the document D2 collides with the first intermediate conveyance rollers (registration rollers) 331 to form a loop, and then the conveyance of the document D2 is stopped. (Refer to FIG. 12C.)

(2O) Then, after a predetermined period of time has passed, the drive motor M2, delivery clutch CL1, registration clutch CL2 and conveyance clutch CL4 are turned on, and the conveyance brake BRK1 is turned off, so that the documents D1 and D2 are conveyed at high speed. At a point of time when the document D1 reaches a predetermined exposure position on the platen glass 111, the drive motor M2 is turned off. Further, when the conveyance clutch CL3 and the registration clutch CL2 are turned off and the conveyance brake BRK1 is turned on, the document D1 is stopped at the exposure position, and at the same time the document D2 is stopped at a predetermined waiting position on the platen glass 111 (shown in FIG. 12D). That is, in this example, a document stopper is not used, and an amount of movement of the document D is controlled when the pulse number of the rotary encoder RE is counted on the basis of the registration sensor S7, and the document D is conveyed to the reading position.

Figure 12:
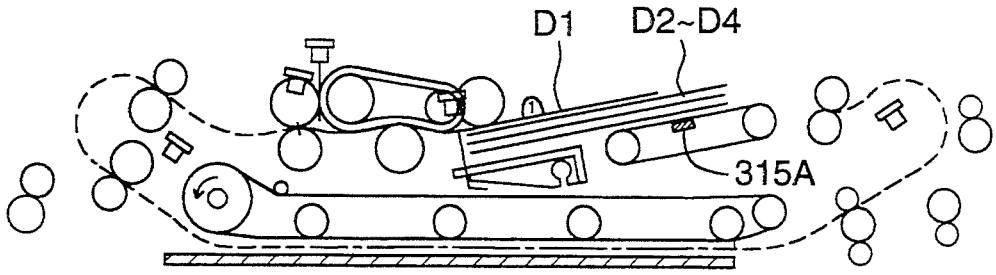
FIGS. 12(A) to 12(F) are schematic illustrations showing a document conveyance path for odd-numbered pages in the R-RDH mode.
Figure 12:
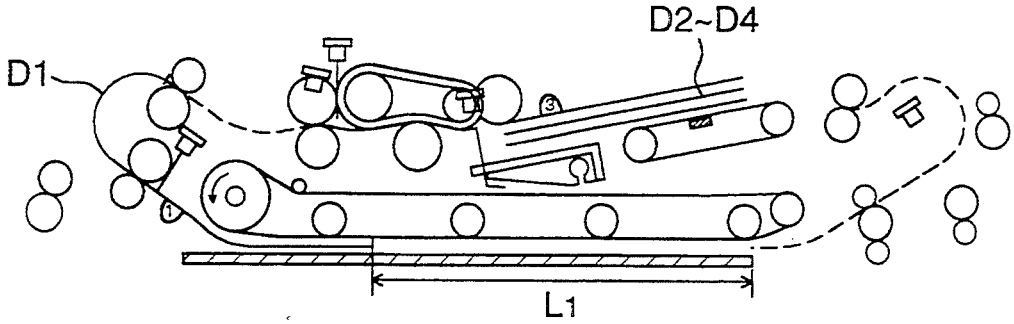
Figure 12:
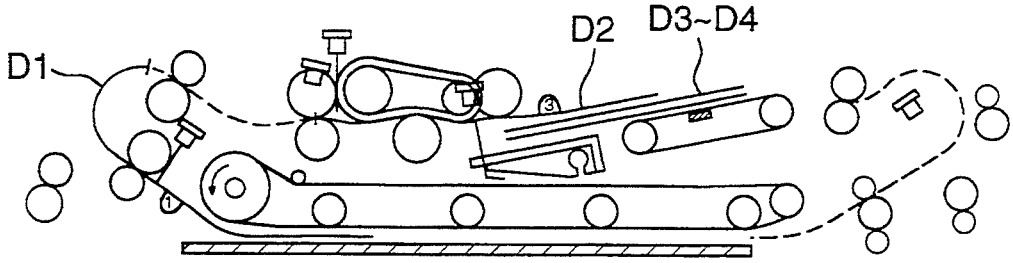
Figure 12:
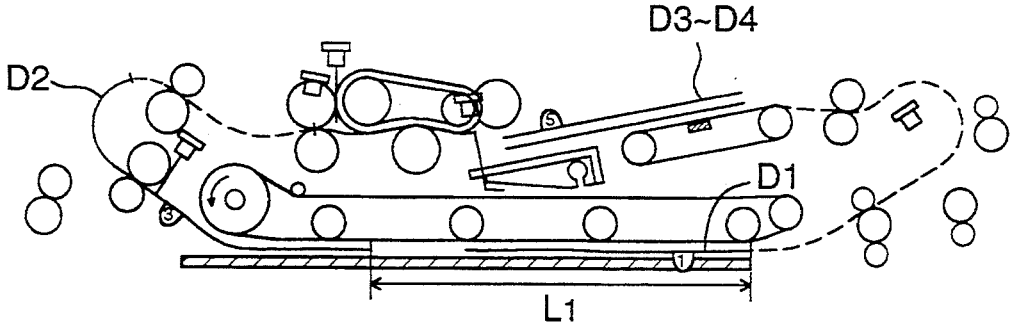
Figure 12:
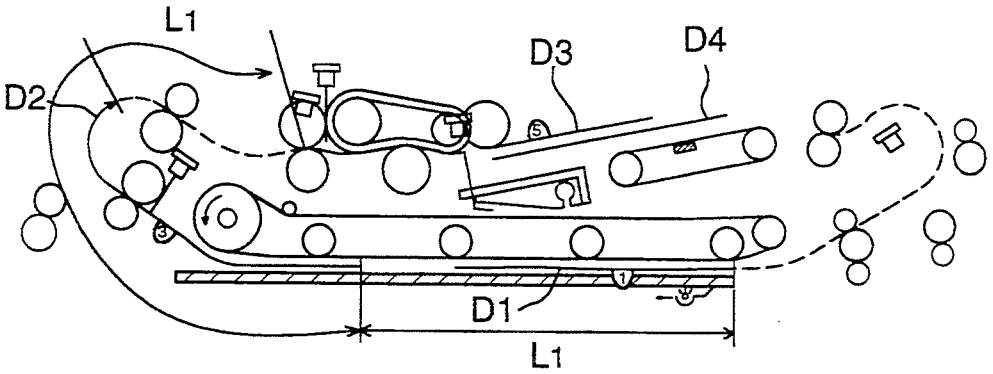
Figure 12:
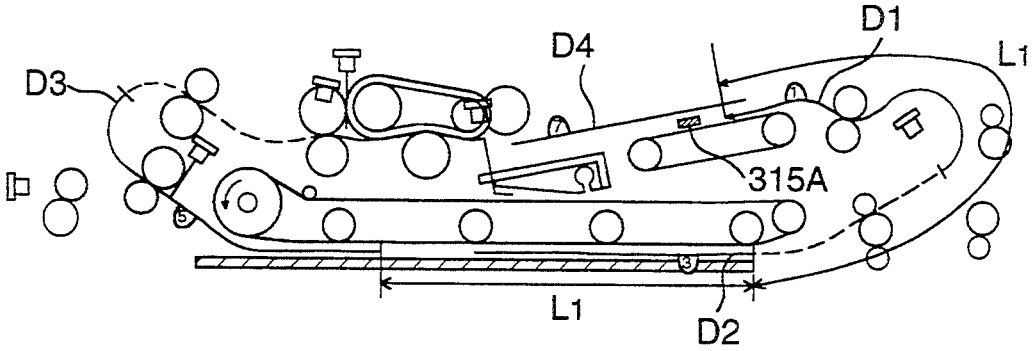

(2P) Under the condition that the documents D1 and D2 are stopped, the document D1 is exposed for scanning in accordance with the signal sent from the copier body (shown in FIG. 12E). In other words, while the document D1 is stopped on the platen glass 111, the first surface (1) is exposed by an exposure lamp of the scanning exposure section 110, and a document image can be formed on a photoreceptor drum through a lens and mirrors, and then a copy process is conducted on the document D1.

During the aforementioned exposure operation, the timer completes its counting operation, and the drive motor M2 and the clutch CL1 are activated, so that the feed belt 324 is rotated and the next document D3 is sent out. When the timer is controlled, a registration operation is carried out, and the document D3 is stopped at a position where an interval between the leading end of the document D3 and the trailing end of the previous document D2 can be maintained to be a predetermined interval L1.

Consequently, at this time, the three documents D1, D2 and D3 are aligned in a row on the conveyance passage from the separation feed means to the reading means. At this time, the document D1 is located in the reading position on the platen glass 21, and the document D2 is located between the conveyance belt 141 and the second intermediate conveyance rollers 132 (the second conveyance rollers), and the document D3 is located at a position where the leading end of the document D3 collides with the registration roller 331. In this way, each of the documents D2 and D3 waits in each waiting position so that the successive conveyance can be stably carried out.

(2Q) Document Replacement (Refer to FIG. 12E.)

After the exposure operation of the document D1 has been completed, the drive motor M2 is driven at high speed so that the conveyance belt 141 is rotated, and further the paper discharge motor M3 is rotated at high speed. The exposed document D1 passes through the paper discharge reversal section 350, and is returned to the bottom of the document stack section 310. When the paper discharge motor M3 is rotated at high speed, the document D1 passes through a branch portion in which the upper passage is opened when the changeover claw 357 is oscillated by the RDH changeover solenoid SL2, so that the document D1 advances in the guide plate 356B. When the leading end of the document D1 is detected by the paper discharge sensor S9 in the process of this conveyance operation, a time counting operation is started by the timer. When the counting operation is completed by the timer, the bottom-return clutch CL4 is turned on. In the case where the deviation detection sensor S10 is off at this time, the deviation correction motor M4 is rotated in a direction opposite to the viewer's side. In the case where the sensor S10 is on, the motor M4 is rotated in a direction of the viewer's side. After the sensor S10 has been turned off, the motor M4 is rotated again in the direction opposite to the viewer's side. Concurrently when the sensor S10 has been turned on, the motor is stopped, and the document collides with the width stopper plate 316 so that the deviation of the document is corrected and the document is aligned. In this case, the timer is set so that the bottom-return clutch CL4 can be turned on for the purpose of holding the leading end of the document D1 by the gripper section 311B of the feed belt 311.

In this example, the document conveyance distance from the paper discharge roller 351 to the gripper section 311B is longer than the length of a paper to be processed. However, it is possible to reduce the distance from the paper discharge roller 351 to the gripper section 311B to be shorter than the document length in the following manner: after the trailing end of the document D1 has passed through the paper discharge roller 351, the deviation correction motor M4 is turned on by the action of an independent timer.

(2S) Further, when the bottom-return feed belt 311 and the deviation correction rollers 355 are rotated, the document D1 is inserted below the upper document stack. In this case, the separation lever 315A of the number of copies separation means 315 is lifted upward by a predetermined height by the action of the number of copies separation solenoid SL4. Therefore, the document D1, the leading end of which is nipped by the gripper section 311B, is inserted below the lowermost document.

(2T) After the document replacing operation has been completed, the document D4 is further sent out. Since the movable pushing plate 317 is lowered immediately after the completion of registration, the document D1 returning to the document stack tray 310 passes above the lowered movable pushing plate 317, and collides with the document leading end stopper 318 and stops.

(2U) When the document D4 is conveyed to the registration position, the trailing end of the document D4 passes through the separation lever 315A, and the separation lever 315A is moved upward, so that the number of copies separation sensor S14 is turned on. In this way, it can be detected that the last document of the first circulation has been sent out.

(2V) After the document D4 has been conveyed to the second stop position, the document D1 returned to the document stack section 310 is sent out again while the document D3 is being exposed. In the same manner, D2, D3 and D4 are sent out, and when D4 is returned, the number of copies separation solenoid SL3 is operated so that the separation lever 315A is inserted below the document D4. This operation is repeated by a predetermined number of copies.

In this example, after the completion of registration conveyance, the document is returned when the movable pushing plate 317 is lowered. The registration conveyance operation may be conducted after the document has been returned. In this case, the paper holding lever 319 provided upstream of the separation lever 315A assists so that the returning document can be positively inserted below the document stack, and lightly comes into contact with the upper surface of the document by its weight. This paper holding lever 310Z is also effective to stabilize the operation of the separation lever 315A while curled papers or a small number of documents are conveyed.

(3) R-RDH Mode (Two-sided Document Circulation Conveyance Mode)

The aforementioned operation is conducted in a case in which a one-sided document is copied onto one side of a recording sheet. In the R-RDH mode in which a two-sided document is copied onto both sides of a recording sheet, the document is reversed in the first circulation so that only the odd number pages are copied (shown in FIG. 8(A)), and the even number pages are copied in the second circulation (shown in 8(B)). Of course, the recording paper feeding operation in the copier body 100 is conducted in accordance with the RDH and R-RDH modes.

FIGS. 13(A) to 13(F) and FIGS. 14(A) to 14(F) are schematic illustrations showing a document conveyance process of the R-RDH mode in which a two-sided document is copied onto both sides of a recording paper. A document conveyance operation of even number pages will be explained as follows in the case of small size documents.

Figure 13:
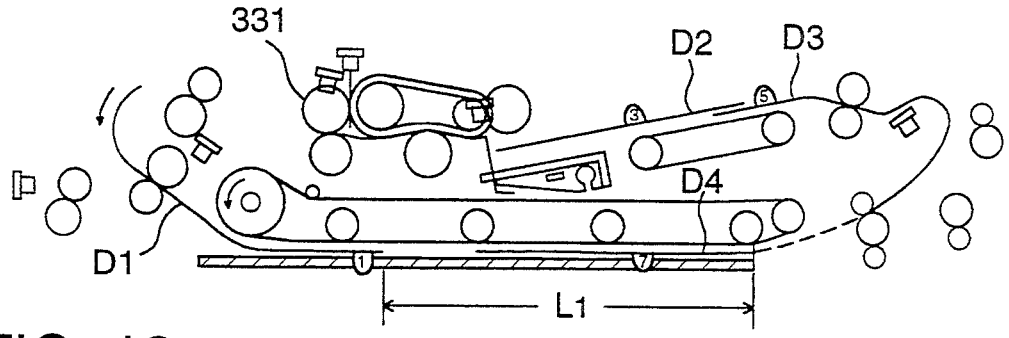
FIGS. 13(A) to 13(F) are schematic illustrations showing the first half of the document conveyance process for even-numbered pages in the R-RDH mode.
Figure 13B:
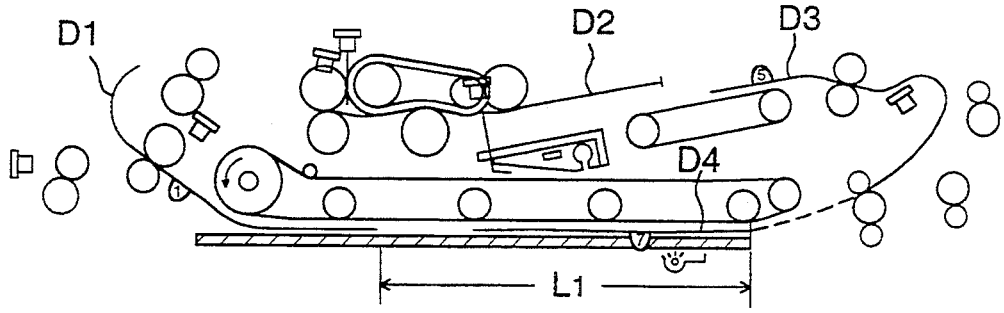
Figure 13:
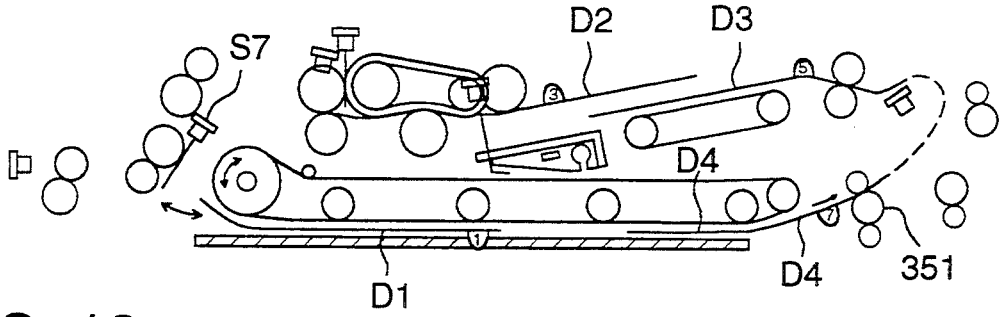
Figure 13:
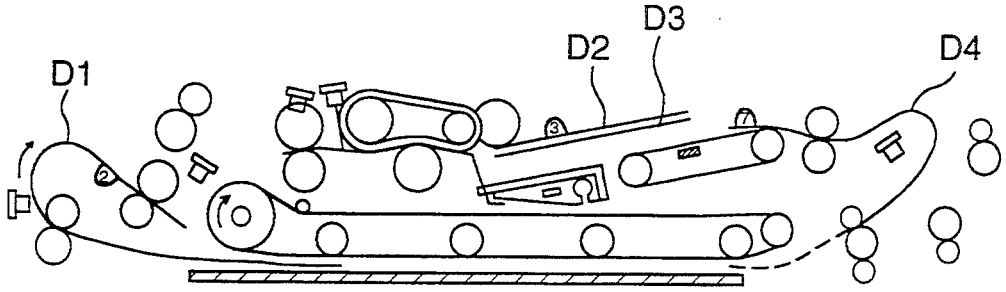
Figure 13:
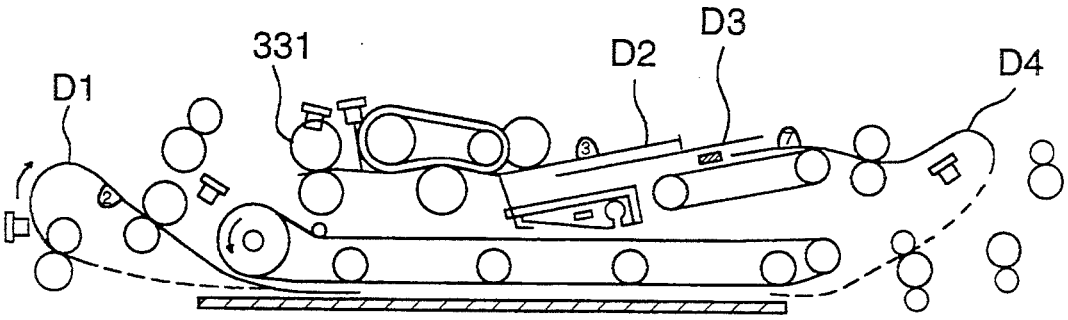
Figure 13:
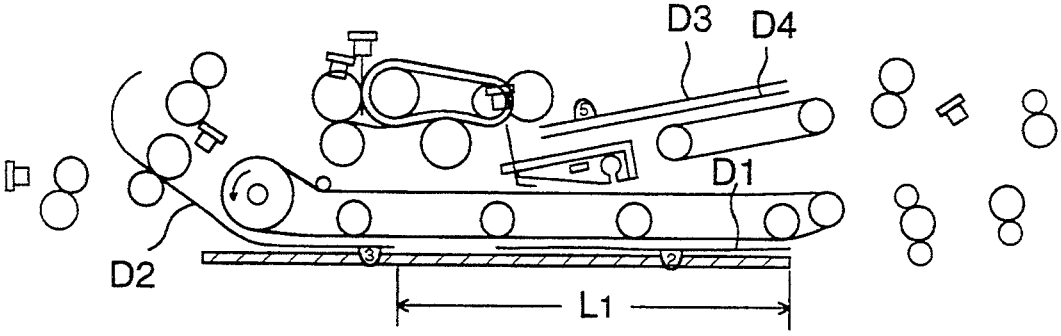
Figure 14:
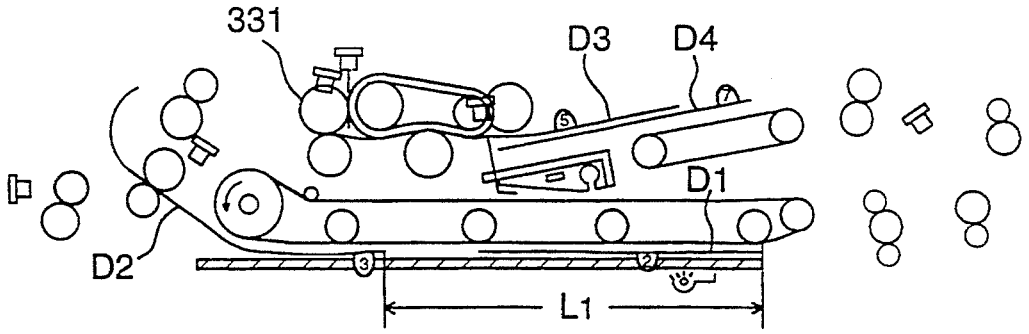
FIGS. 14(A) to 14(F) are schematic illustrations showing the second half of the document conveyance process for even-numbered pages in the R-RDH mode.
Figure 14:
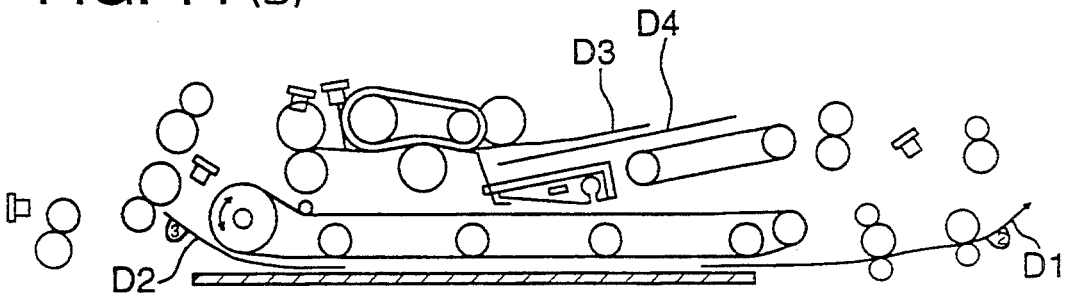
Figure 14:
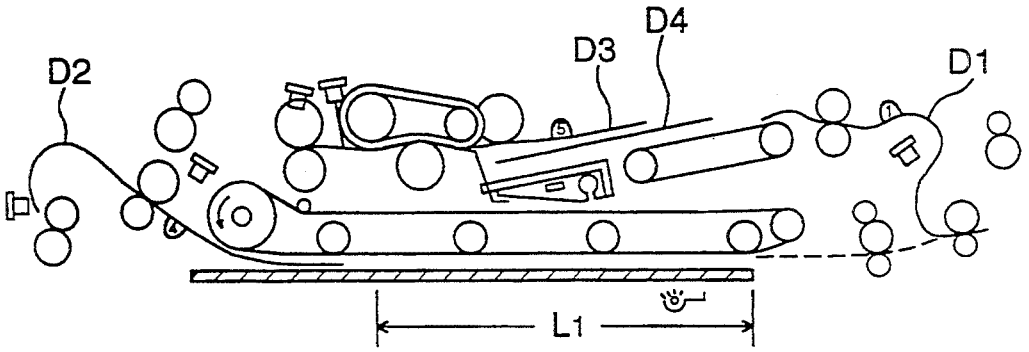
Figure 14:
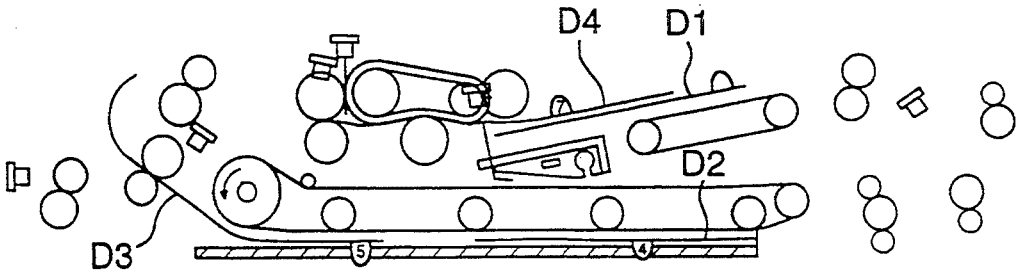
Figure 14E:
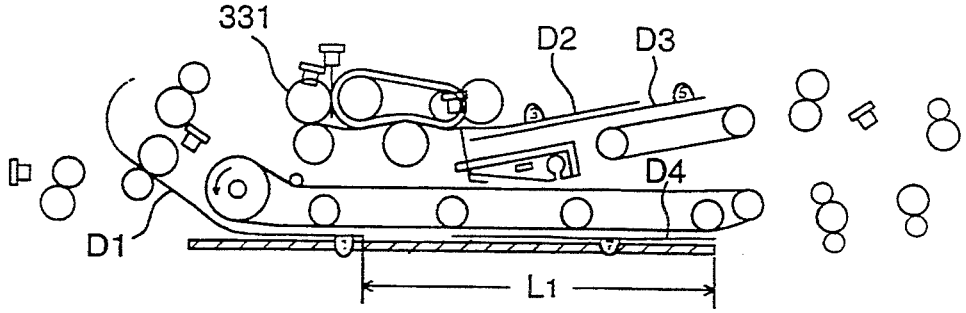
Figure 14F:
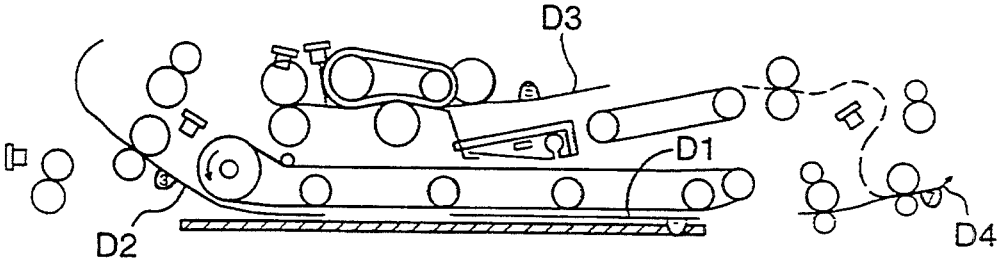

(3*a*) FIG. 13(A) shows a condition of the intermediate conveyance of the lead document D1 of the even-numbered paper in the second circulation. When the last document D4 in the first circulation, which is previously being conveyed, stops at a predetermined position on the platen glass 111, the lead document D1 in the second circulation advances onto the platen glass 111. Then, the document D1 is stopped at a waiting position while the fore end of the document D1 and that of the previous document D4 keep a predetermined interval L1.

(3*b*) Next, the document D4 is subjected to exposure at a predetermined position on the platen glass 111. While the document D4 is being exposed, the next document D2 is sent out, and waits for the next operation at the registration roller 331. (Refer to FIG. 13(B).)

(3*c*) When the conveyance belt 341 is normally rotated, the documents D4 and D1 are concurrently conveyed. After the trailing end of the document D1 has passed through the registration sensor S7, a predetermined period of time passes. Then the conveyance belt 341 is reversed, so that the document D1 is fed to the document reversal feed passage 336. The last document D4 in the first circulation is strongly nipped by the paper discharge roller 351, and conveyed to the paper discharge paths f, g, h by the drive force of the paper discharge motor M3, resisting the force of the conveyance belt 341 that is reversed (Refer to FIG. 13(C).)

(3*d*) Successively, the document D1 is conveyed in the reverse direction, and passes through the path i. Then the document D1 is inverted and the second surface (2) is set downward. After that, the document D1 advances onto the platen glass 111 again. In this case, the document D4 advances to the document stack unit 310. After the fore end of the document D1 is detected by the reversal detection sensor S17, a predetermined period of time passes. Then motor M2 is turned off, and switched to the normal rotation. However, the reversal roller is always rotated in the normal direction, so that the document D1 is successively fed onto the platen glass 111. At this time, after a predetermined period of time has passed after the detection of the trailing end of the document D1 conducted by the sensor S7, the feed clutch CL1 is turned on, so that the document D2 is sent out while a predetermined interval is maintained between the documents D1 and D2.

(3*e*) The documents D1 and D2 are concurrently conveyed, and the document D1 is stopped at a predetermined position at the right end of the platen glass 111 and exposed with light. At this time, the document D2 advances to a predetermined waiting position on the platen glass 111 and stops at the position. The document D3 is sent out while the document D2 is being exposed with light, and stopped at a position where it collides with the registration roller 331 (shown in FIGS. 13(F) and 14(A)).

(3*f*) After the second surface (2) of the document D1 has been exposed, the document D1 is discharged to the paper discharge reversal section 350. At the same time, the document D2 advances onto the platen glass 111 (shown in FIG. 14(B)).

(3*g*) The document D2 is inverted by the document reversal guide plate 336. Then, the document D2 advances onto one end portion of the platen glass 111 while the fourth surface (4) faces downward. While the document D2 is conveyed, the lead document D1 passes through the reversal paths j, k, m, n in the discharge reversal section 350, and while the first surface (1) faces upward, the lead document D1 advances to the document stack section 310 (shown in FIG. 14(C)). After the registration sensor S7 has been turned on by the document D2, a predetermined period of time passes. Then the waiting document D3 is sent out.

(3*h*) The documents D2 and D3 are concurrently conveyed, and the document D2 is stopped at a predetermined position at the right edge on the platen glass 111 so as to be subjected to exposure. At this time, the document D3 advances to a predetermined waiting position on the left on the platen glass 111, and waits for the next operation. In this case, an interval between the fore end of the document D2 and that of the document D3 is maintained to be L1. While the document D2 is being exposed, the document D4 is sent out, and collides with the registration roller 331 and stops (shown in FIG. 14(D)).

In the same manner, the even-numbered documents are inverted in the intermediate conveyance section 330, and while the even-numbered page surfaces are set downward, the documents are conveyed onto the platen glass 111. After exposure, the documents are inverted in the paper discharge reversal section 350. Then the documents are returned to the lowermost layer of the document stack on the document stack section 310 while the odd-numbered page surfaces are set upward (shown in FIGS. 14(E) and 14(F)).

The conveyance operations of small size documents are described above. When the documents of large size (B4 papers, A3 papers and 11 inch papers) are conveyed, the waiting position of the following document is set on the upstream side of the platen glass 111 close to the registration roller 334 provided at the branch portion of the document conveyance path c and the reversal conveyance path i.

The feed belt having the gripper section, and the movable pushing plate, which are used for the automatic document feeder of the first example, can be effectively applied to the circulation type automatic document feeder (RDH). Further, it can be also applied to a sheet refeeding device, the feeding sheet set section and the discharging sheet stack section of which are constructed in the same manner.

Next, the second example of the present invention will be explained as follows. The second example has approximately the same construction as the first example except for the document conveyance method.

FIGS. 15(A) to 15(F) are schematic illustrations showing a condition of document D when the document D is discharged from the paper discharging and reversal section 350 to the feed belt 311 and the movable pushing plate 317 in the document stack section 310.

Document D1 is conveyed in the following manner. After the leading end of document D1 has been detected by the leading end passage sensor S9, a predetermined period of time passes. That is, the leading end of the document arrives at the gripper section 311B. Then, the clutch is connected, and the leading end of the document D1 is held by the gripper section 311B of the feed belt 311 that starts the rotational operation from the home position. Then, the document is conveyed while it is being nipped by the circulation paper discharge roller 355 disposed in the upstream of the document flow (shown in FIGS. 15(A) and 15(B)). Document D1 is conveyed on the rough surface of the feed belt 311 that is successively rotated. Then, the document D1 is inserted under the unprocessed document stack D, the end portion of which is lifted by the separation lever 315A, so that the document D1 is conveyed to the left in the drawing (shown in FIG. 15(C)).

In the meantime, the movable pushing plate 317 is located at the lower position, so that the leading end of the document stack D is separated from the delivery roller 321. The surface linear velocity V1 of the feed belt 311 is a little higher than the surface linear velocity V2 of the circulation discharging roller (skew conveyance correction roller) 355 of the paper discharging and reversal section 350, that is, $V1>V2$. In this connection, the surface of the feed belt 311 with which the document D1 comes into contact is made to be rough, that is, the surface between A and B in FIG. 4 is rough. Accordingly, the document D1 is pressed against the surface of the feed belt 311 by the weight of the document stack, and positively held and conveyed by the feed belt 311.

Successively, the document D1 is held by the circulation discharging roller 355, fed onto the feed belt 311, and conveyed by the feed belt 311. When the returned document D1 reaches a curved portion of the belt where the document is separated from the surface of the feed belt 311, the leading end of the document D1 is released from the gripper section 311B, and then the document D1 slides on the movable pushing plate 317 (shown in FIG. 15(D)). That is, when the feed belt 311 is directed downward along the idle roller 312B, the document D held on the feed belt 311 is slid on the movable pushing plate 317 located a little lower than the upper surface of the feed belt 311.

Figure 15:
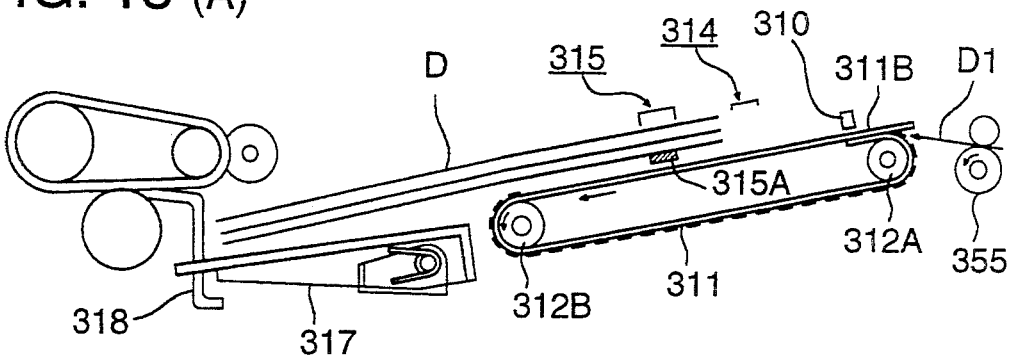
FIGS. 15(A) to 15(F) are schematic illustrations showing a condition of conveyance of a returned document on the document stack unit in the document circulation mode in the second example.
Figure 15:
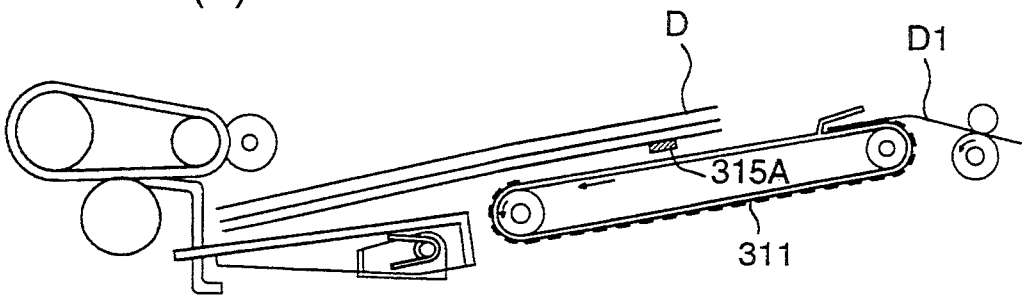
Figure 15:
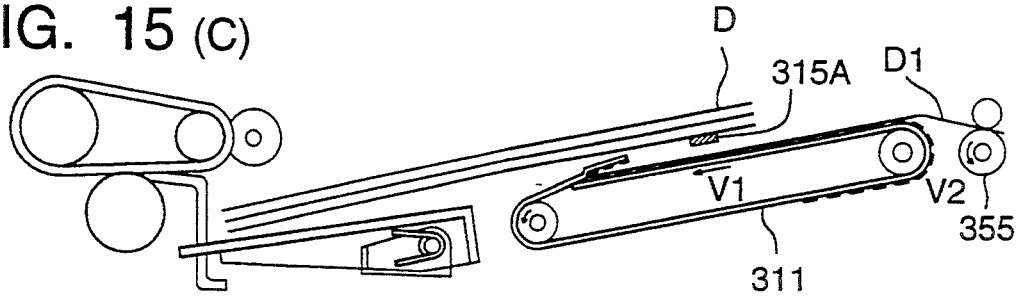
Figure 15:
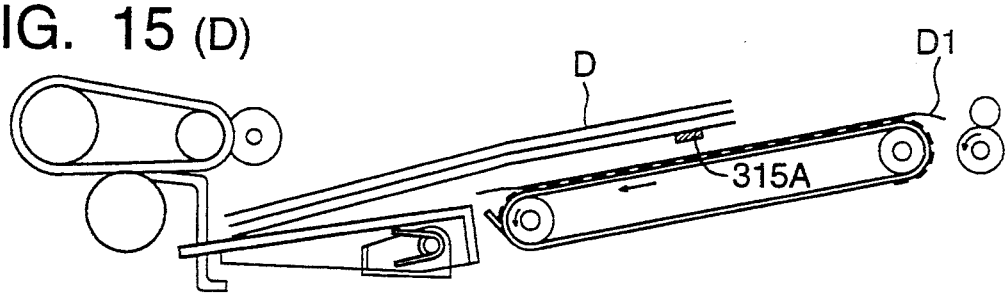
Figure 15:
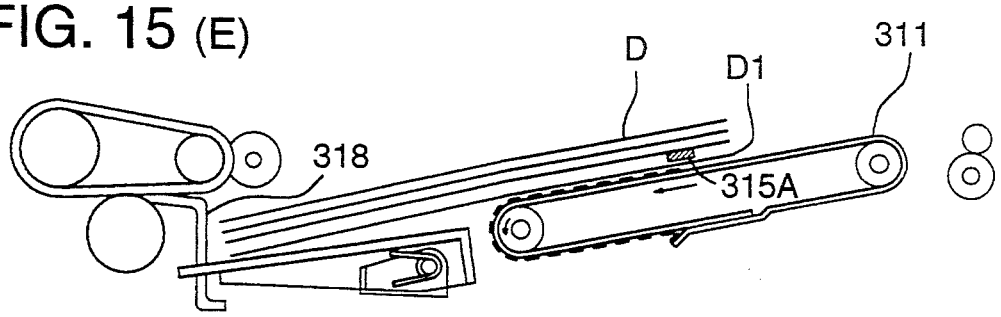
Figure 15:
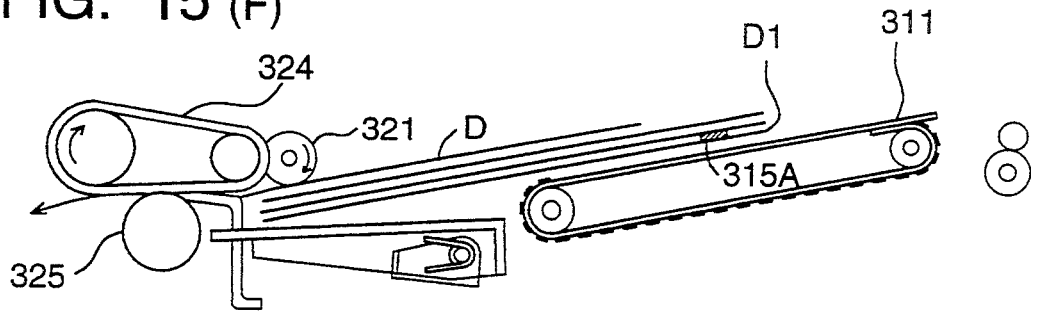

When the leading end of the document D1 collides with the document leading end stopper 318, the conveyance of the document is stopped while the latter half of the document D1 is bestriding the rough and smooth surfaces of the rotating feed belt 311 (shown in FIG. 15(E)).

The feed belt 311 is further rotated, and stopped at the hole position. At this time, the smooth surface of the feed belt 311 comes into contact with the document (shown in FIG. 15(F)). Accordingly, when the overall circumferential length of the feed belt 311 is set longer than the maximum length of the conveyed document D in the conveyance direction, the document returning operation can be smoothly carried out.

In this case, the surface speed V1 of the feed belt 311 is set higher than the circumferential speed V2 of the circulation discharging roller 355 (for example, V1=1150 mm/sec, and V2=1000 mm/sec). While the returned document D1 is nipped by the circulation paper discharging roller 355, the document D1 is conveyed on the feed belt 311. The leading end of the returned document D1 is inserted into the gripper section 311B as shown in FIG. 15(A). As the gripper section 311B of the feed belt 311 is moved, the leading end of the document D1 is relatively moved from the feed belt 311, and gradually released from the root portion of the gripper section 311B. Finally, the leading end of the document D1 is disengaged from the gripper section 311B as shown in FIG. 15(C). After that, the leading end of the document D1 linearly advances, and slides on the movable pushing plate 317, and comes into contact with the document leading end stopper 318. Therefore, the leading end of the document is not held by the gripper section 311B while the feed belt 311 is curved along the idle roller 312B, so that the document can be properly conveyed in a predetermined conveyance direction.

Before the gripper section 311B arrives at the curved portion of the feed belt 311, the leading end of the document D1 is completely disengaged from the gripper section 311B. Consequently, instead of using the speed difference (V1−V2), the following operation may be carried out: The feed belt 311 is rotated at the same speed as that of the circulation paper discharging roller 355. Before the gripper section 311B reaches the curved portion of the feed belt 311, the rotational speed of the circulation paper discharging roller 355 is temporarily reduced or stopped so that the leading end of the document D1 can be disengaged from the gripper section 311B.

In the case where document D1 of small size is conveyed in a returning manner, the trailing end of the document D1 is discharged from the nip position of the circulation paper discharging roller 355 at an early stage, so that the conveyance force is not provided. Therefore, the document D1 is held between the rough surface of the conveyance belt 311 and the document stack D, and the document D1 is conveyed by the surface frictional force and inertia force. Therefore, in the prior art, there is a possibility that the leading end of the document is not disengaged from the gripper section 311B and further the document is conveyed around the idle roller 312B. According to the present invention, before the gripper section 311B arrives at the curved portion of the feed belt 311, the leading end of the document D1 is disengaged from the gripper section 311B, so that the leading end of the document advances linearly by the conveyance force of the feed belt 311 toward the document leading end stopper 318.

Next, the third example of the present invention will be explained as follows. The third example has the same construction as the first and second examples except for the document stopping method.

Figure 16:
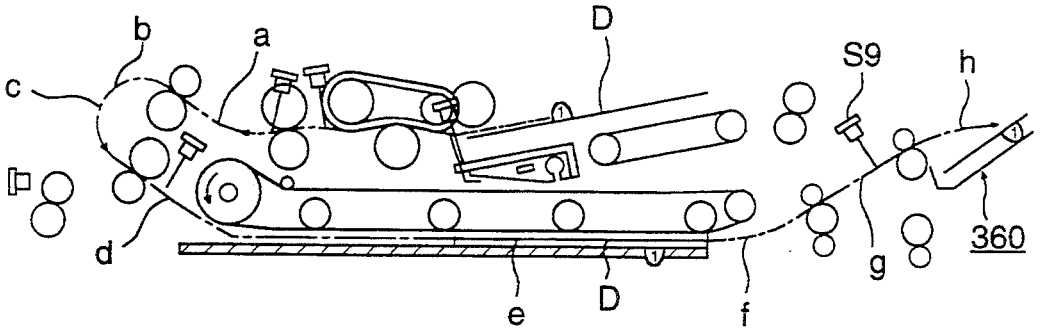
FIGS. 16(A) and 16(B) are schematic illustrations showing a document conveyance path in the ADF and R-ADF modes in the third example.
Figure 16:
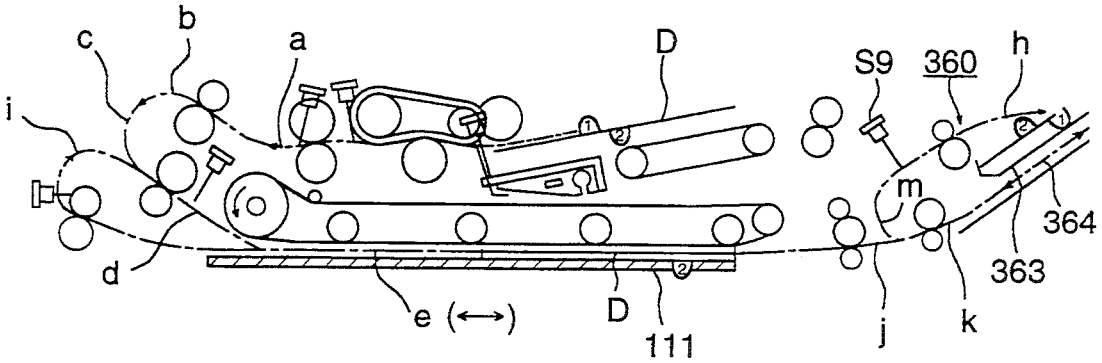

FIGS. 16(A) and 16(B) are schematic illustrations showing the document conveyance paths (illustrated by a one-dotted chain line) of various modes.

FIG. 16(A) shows the ADF mode in which one sided documents are copied and discharged to the paper discharging tray 360 provided outside of the apparatus. In the case of a common document, the size of which is not more than A3, the document D is conveyed through the paths a, b, c, d, e, f, g and h, and then the document D is stacked on the movable tray 363. In the case of a document of large size such as A2, A3 and 11×17 inches papers, the document is stacked over the fixed tray 361 and the movable tray 363.

FIG. 16(B) shows the R-ADF mode in which two sided documents are copied and discharged onto the paper discharging tray 360 provided outside of the apparatus. In the R-ADF mode, the document D passes through the paths a, b, c, d and e. Then, the first surface (1) of the document is exposed, and the document is reversely conveyed on the platen glass 111, and inverted in the loop path i. After that, the document passes through the path d again. Then, the document passes through the right path e in the drawing, and the second surface (2) of the document is exposed. After both sides have been exposed, the document D is conveyed to the paper reversal and discharge section 350, and passes through paths f, j and k. Then, the documents D enters the tunnel-shaped reversal and discharge path 364 of the paper discharge tray section 360. After that, the document is reversely conveyed, and passes through the paths m and h. Then, the document is stacked on the movable tray 363 in the paper discharge tray section 360. In this connection, the operations of the RDH and the R-RDH modes are the same as that of the aforementioned example.

Also, in this third example, after the initializing operation, the document feed preparation is completed. Successively, the document feed operation is started. FIGS. 17(A) to 17(F) are schematic illustration showing the conveyance process of a one sided document.

(2A) When the copy button is pressed, the pushing motor M1, paper discharging motor M3 and bottom-return clutch CL4 are turned on, so that the apparatus is ready for document conveyance and copy.

(2B) When the copy button is turned on, the bottom-return clutch CL4 is turned on, and the paper discharging motor M3 is driven at low speed. Due to the foregoing, the drive roller 312A is rotated, and the feed belt 311 is rotated (at low speed V2). When a hole 311C for detection of the feed belt 311 passes through the belt home position sensor S13, a detection signal is sent out. According to the detection signal, after a predetermined period of time (T1) has passed, the paper discharge motor M3 is stopped, and at the same time the clutch CL4 is turned off and the brake BRK2 is turned on, so that the feed belt 311 is stopped. Then, the cutout portion 311D and the gripper section 311B are set at reference positions. At the same time, the number of copies separation solenoid SL3 is turned on, and the separation lever 315A passes through the cutout portion 311D and comes into contact with the lowermost layer of the document stack.

(2C) When the copy button is turned on, the pushing motor M1 is driven. Then, the movable pushing plate 317 is rotated through the drive plate 319 secured to the oscillating shaft 317A, and also through the torsion spring 317B. Therefore, the movable pushing plate 317 is rotated and its fore end is raised, so that the stacked documents D are lifted. In the process of lifting, the rotational angle of the oscillating shaft 317A is counted by a rotary encoder in such a manner that the pulse C1 is counted.

(2D) When the upper surface of the document stack D provided on the movable pushing plate 317 comes into contact with the outer circumferential surface of the delivery roller 321, the movable pushing plate 317 raises the delivery roller 321 while the document stack D is held on it. After the delivery roller 321 has been raised by a predetermined height, the pushing detection sensor S4 is turned on, and the counting operation is started. When the delivery roller 321 is further raised, a frame holding the delivery roller 321 comes into contact with a fixed member not shown in the drawing, so that the rising motion of the delivery roller 321 is stopped. However, the drive plate 319 is further driven, and rotated counterclockwise while the torsion spring 317B is being compressed. Therefore, a gap between the movable pushing plate 317 and the drive plate 319 is reduced. When the pushing detection sensor S4 is turned on, the pushing force becomes the initial setting pressure (for example, the roller weight 50 g), and the counting of C1 is stopped.

(2E) The thickness of the document stack D is detected by the output of the counting C1. In accordance with the document size detected by the size sensor S2, also in accordance with the setting input of thick or thin papers, a specified pulse is determined by a predetermined pushing pulse table. The thickness of the document stack is detected by the aforementioned counting value of C1, and the detected thickness is classified into, for example, large, intermediate and small.

For example, document papers of B5 to A3 size are used, and the employed size is detected by the size detection sensor S2. In the case where document stacks of a plurality of sizes are concurrently set, the operator pushes a key for a plurality of sizes provided on the operation panel, so that the processing of document stacks of a plurality of sizes can be designated. When the thickness of a sheet of document paper is designated, a thin sheet key or a thick sheet key provided on the operation panel is pressed.

As described above, the thickness of a document stack and the document size are automatically detected by sensors. When documents of a plurality of sizes are used, it is manually set. Also, the sheet thickness is manually set.

According to the detected values and also according to the manually set values, a pushing pass table is previously set and stored in a non-volatile memory, and the count value C2 is determined by the aforementioned sheet condition input means.

(2F) The count C2 is inputted in accordance with the aforementioned designated pulse. Further, when the drive plate 319 is driven, the counting operation of count C2 is continued. When the drive plate 319 is oscillated until the designated count C2 is counted up, the winding amount of the torsion spring 317B is increased, and the resilient force is approximately linearly increased, so that the pushing force can be increased.

When the count C2 is counted up, the movable pushing plate 317 sends out the document D by a predetermined pushing force (for example, 100 g). Then, the movable pushing plate 317 comes into contact with the delivery roller 321 with pressure, and the pushing motor M1 is stopped.

(2G) Concurrently when the pushing motor M1 is started and stopped in accordance with the counting operation described above, the delivery clutch CL1 and drive motor M2 are turned on and rotated at low speed, so that the document D1 is fed. That is, the feed belt 324 is rotated by the drive force generated by the drive motor M2 driven at low speed, so that documents in the upper layer are fed by the feed belt 324, and further only the uppermost document D1 in the plurality of documents is separated by the reverse roller 325 and conveyed at a low speed V0.

The fore end of the separated document D1 is detected by the skew correction sensor S5, and a fore end detection signal is generated. After a predetermined period of time has passes from the generation of the signal (timer T3), the drive motor M2 is turned off. Then, the document collides with the first intermediate conveyance roller (registration roller) 331, the registration clutch CL2 of which is turned off so that the first intermediate conveyance roller 331 is stopped. Therefore, a loop is formed and the skew of the document D1 is corrected (shown in FIG. 17(A)).

(2I) After the detection conducted by the skew correction sensor S5, a predetermined period of time (T5) passes. Then, the drive motor M2 is driven again. At this time, the drive motor M2 is rotated at high speed. Concurrently when the delivery clutch CL1 is turned on, the registration clutch CL2 and the conveyance clutch CL3 are turned on, so that the document D1 is conveyed to the downstream at a high conveyance speed V1 (for example, 1200 mm/s). When the fore end of the document D1 crosses the passage detection sensor S6, the sensor is turned on. Then, the delivery clutch CL1 that has been driving the drive roller 323 is turned off, and the feed belt 324 is idly rotated until the rear end of the document D1 passes through the sensor S6. After that, the rotation of the feed belt 324 is stopped. However, the document D1 is successively conveyed at a high speed V1 when the first intermediate conveyance rollers 331 are driven by the drive motor M2. Further, when the sensor S6 is turned on, the paper discharging motor M3 is driven at high speed, and documents in the paper discharging path are discharged outside of the apparatus by the paper discharging rollers 351, 352 at high speed (V1).

(2J) After the time has been measured by the timer T5, the pushing motor M1 is reversely rotated, so that the drive plate 319 and the movable pushing plate 317 are lowered so as to release the pushing action. When the home position detection sensor S3 detects that the drive plate 319 has returned to the initial position, the pushing motor M1 is stopped. In the case where a plurality of documents are successively fed, the drive plate 319 and the movable pushing plate 317 are not returned to the home position, and in accordance with the detection signal of the pushing detection sensor S4 or the drive start signal of the drive means in the separating direction, the descending operations of the drive plate 319 and the movable pushing plate 317 are stopped at an intermediate position.

(2K) After the sensor S13 has detected the passage of the home position detection hole 311C formed on the feed belt 311, the timer T4 measures a predetermined period of time. Then, the number of copies separation solenoid SL3 of the pushing means 314 is turned off, so that the pushing lever 314A is lowered. Due to the foregoing, the separation lever 315A held by the pushing lever 314A is also lowered by its weight. Therefore, a pushing action given to one end of the document stack is released, and the separation lever 315A is lightly contacted with the lowermost document, and the number of copies separation sensor S14 is turned on.

In the case where the document stack is set below the separation lever 315A of the document stack section 310 or the separation lever 315A is inserted into the document stack, the number of copies separation sensor S14 does not detect the stop position. According to the signal, the pushing lever 314A is lowered when the solenoid SL3 is turned off, and when the solenoid SL4 is turned on, the separation lever 315A is diagonally slid and withdrawn. When the solenoid SL4 is successively turned off, the separation lever 315A pushed by the spring 315E is advanced, so that the separation lever 315A is inserted below the cutout portion 311D of the feed belt 311 under the document stack.

(2L) Next, when the fore end of the document D1, which is conveyed at a speed of V1, passes through the registration sensor S7, an ON signal is provided. Then, the encoder sensor S16 for an encoder plate RE directly connected with the drive roller 342 of the conveyance belt 341 and also connected with the second intermediate conveyance rollers (registration roller) 334 starts a counting operation. After a predetermined counting operation ($\phi$1) has been carried out by the encoder RE, the drive motor M2 is turned off. At this time, the encoder plate RE starts a counting operation, and a predetermined counting operation ($\phi$1) is carried out. Then the registration clutch CL2 and the conveyance clutch CL3 are turned off, and the conveyance brake BRK1 is turned on, so that the rotating operations of the conveyance belt 341 and the second intermediate conveyance rollers 334 are stopped. At this time, the fore end of the document D1 arrives and stops at a predetermined waiting position (a position located at a distance of L1 from the stop position, for example, 236 mm) on the platen glass 111.

Previously to the above operation, when the fore end of the first document D1 passes through the registration sensor S7 and an ON detection signal is provided, the pushing operation of the drive means is started by the pushing motor M1, so that the drive plate 319 and the movable pushing plate 317 are raised, and the following document D2 is successively pushed.

(2M) After the start (92) of the counting operation of the encoder plate RE, a predetermined period of time (T6) passes, and then the drive motor M2 and the delivery clutch CL1 are turned on. Then, the delivery roller 321 and the feed belt 324 are rotated at low speed (V0), so that the document D2 is fed at low speed. In the same manner as the aforementioned document D1, the document D2 collides with the intermediate conveyance rollers (registration roller) 331 so as to form a loop, and the document D2 is stopped (shown in FIG. 17(C)).

(2N) After a predetermined period of time has passed, the drive motor M2, registration clutch CL2 and conveyance clutch CL3 are turned on, and the conveyance brake BRK1 is turned off, so that the documents D1 and D2 are conveyed at high speed (V1). At a point of time when the document D1 arrives at a predetermined exposure position on the platen glass 111 (encoder $\phi$1), the drive motor M2 is turned off. After that (encoder $\phi$2), when the conveyance clutch CL3 and registration clutch CL2 are turned off and the conveyance brake BRK1 is turned on, the document D1 is suddenly stopped at the exposure position, and at the same time the document D2 is made to wait for the next operation at a predetermined waiting position on the platen glass 111 (shown in FIG. 17(D)). That is, in this example, a document stopper is not used, but a movement amount of the document D is controlled by counting the pulse number of the rotary encoder RE in accordance with a signal sent from the registration sensor S7, so that the document is conveyed to the reading position and accurately stopped at a predetermined position.

Figure 17:
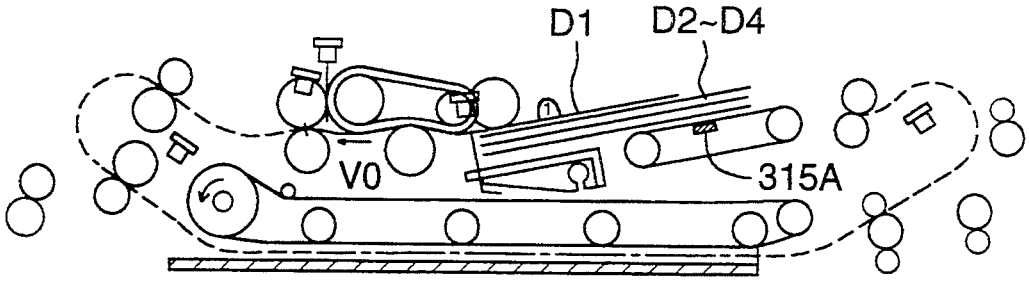
FIGS. 17(A) to 17(F) are schematic illustrations showing a document conveyance path for odd-numbered pages in the R-RDH mode in the third example.
Figure 17:
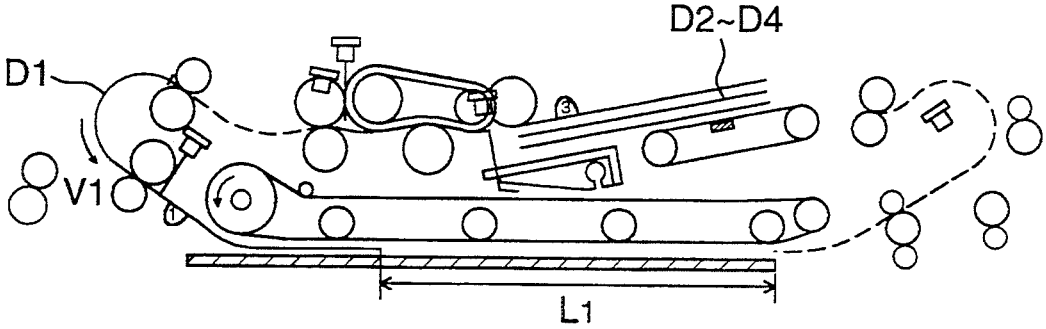
Figure 17:
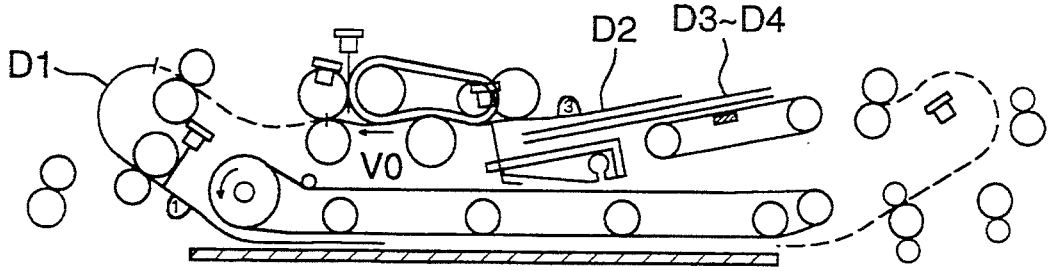
Figure 17:
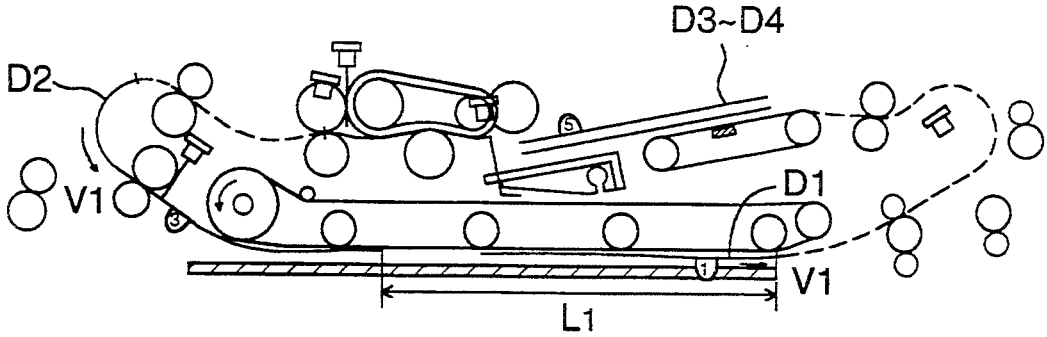
Figure 17:
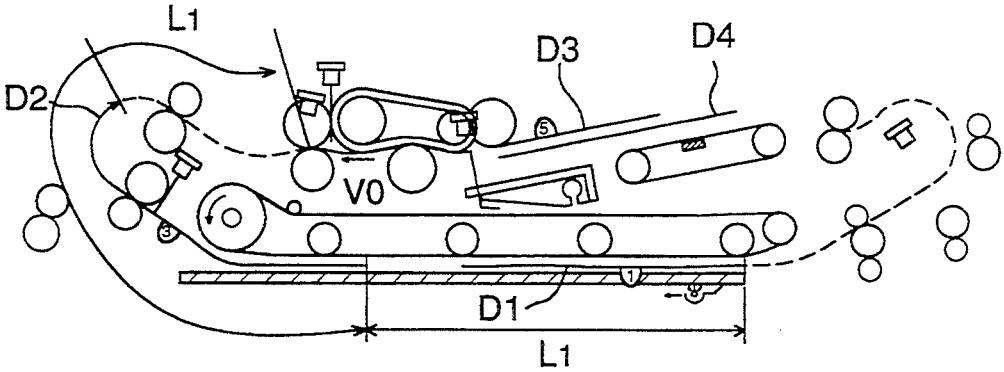
Figure 17:
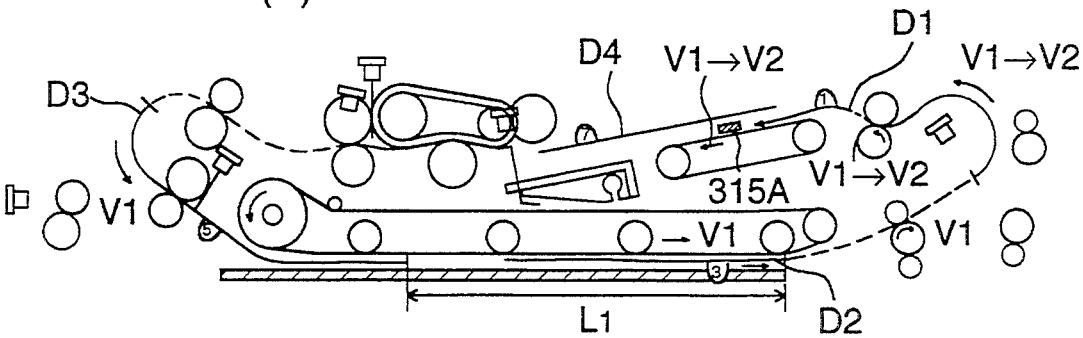

(2O) Under the condition that both documents D1 and D2 are stopped, a scanning exposure operation is conducted on the document D1 in accordance with a signal sent from the copier body (shown in FIG. 17(E)). That is, while the document D1 is stopped on the platen glass 111, the first surface (1) of the document D1 is exposed by an exposure lamp of the scanning exposure section 110. A document image is formed on a photoreceptor drum after the scanning light beams have been sent through a lens, mirror and the like. After that, a series of copying processes are performed on the document D1.

During the exposure operation described above, when a predetermined period of time is counted up by the timer T6, the drive motor M2 and the clutch CL1 are activated, and the feed belt 324 starts rotating, so that the next document D3 is sent out at low speed (V0). When the timers are controlled, a registration operation is conducted on the document D3, so that the document D3 is stopped at a position where an interval between the leading end of the document D3 and that of the previous document D2 is maintained to be a predetermined value L1.

Consequently, at this time, three documents D1, D2 and D3 are longitudinally disposed at regular intervals in the path from the separation feed means to the reading section. At this time, the document D1 is disposed at the reading position on the platen glass 111, the document D2 waits at a position bestriding the conveyance belt 341 and the second intermediate conveyance rollers 334 (registration roller), and the document D3 waits at a position where it collides with the registration roller 331. That is, the documents D2 and D3 wait for the successive conveyance operation at appropriate positions so that the conveyance operation can be smoothly carried out.

(2P) Document Replacement (shown in FIG. 17(F))

After the document D1 has been exposed, the drive motor M2 is driven at high speed, and the conveyance belt 341 is rotated at high speed (V1). Previously to the operation described above, the paper discharging motor M3 is driven at high speed, so that the document D1 is discharged at the same paper discharging speed V1 as that of the conveyance speed of the conveyance belt 341. When the paper discharging motor M3 is driven at high speed, the document D1 passes through an upper position of the paper discharging roller 351, and then passes through a branch portion, the upper passage of which has already been opened when the switching claw 357 is oscillated by the RDH switching solenoid SL2. When the leading end of the document D1 is detected by the paper discharging sensor S9 during the conveyance operation, the timers T8 and T9 start the counting operation. When a predetermined period of time is counted up by the timer T8, the bottom-return clutch CL4 is turned on, and the paper discharge brake BRK2 is turned off. When the deviation detection sensor S10 is turned off at this time, the deviation correction sensor M4 is rotated in a direction opposite to the viewer's side, and when the sensor S10 is turned on, the motor M4 is rotated in a direction of the viewer's side. After the motor has been turned off, the motor is driven again in the direction opposite to the viewer's side, and the motor is stopped concurrently when it is started. Then, the document collides with the width stopper plate 316 so that the deviation is corrected and the document is aligned. The timer is set so that the bottom-return clutch CL4 can be turned on. Therefore, the fore end of the document D1 is held by the gripper section 311B of the feed belt 311.

In this example, a conveyance distance from the paper discharging roller 351 to the gripper section 311B is determined to be longer than the length of the document to be processed. However, it is possible to reduce the distance from the paper discharging roller 351 to the gripper section 311B to be shorter than the document size when the deviation correction motor M4 is turned on by a timer operation after the trailing end of the document D1 has passed through the paper discharging roller 351.

(2Q) Further, the bottom-return feed belt 311 and the circulation paper discharge roller 355 are rotated, so that the document D1 is inserted below the upper document stack. In this case, the separation lever 315A of the number of copies separation means 315 is raised upward by a predetermined height by the action of the number of copies separation solenoid SL4. Therefore, the document D1, the leading end of which is nipped by the gripper section 311B, is inserted below the last document which has not been conveyed yet (shown in FIG. 17(F)).

(2R) When the trailing end of the document D1 passes through the paper discharging sensor S9, the paper discharging sensor S9 is turned off, and the paper discharging motor M3 is switched to the intermediate speed, and the speed of the paper circulation discharging roller 355 is reduced. Then, the document D1 is successively fed to the document stack section 310 at an intermediate delivery speed of V2. After the document D1 has been replaced with the document D2, the document D1 is sent out by the circulation paper discharging roller 355 and the feed belt 311. After the belt home position sensor S13 has been turned on by the action of the portion 311C to be detected provided on the feed belt 311, a predetermined period of time passes. Then, the bottom-feed clutch CL4 is turned off, so that the power transmission of the paper discharge motor M3 is intercepted. At the same time, the paper discharging brake BRK2 is turned on, so that the rotation of the drive roller 312A is stopped. Therefore, the feed belt 311 is stopped at the home position.

Immediately after the completion of registration, the movable pushing plate 317 is lowered. Therefore, the document D1 returning to the document stack section 310 passes above the movable pushing plate 317 that has been lowered, and collides with the document fore end stopper 318 at a middle speed of V2, and stops.

(2S) The following documents successively conduct the operations of paper feeding, paper conveyance and paper discharging. When the last document D4 is conveyed to the registration position, the trailing end of the document D4 comes out from the separation lever 315A, and the separation lever 315A moves upward. Then, the number of copies separation sensor S14 is turned on. In this way, it can be detected that the last document in the first circulation has been sent out.

(2T) After the last document D4 has been conveyed to the second stop position, the document D1 is sent out again which has been returned to the document stack section 310 during the exposure of the document D3. In the same manner, the documents D2, D3 and D4 are sent out. When the document D4 is returned, the number of copies separation solenoid SL3 is operated, and the separation lever 315A is inserted below the document D4. The above operation is repeated by a predetermined copying time.

In this example, after the completion of registration, the document is returned while the movable pushing plate 317 is being lowered. However, the document feed operation may be conducted after the completion of the returning operation. In this case, the paper holding lever 310Z provided on the upstream side of conveyance of the separation lever 315A helps the returning document to be positively inserted below the document stack, and comes into contact with the document by its own weight. This paper holding lever 310Z is also effective to stabilize the operation of the separation lever 315A in the case where curled documents or small number of documents are conveyed.

(3) R-RDH mode (two-sided document circulation conveyance mode)

The operation described above is conducted in a case where one-sided documents are copied on one size of a recording paper. In the R-RDH mode in which two-sided documents are copied on both surfaces of recording papers, the documents are inverted in the first circulation so that the odd-numbered pages are copied (shown in FIG. 8(A)), and then the even-numbered pages are copied in the second circulation (shown in FIG. 8(B)). Of course, the paper feeding operations to feed copy papers on the copier body 100 side are conducted in accordance with the RDH and R-RDH modes.

FIGS. 18(A) to 18(F) and FIGS. 19(A) to 19(F) are schematic illustrations showing the document conveyance process of the R-RDH mode in which two-sided documents are copied on both sides of recording papers. The followings are explanations for document conveyance in the case where even-numbered pages of small size documents are copied.

Figure 18:
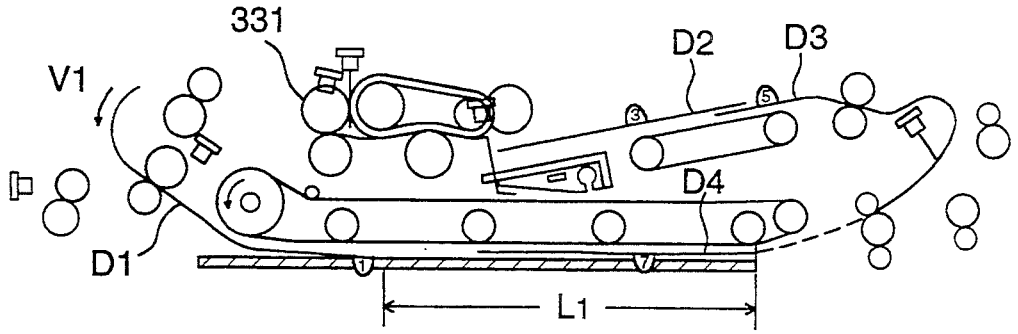
FIGS. 18(A) to 18(F) are schematic illustrations showing the first half of the document conveyance process for even-numbered pages in the R-RDH mode.
Figure 18B:
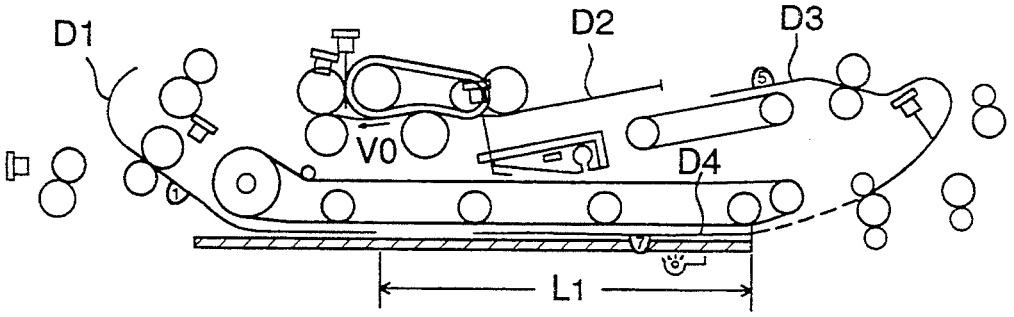
Figure 18:
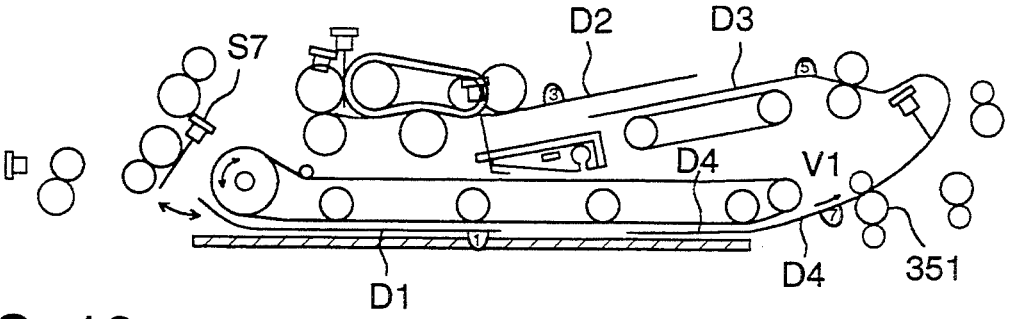
Figure 18:
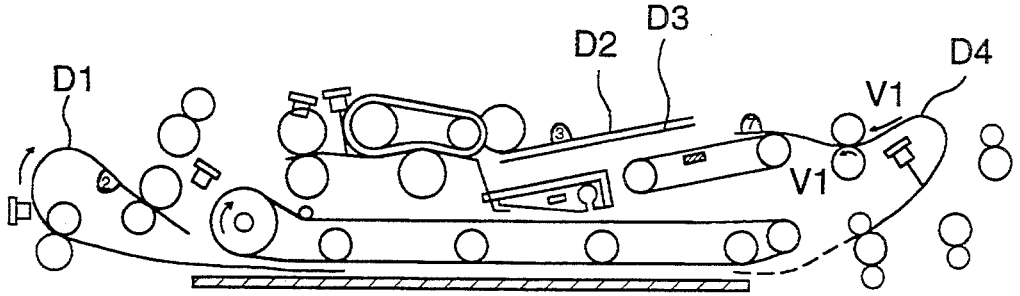
Figure 18:
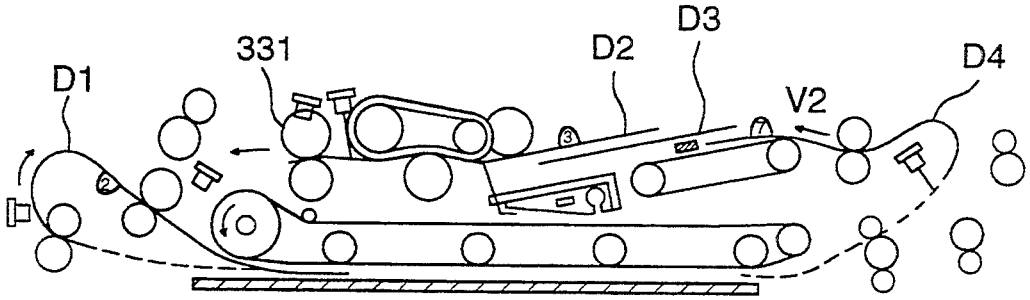
Figure 18:
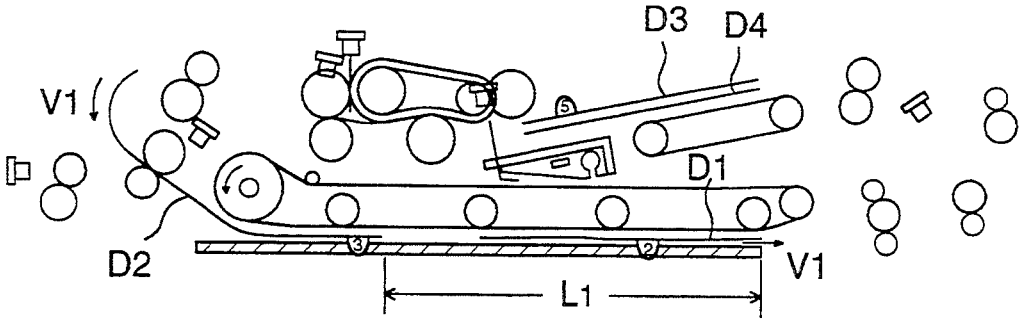
Figure 19:
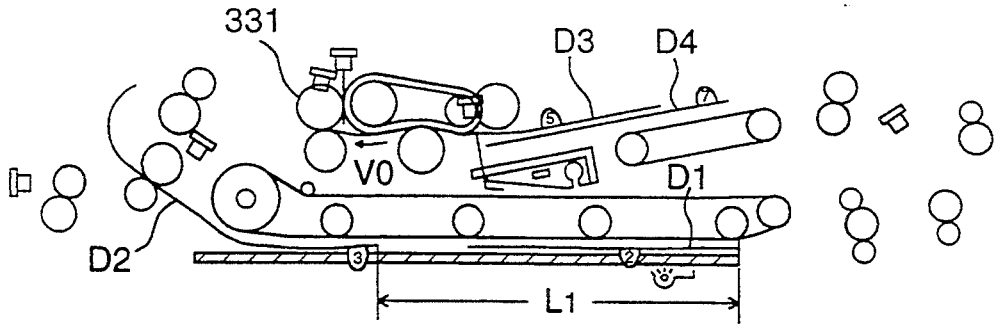
FIGS. 19(A) to 19(F) are schematic illustrations showing the second half of the document conveyance process for even-numbered pages in the R-RDH mode.
Figure 19:
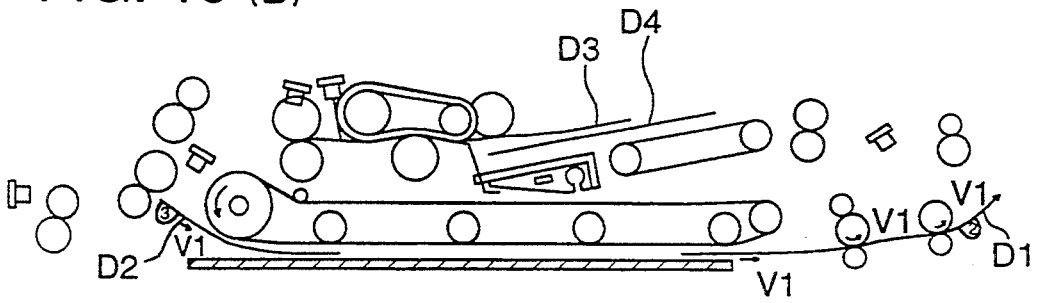
Figure 19:
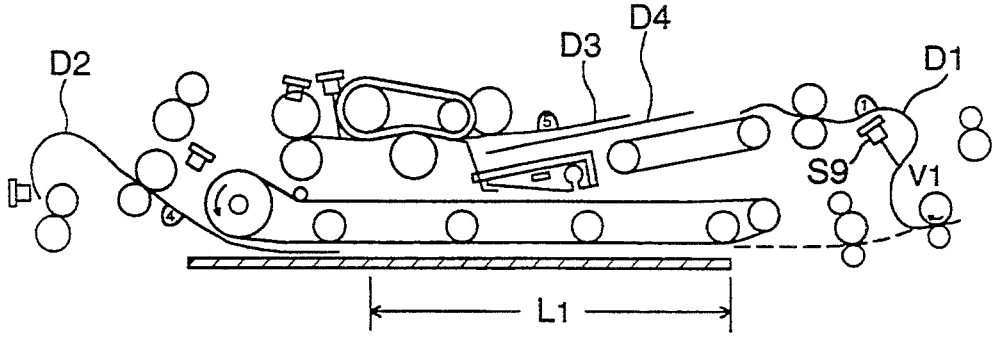
Figure 19:
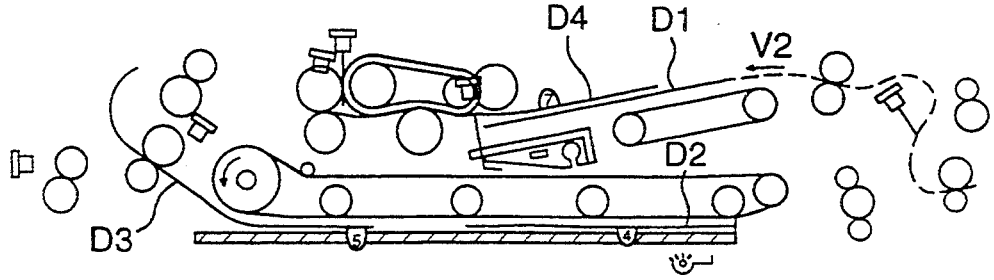
Figure 19:
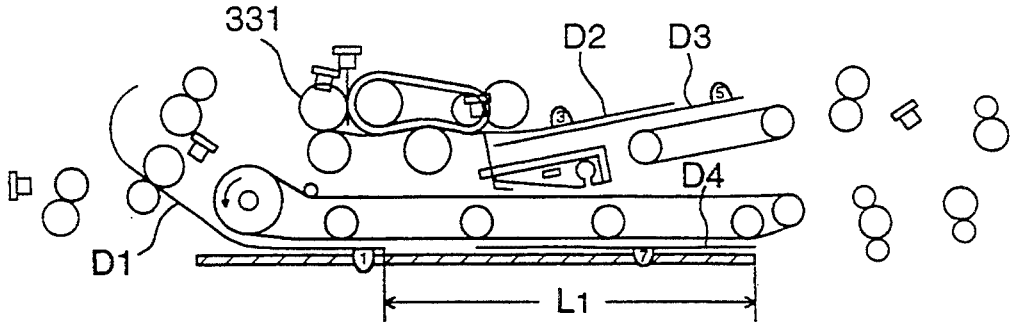
Figure 19:
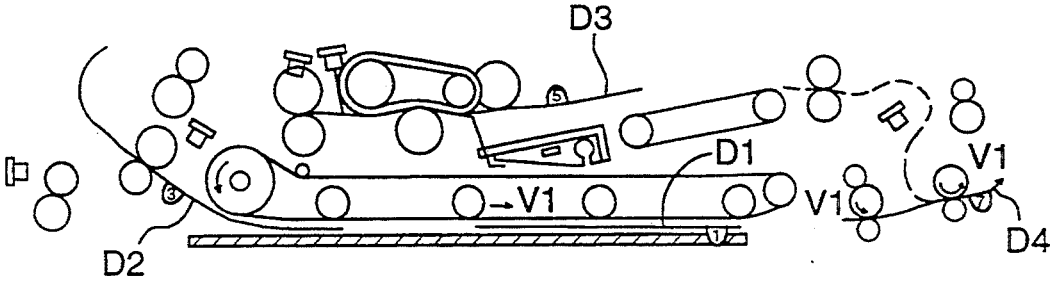

(3*a*) FIG. 18(A) shows a condition of intermediate conveyance of the first document D1 of the even-numbered pages in the second circulation. Concurrently when the last document D4 in the first circulation is stopped at a predetermined position on the platen glass 111, the first document D1 in the second circulation advances onto the platen glass 111 at high speed (V1).

Then, the document D1 is stopped while the leading end of the document D1 and that of the previous document D4 maintain a predetermined interval L1.

(3*b*) Next, the document D4 is subjected to exposure at the predetermined on the platen glass 111. During the exposure of the document D4, the next document D2 is sent out at low speed (V0), and waits for the successive operation at the registration roller 331 (shown in FIG. 18(B)).

(3*c*) When the conveyance belt 341 is normally rotated, the documents D4 and D1 are concurrently conveyed at the same high speed (V1). After the trailing end of the document D1 has passed through the registration sensor S7, a predetermined period of time passes, and then the conveyance belt 341 is reversed so that the document D1 is sent to the reversal path 336. On the other hand, the last document D4 in the first circulation is strongly nipped by the paper discharge roller 351, and conveyed by the drive force of the paper discharge motor M3 to the direction of the paper discharge paths f, j, h at high speed (V1) while resisting the drive force of the conveyance belt 341 that is reversed. Before the completion of discharge of the document D4, the conveyance speed is changed to the intermediate speed V2, and the document D4 is conveyed into the document stack section 310 (shown in FIG. 18(C)). In the document stack section 310, the home position sensor S13 is turned off by the action of the portion 311C to be detected on the feed belt 311. After a predetermined period of time has passed, the bottom return clutch CL4 is turned off, and the paper discharge brake BRK2 is turned off so that the rotation of the drive roller 312 is stopped and the feed belt 311 is stopped at the home position.

(3*d*) Successively, the document D1 is conveyed in the reverse direction. After the document D1 has passed through the path i, it is inverted. Then, the document D1 advances onto the platen glass 111 again while the second surface (2) is set downward. On the other hand, the document D4 advances toward the document stack section 310. The leading end of the document D1 is detected by the reversal detection sensor S17. After a predetermined period of time has passed, the motor M2 is turned off and switched to the normal rotation. However, the reversal roller is always rotated in the normal direction, so that the document D1 is successively sent onto the platen glass 111. At this time, after a predetermined period of time has passed after the detection of the leading end of the document D1, the conveyance clutch CL1 is turned on, so that the document D2 is conveyed at the same conveyance speed (V1) as that of the document D1 while the documents D2 and D1 maintain a predetermined interval (shown in FIGS. 18(D) and 18(E)).

(3*e*) Documents D1 and D2 are concurrently conveyed at a speed of V1, and the document D1 is suddenly stopped at a predetermined position located at the right edge of the platen glass 111, then the document D1 is subjected to exposure. While the document D1 is being exposed, the document D2 waits for the next operation at a predetermined position on the platen glass 111. While the document D1 is being exposed, the document D3 is sent out at a low speed of V0, and collides with the registration roller 331 and stops (shown in FIGS. 18(F) and FIG. 19(A)).

(3*f*) After the second surface (2) of the document D1 has been exposed, the document D1 is conveyed out to the paper discharge reversal section 350 at a high speed of V1. Concurrently, the document D2 advances onto the surface of the platen glass 111 at the high speed of V1 (shown in FIG. 19(B)).

(3*g*) The document D2 is inverted by the inversion guide plate 336. Then, the document D2 advances to one end of the platen glass 111 at the high speed of V1 while the fourth surface (4) is set downward. During the above operation, the first document D1 passes through the reversal paths j, k, m, n in the paper discharge reversal section 350. While the first surface (1) is set upward, the document D1 advances to the document stack section 310 at the high speed of V1. After the sensor S9 has detected the trailing end of the document, the document speed s switched to the intermediate speed V2 (shown in FIG. 19(C)). After the leading end of the document D2 has turned on the registration sensor S7, a predetermined period of time passes. Then, the document D3 that has been waiting is conveyed out (V0).

(3*h*) After the leading end of the document D2 has been detected by the registration sensor S7, the document D3 is successively conveyed, and the documents D2 and D3 are concurrently conveyed. Then, the document D2 stops at a predetermined position located at the right end of the platen glass 111 and receives the exposure processing. At this time, the document D3 advances to a predetermined position located at the left end of the platen glass 111 and waits for the next operation. An interval between the leading end of the document D2 and that of the document D3 is maintained to be L1. While the document D2 is being exposed, the document D4 is sent out, and collides with the registration roller 331 and stops. When the trailing end of the document D1 passes through the sensor S9, in the same manner as described before, the document D1 advances to the document leading end stopper 318 at the intermediate speed V2 (shown in FIG. 19(D)).

In the same manner as described before, the even-numbered page document is inverted in the intermediate conveyance section 330. While the even-numbered page is set downward, the document is conveyed onto the platen glass 111. After the exposure, the document is switched back and inverted in the paper discharge inversion section 350, and while the odd-numbered page surface is set upward, the document is returned to the lowermost layer of the document stack on the document stack section 310 (shown in FIGS. 19(E) and 19(F)).

The aforementioned conveyance operations are performed in the case where small-size documents are conveyed. In the case where large size documents (B4, A3 and 11 inches paper) are conveyed, the waiting position of the successive document may be set at a position in the upstream of the platen glass 111 close to the registration roller 334 provided at a branch portion of the document normal conveyance path c and the inversion conveyance path i.

The document conveyance operations in the RDH and R-RDH modes are described above. Also, in the case where documents are discharged from the image reading section to the paper discharge tray 360 disposed outside of the apparatus by the discharging means in the ADF and R-ADF modes, the documents can be properly stacked on the trays 361, 363 when the document discharging speed is set at and switched to $V1>V2$ as described before. In this example, the speeds are set at the following values: $V1=1200$ mm/s and $V2=600$ mm/s.

In the aforementioned automatic document feeder, the document image reading stop reference position is set at the right end (the document discharge side end) of the platen glass 111. However, it should be understood that the present invention is not limited to the specific example, and the document image reading stop reference position may be set at a position on the left side of the platen glass 111.

The brake means applied to the conveyance means is not limited to an electrical or a mechanical brake, but a short-circuit brake or a reversing brake of the drive motor M3 may be applied.

Figure 20:
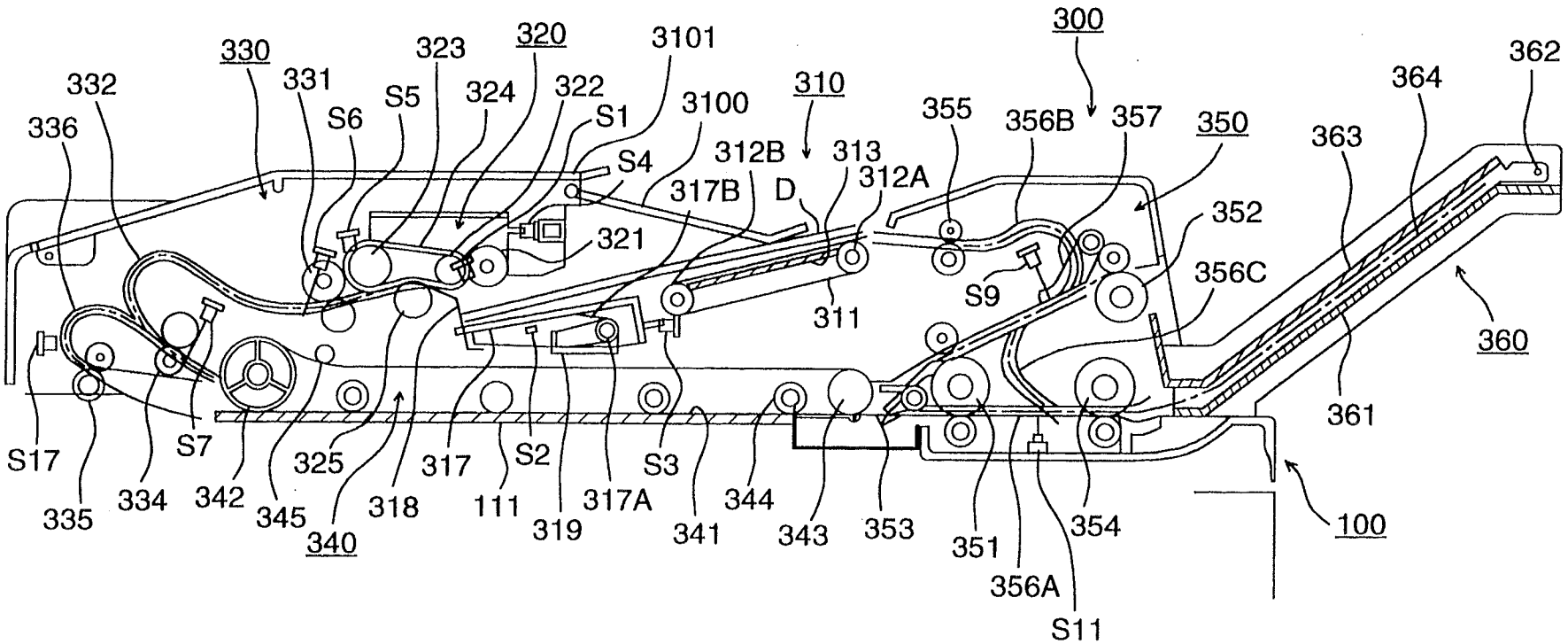
FIG. 20 is a sectional view of the automatic document feeder of the fourth example.
Figure 24:
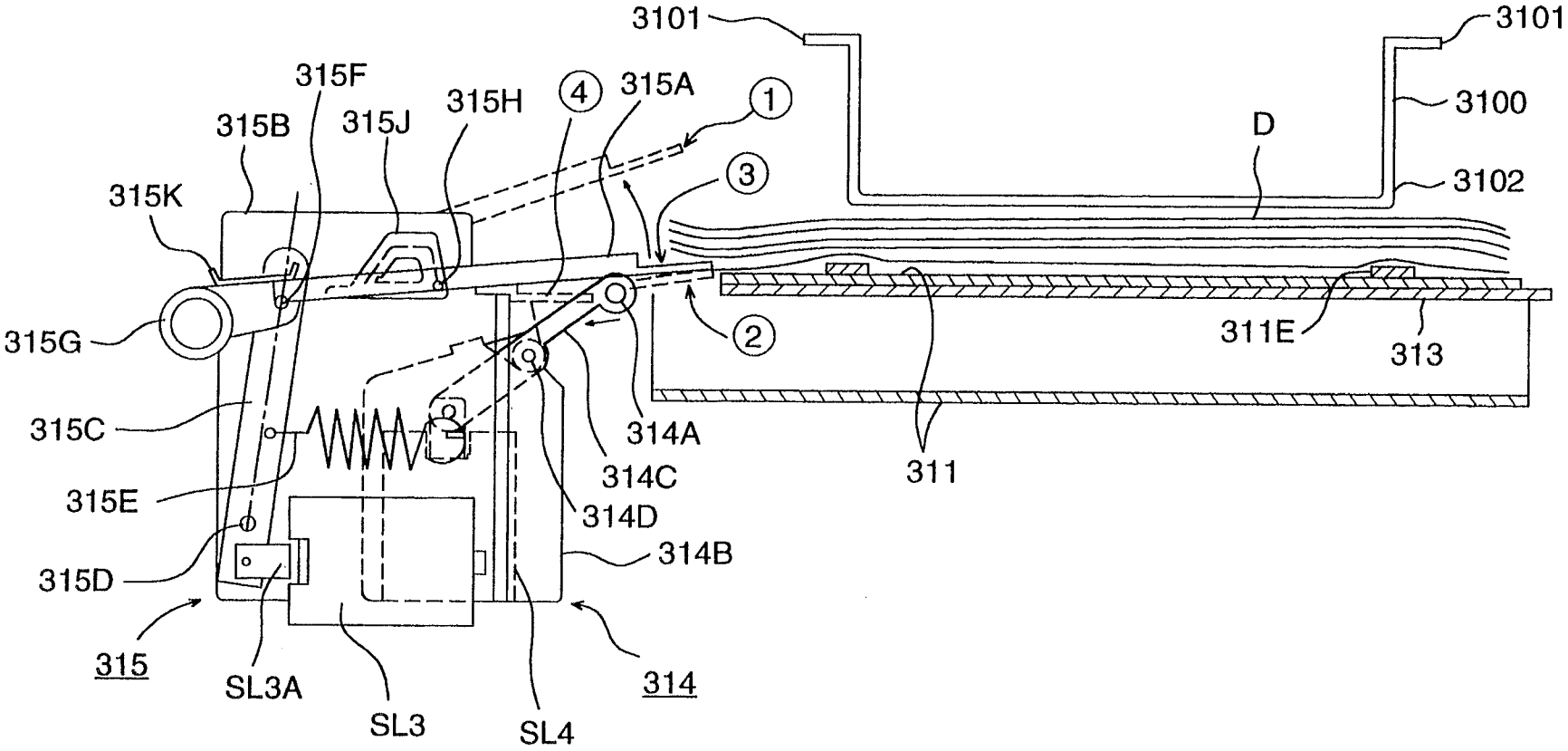
FIG. 24 is a sectional side view of the separation means, pushing means and feed belt which are contacted with a document with pressure, in the fourth example.

Next, the fourth example will be explained as follows. The fourth example is characterized in that: the surface of the feed belt which comes into contact with documents is provided with stripe-shaped protrusions; and a document pressing member is provided which comes into contact with the stripe-shaped protrusions with pressure. In FIGS. 20 and 24, at the end of the document stack section 310 on the downstream side of document flow, a movable pushing plate 317 is pivotally provided around an oscillation shaft 317A. A drive plate 319 is secured to the oscillation shaft 317A with screws. Accordingly, the drive plate 319 can be oscillated integrally with the oscillation shaft 317A. A resilient deformation member (for example, a torsion spring) 317B is wound around the oscillation shaft 317A, so that the drive plate 319 can be pushed by both ends of the oscillation shaft 317A, and the movable pushing plate 317 can be pushed by the central portion of the oscillation shaft 317A. In the upper portion of the document stack section 310, a document pressing member 3100 is rotatably supported by a support section 3101 engaged with a support shaft provided at one end of the feed section 320. The document pressing member 3100 presses against the document stack on the feed belt 311 so that the documents can be positively conveyed, and also the document pressing member 3100 guides an upper surface of the document that has been discharged from the paper discharge inversion section 350 and returned to the upper portion of the document stack on the feed belt 311.

Figure 21:
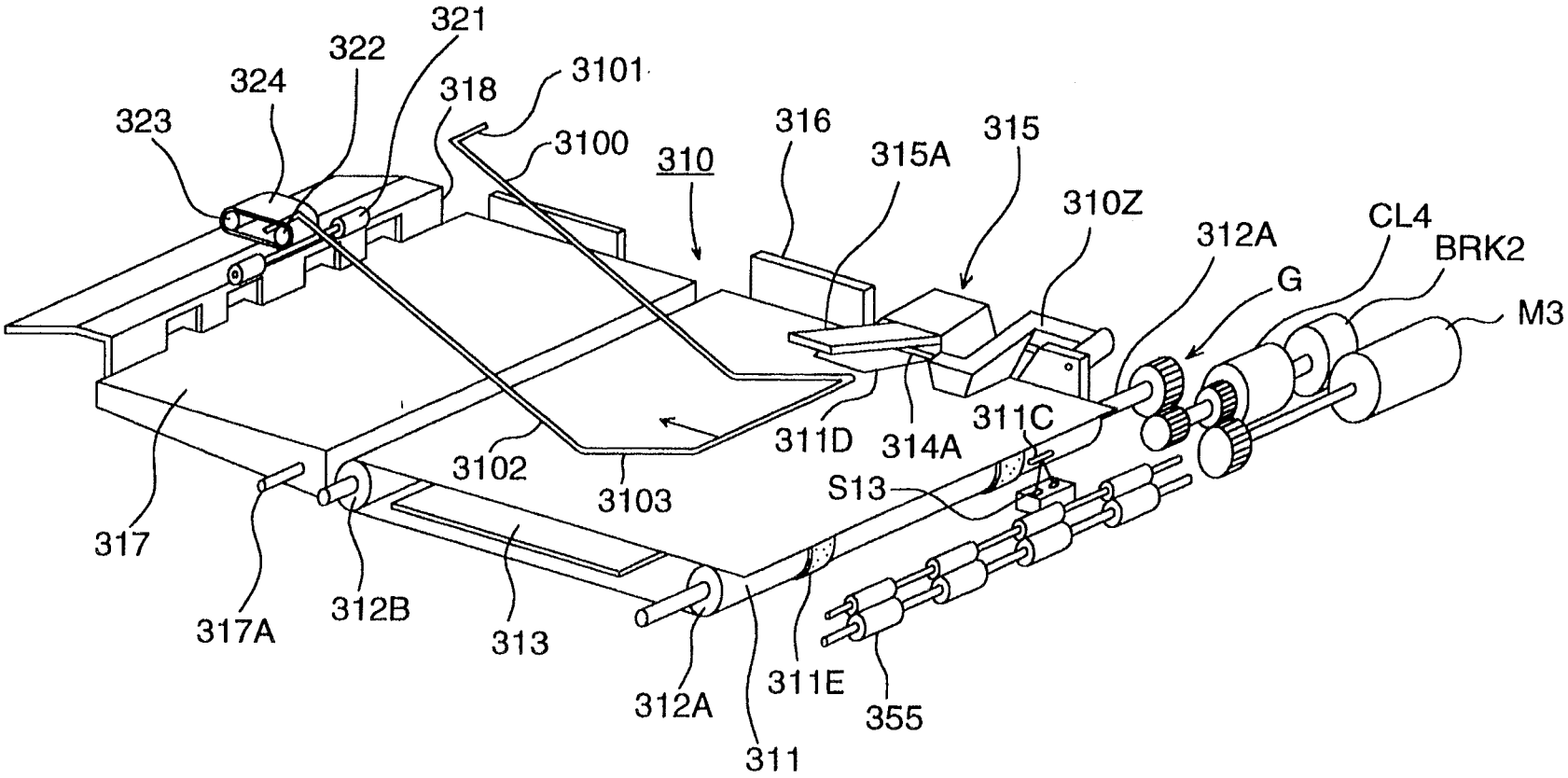
FIG. 21 is a perspective view of a primary portion of the document stack unit of the fourth example.
Figure 22:
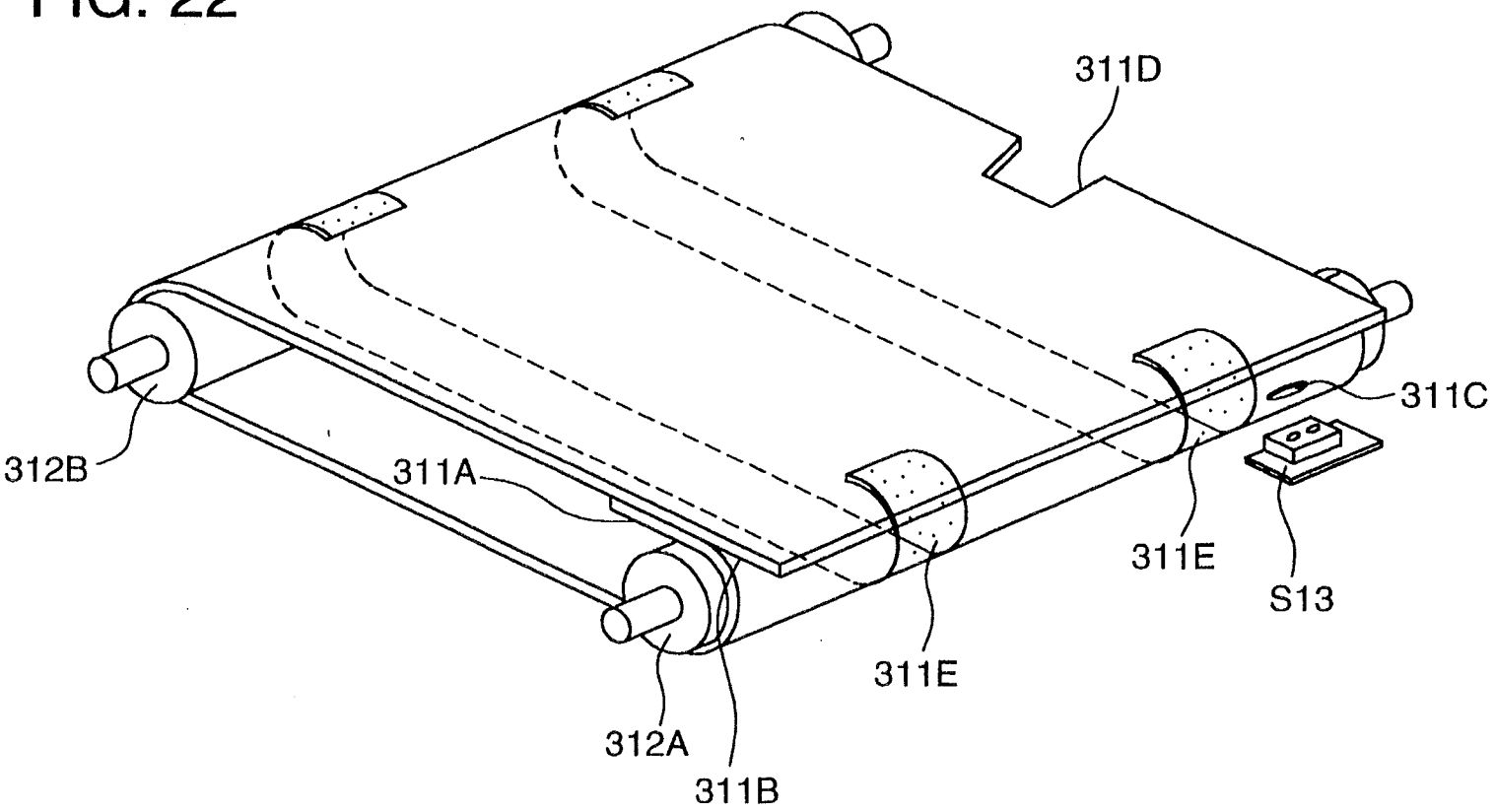
FIG. 22 is a perspective view of the paper feed belt and related members of the document stack unit of the fourth example.
Figure 23:
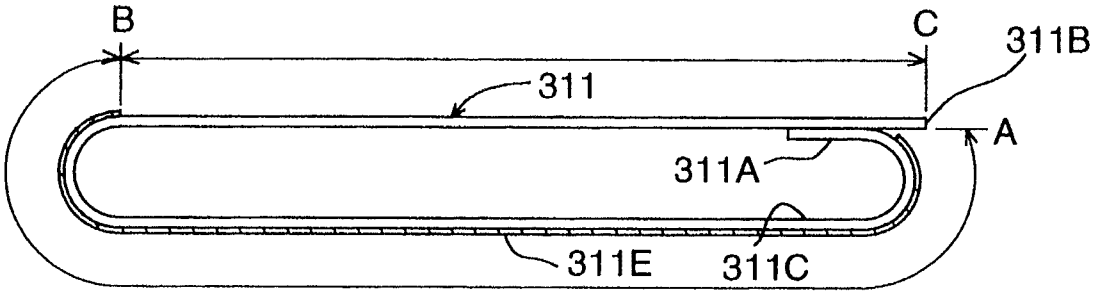
FIG. 23(A) is a sectional view of the feed belt of the fourth example.
FIG. 23(B) is a partially enlarged sectional view of the feed belt of the fourth example.
Figure 23:
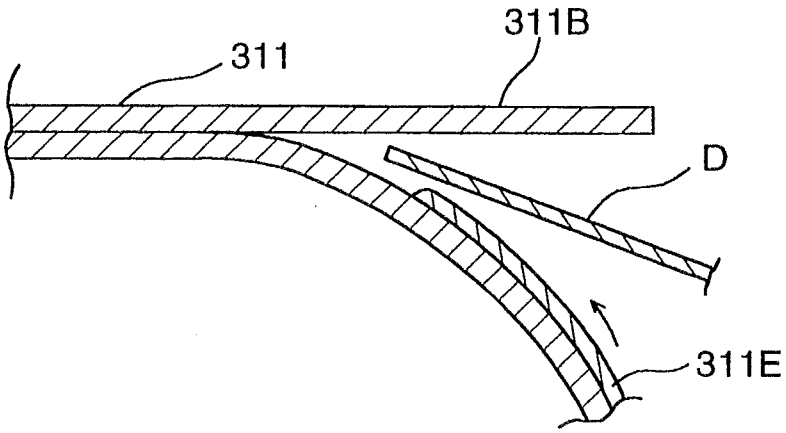

FIG. 21 is a perspective view showing the primary portion of the document stack section 310. FIG. 22 is a perspective view of the feed belt 311. FIG. 23(A) is a sectional view of the feed belt 311. FIG. 23(B) is a partially enlarged sectional view of the feed belt 311. The feed belt 311 is a rotatable wide endless belt, and conveys documents D. The feed belt 311 is trained about a drive roller 312A and an idle roller 312B. One end portion of the feed belt 311 is connected at a joint portion 311A, so that it forms a loop. The other end portion of the feed belt 311 forms a gripper section 311B extending outside from the joint portion 311A. The feed belt 311 is made of a cloth belt coated with resin. Alternatively, the feed belt 311 is made of a film of polyethylene terephthalate (PET). An inside surface of the gripper section 311B of the feed belt 311, and the inner circumferential surface of the feed belt 311 are made rough. Therefore, the fore end of a document can be effectively held by the frictional force of the rough surface, and also the slippage of the drive roller 312A can be effectively prevented. In a region between A and B on the outer surface of the feed belt 311 shown in FIG. 23(A), a plurality of stripe-shaped protrusions 311E are provided, wherein the protrusions 311E is a little protruded from the feed belt surface. The surfaces of the protrusions 311E are rough so that the friction coefficient is high. It is preferable that other portions on the belt surface are smooth. In the example shown in the drawing, two stripe-shaped protrusions are formed in the document conveyance direction in parallel with each other, however, not less than three protrusions may be provided. The protrusions 311E may be provided in the following manner: a plurality of chloroprene rubber sheets having a high friction coefficient may be adhered or melted on the surface of the feed belt 311 between A and B in FIG. 23(A). In this case, the rubber sheets are disposed in parallel. Alternatively, protrusions 311E of the same configuration having a high friction coefficient may be formed integrally with the feed belt 311 at the same positions as described before.

The document pressing member 3100 is rotatably supported by the support section 3101 engaged with the support shaft provided at one end of the feed section 320. The document pressing member 3100 is pushed by its own weight or a spring, so that the document press-contacting portion 3102 partially comes into contact with the portions of the document D located above the protrusions 311E on the feed belt 311. The document press-contacting positions of the document pressing member 3110 are determined so that the protrusions 311E on the feed belt 311 and the document press-contacting portion 3102 can hold the smallest size document until the leading end of the document reaches the document fore end stopper 318. The fore end of the document pressing member 3100 on the document press-contacting portion 3102 side forms a guide 3103 which is inclined upward. The guide 3103 works as a guide when the document stack D is manually set on the document stack section 310. Further, the guide 3103 works as a guide when the document D is returned to an upper position on the document stack provided on the feed belt 311 after the document D has been discharged from the paper discharge inversion section 350 in the circulation conveyance. In this connection, numeral 311C is a hole for detection formed in a portion on the feed belt 311. The home position of the feed belt 311 is detected by the reflection type sensor S13 when the hole 311C passes, so that the stop position of the gripper section 311B of the feed belt 311 can be controlled.

As shown in FIG. 21, the paper discharge brake BRK2 and the bottom-return clutch CL4, which are connected with the paper discharge motor M3, are provided at the end of the rotational shaft of the drive roller 312A. A fixed plate 313 is fixedly fastened inside the feed belt 311 between the drive roller **312*a* and the idle roller 312B. The fixed plate 313 supports the document stack D of the feed belt 311** so that the document stack d can be held on a plane.

In FIG. 21, numeral 315 is a number of copies separation means which separates the lowermost layer document of the document stack on the feed belt 311, from the uppermost document of the document stack inserted into the bottom of the lowermost layer of the document stack conveyed in circulation after reading. A separation lever 315A of the number of copies separation means 315 is pushed by a spring, and raised and lowered by the action of the solenoid SL3, and further the separation means 315 is advanced and withdrawn in a direction perpendicular to the document conveyance direction.

Numeral 311D is a cutout portion formed at the side of the feed belt 311 so that the separation lever 315A can be raised above the feed belt 311.

When a first document stack is placed on the document stack section 310, the document pressing member 3100 is raised upward. Alternatively, the document stack is inserted along the guide 3103. In this way, the document stack is placed on the feed belt 311 and the movable pushing plate 317 described later. Then the document stack collides with the width stopper 316 which regulates the movement of the document stack in the width direction. At the same time, the fore end of the document collides with the document fore end stopper 318 so as to align the document. At this time, the surface of the feed belt 311 on which the document is placed is smooth (the surface is shown by B—C surface in FIG. 23(A). When the document is stacked, the separation lever 315A is lowered by the weight of the document stack, and the lowermost layer is lightly pushed up. A rotatable paper pressing lever 310Z provided in the upstream of conveyance with respect to the separation lever 315A helps a returning document so that it can be positively inserted under the document stack. The paper pressing lever 310Z comes into contact with the document surface with light pressure. The paper holding lever 310Z is effective to stabilize the operation of the separation lever 315A when curled documents or a small number of documents are conveyed.

FIGS. 25(A) to 25(E) are schematic illustration showing the conveyance process of document D discharged onto the feed belt 311 and the movable pushing plate 317 of the document stack section 310 from the paper discharge inversion section 350.

After the leading end of document D1 has been detected by the leading end passage sensor S9 (the fore end of the document comes close to the gripper section 311B), the clutch is connected, and the leading end of the document D is held by the gripper section 311B of the feed belt 311 that starts rotating from the home position. When the feed belt 311 is further rotated, the document D1 is held on the rough surface of the feed belt 311, and conveyed to the left and inserted below the lowermost layer of the document stack that has not been processed yet (shown in FIGS. 25(A) and 25(B)). As described before, the separation lever 315A passes through the cutout portion 311D of the feed belt 311 by the action of the pushing lever 314A being driven by the solenoid SL4. Accordingly, the document stack is raised to a predetermined height by the separation lever 315A.

At this time, the movable pushing plate 317 is located at a lower position, and the leading ends of the document stack D are separated from the delivery roller 321. In this case, the surface speed of the feed belt 311 is set slightly faster than that of the circulation discharging roller (deviation correction roller) 355 of the paper discharge and reversal section 350, or the surface speed of the feed belt 311 is set equal to that of the circulation discharging roller 355 of the paper discharge and reversal section 350. The protrusions 311E provided between A and B in FIG. 23(A) of the feed belt 311 coming into contact with the document D1, form a protruded rough surface (the amount of protrusion is about 0.5 to 1 mm), and the protrusions are appropriately pressed by the document pressing member 3100. Therefore, the document D1 is pressed on the feed belt 311 surface by the weight of the upper document stack and the pushing force of the document pressing member 3100, so that the document D1 is positively held and conveyed by the feed belt 311 (shown in FIG. 25(C)).

The leading end of the returned document D1 conveyed by the feed belt 311 is separated from the feed belt 311 surface. Then the document D1 is successively fed by the rough surface of the feed belt 311 and slides on the movable pushing plate 317. That is, the document D held by the feed belt 311 is conveyed downward along the idle roller 312B of the feed belt 311, and then the document D slides on an upper surface of the movable pushing plate 317 located at a position a little lower than the upper surface of the feed belt 311.

Figure 25:
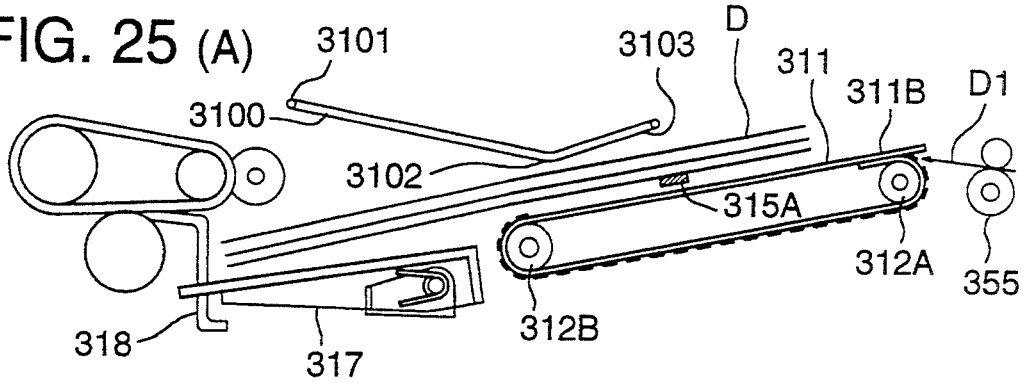
FIGS. 25(A) to 25(E) are schematic illustrations showing a process of document conveyance on the document stack unit in the document circulation mode in the fourth example.
Figure 25:
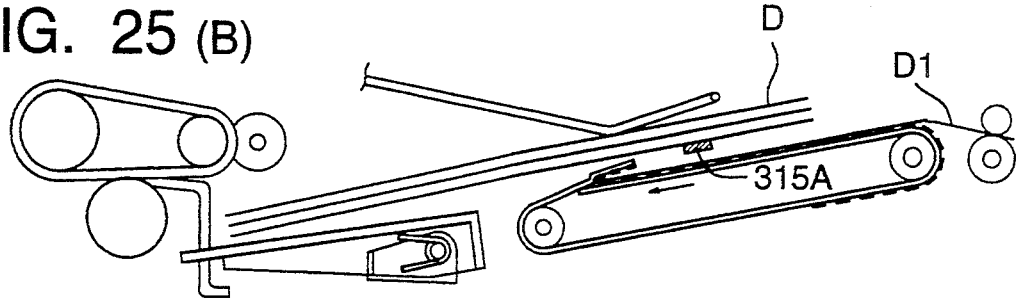
Figure 25:
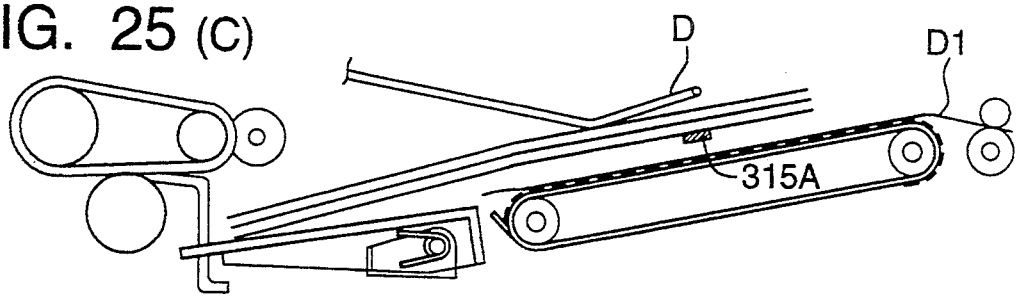
Figure 25:
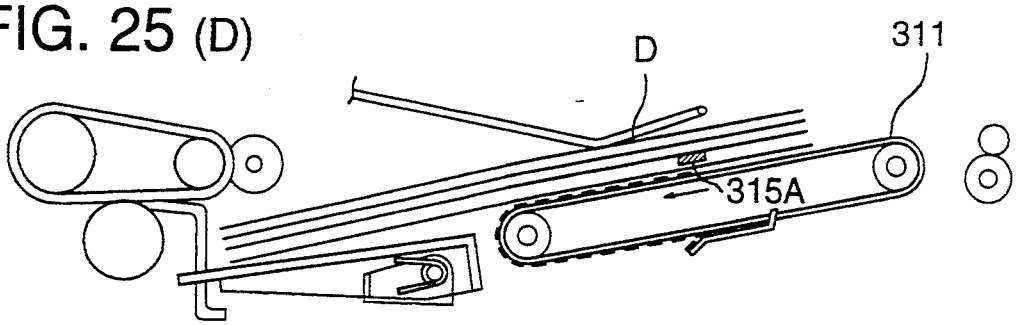
Figure 25:
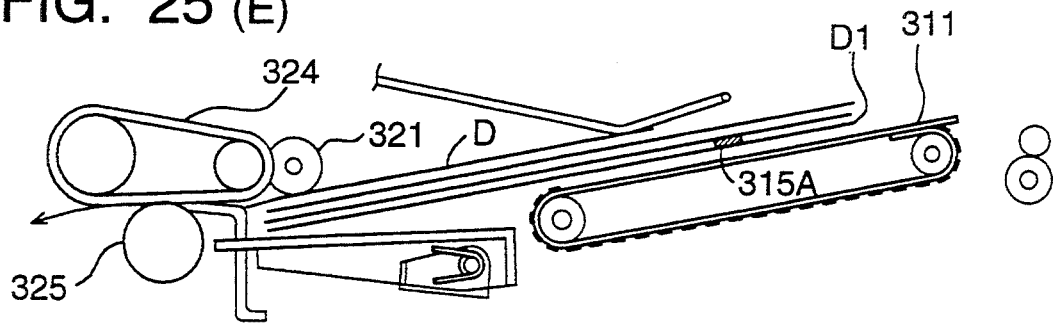

When the leading end of the document D1 collides with the document leading end stopper 318, the conveyance of the document is stopped while the latter half of the document D1 is bestriding the rough and smooth surfaces of the rotating feed belt 311 (shown in FIG. 25(D)).

The feed belt 311 is further rotated, and stopped at the hole position. At this time, the smooth surface of the feed belt 311 comes into contact with the document (shown in FIG. 25(E)). Accordingly, when the overall circumferential length of the feed belt 311 is set longer than the maximum length of the conveyed document D in the conveyance direction, the document returning operation can be smoothly carried out.

As shown in FIG. 20, an intermediate conveyance section 330 is provided in the downstream of document conveyance in the feed section 320. The intermediate conveyance section 330 includes a pair of first intermediate conveyance rollers rotated normally, curved guide plate 332, and a pair of second intermediate rollers 334 rotated reversely. Therefore, a conveyance path is formed which conveys the document D sent out from the feed section 320, to one end of the platen glass 111.

A paper discharge tray section 360 is provided in the upper portion of the copier body 100 at a position close to the paper discharge opening of the paper discharge reversal section 350 of the automatic document feeder 300. The paper discharge tray section 360 includes a fixed tray 361 having an inclined surface secured to the upper surface of the casing of the copier body 100 with screws, and a movable tray (resin tray) 363 pivotally mounted on the fulcrum shaft 362 provided at one end of the fixed tray 361 so that the movable tray 363 can be oscillated. Under the condition that the movable tray 363 is folded, the inclined upper surface of the fixed tray 361 and the inclined lower surface of the movable tray 363 maintains a predetermined interval and forms a reversal paper discharge passage 364. A document D sent from the reversal paper discharge roller 354 goes up in the reversal paper discharge passage 364 and temporarily stops after the detection of the trailing end of the document by the sensor S11, and is successively introduced into the automatic document feeder 300 by the reverse rotation of the reversal paper discharge roller 354. In the R-ADF mode of two-sided documents, the document D passes through the guide 356C, and is discharged outside by the paper discharge roller 352 of the paper discharge reversal section 350, and the discharged document is stacked on the upper surface of the movable tray 363.

In the fourth example, the document pressing member 3100 is pressed by it own weight. Alternatively, the document pressing member 3100 may be pressed by a spring. In the case of curled documents, the document pressing member 3100 may be fixed at an upper position of the document return path without pressing the curled document. Further, the protrusions 311E having a high friction coefficient are not necessarily provided all over the region between A and B on the feed belt 311, but they may be provided in a portion of the region between A and B all over the width of the feed belt 311. Alternatively, not less than three protrusions 311E may be disposed in parallel.

As explained above, in the automatic document feeder of the present invention, the uppermost document of the document stack provided on the document stack section is returned to the lowermost layer of the document stack on the document stack section through the paper feed section and the processing section, forming a closed loop. Accordingly, the documents are not stained when they are rubbed with each other. The automatic document feeder of the present invention does not require a suction means, so that the structure can be simplified, and the manufacturing cost can be reduced, and further the occurrence of noise and vibration can be avoided.

When a wide belt having the gripper section is used for the document feeder, damage caused in the fore end of a document can be effectively prevented.

In the RDH and R-RDH modes of the automatic document feeder of the present invention, when a document discharged from the paper discharge inversion section is bottom-returned to the lowermost layer of the document stack on the feed belt of the document stack section, the returned document can be positively held and returned at high speed to a predetermined stop position by the action of the rough surface of the gripper section of the feed belt and also by the rough surface on the feed belt, irrespective of the number of returned documents and the curl caused on the documents.

What is claimed is:

1. An automatic document feeding apparatus for conveying a plurality of documents one sheet by one sheet to an image reading section, comprising:

document holding means for holding the plurality of documents;

first conveying means for conveying the plurality of documents one sheet by one sheet to the image reading section, having a platen glass, so that an image on a first side of a conveyed document of the plurality of documents is scanned by a scanning means;

second conveying means for conveying said conveyed document so that said conveyed document is turned over and conveyed to the image reading section again so that an image on a second side which is opposite to said first side of said conveyed document is scanned by said scanning means;

discharging means for discharging said conveyed document from the image reading section, and for returning said conveyed document to said document holding means;

third conveying means, located in a vicinity of the image reading section, for conveying said conveyed document from at least one of said first conveying means and said second conveying means to the image reading section and for conveying said conveyed document from the image reading section to at least one of said second conveying means and said discharging means; and control means for controlling said apparatus so that;

said conveyed document is conveyed through said first conveying means, said third conveying means, and said discharging means for a first circulation which said first side of said conveyed document is scanned by said scanning means, and said conveyed document is conveyed through said first conveying means, said second conveying means, said third conveying means, and said discharging means for a second circulation which said second side of said conveyed document is scanned by said scanning means;

wherein, in said second circulation, a next conveyed document, following said conveyed document, is set to a waiting position in which at least a part of said next conveyed document is located on said platen glass, said next conveyed document is set to the waiting position without being conveyed through said second conveying means, and said next conveyed document is conveyed to the image reading section through said second conveying means after said second side of said conveyed document is scanned by said scanning means.

2. The apparatus of claim 1, wherein said next conveyed document is being conveyed to said waiting position while said conveyed document is being conveyed from said second conveying means to said image reading section in said second circulation.

3. The apparatus of claim 1, wherein said discharging means further includes:

a first returning means for returning said conveyed document to said document holding means as in the same side facing upward as said document is in said image reading section; and a second returning means for returning said conveyed document to said document holding means as in the opposite side facing upward as said document is in said image reading section.

4. The apparatus of claim 3, further comprising:

a first driving means for driving said first conveying means, said second conveying means, and said third conveying means; and a second driving means for driving said first returning means and said second returning means.

5. The apparatus of claim 1, wherein said waiting position in said image reading section is a predetermined distance apart from said conveyed document which is stopped in said image reading section.

6. The apparatus of claim 1, further comprising:

a detecting means for detecting a pass of said conveyed document through a predetermined detection location in said second conveying means, and for generating a detection signal;

a controlling means for controlling said apparatus so that said next conveyed document is conveyed to said waiting position according to said detection signal from said detecting means.

7. The apparatus of claim 1, wherein a third document is started being conveyed when said conveyed document is in said image reading section and said next conveyed document is at said waiting position; and said third conveyed document is conveyed to said waiting position when said conveyed document is discharged by said discharging means and said next conveyed document is conveyed in said second conveying means.

8. The apparatus of claim 1, wherein said document supporting means further includes:

an inserting means, having a belt-like shape, for inserting said conveyed document into the bottom of documents held on said document supporting means; said inserting means having:

a nipping member for nipping a leading edge of said conveyed document and for moving in a conveyance direction of said conveyed document;

a roller member for conveying said conveyed document from said discharging means to said nipping member of said inserting means.

9. The apparatus of claim 8, wherein a linear speed of said inserting means is faster than a linear speed of said roller member.

10. The apparatus of claim 9, wherein said document supporting means further includes:

a third driving means for driving said inserting means and said roller member.

11. The apparatus of claim 8, wherein said document supporting means further includes:

a brake means for decreasing a linear speed of said roller member, and for stopping a rotation of said roller member.

12. The apparatus of claim 11, wherein said document supporting means further includes:

a third driving means for driving said inserting means and said roller member.

13. The apparatus of claim 1, wherein said document supporting means further includes:

an inserting means for inserting said conveyed document into the bottom of documents held on said document supporting means in synchronism with a movement of a leading edge of said conveyed document;

a detecting means for detecting a pass of said conveyed document through a predetermined detection location, and for generating a detection signal;

a driving means for driving said inserting means;

a brake means for stopping said inserting means at a predetermined position; and a controlling means for controlling said brake means;

wherein said controlling means controls said brake means to stop said inserting means a predetermined period after receiving said detection signal from said detecting means so that said inserting means is stopped at said predetermined position.

14. The apparatus of claim 13, wherein said inserting means is an endless belt.

15. The apparatus of claim 13, wherein said brake means is at least one of a short-circuit brake and a reversing brake.

16. The apparatus of claim 13, wherein said brake means is at least one of an electrical brake means and a mechanical brake means.

17. The apparatus of claim 1, wherein said document supporting means further includes:

an inserting means for inserting said conveyed document into the bottom of documents held on said document supporting means in synchronism with a movement of a leading edge of said conveyed document;

a detecting means for detecting a pass of said conveyed document through a predetermined detection location, and for generating a detection signal;

a driving means for driving said inserting means;

a brake means for stopping said inserting means at a predetermined position;

a shifting means for changing an inserting speed of said inserting means to at least two different speeds; and a controlling means for controlling said brake means and said shifting means;

wherein said controlling means controls said shifting means before receiving said detection signal from said detection means so that said inserting speed is shifted slower; and said controlling means controls said brake means to stop said inserting means a predetermined period after receiving said detection signal from said detecting means so that said inserting means is stopped at said predetermined position.

18. The apparatus of claim 17, wherein said inserting means is an endless belt.

19. The apparatus of claim 17, wherein said brake means is at least one of a short-circuit brake and a reversing brake.

20. The apparatus of claim 17, wherein said brake means is at least one of an electrical brake means and a mechanical brake means.

21. The apparatus of claim 1, wherein said document supporting means further includes:

an inserting means, having a belt-like shape, for inserting said conveyed document into the bottom of documents held on said document supporting means; said inserting means having:

a stripe-shaped protrusion on a surface of said inserting means for creating a high friction between said conveyed document and said surface of said inserting means; and a pressing member for pressing said conveyed document onto said-surface of said inserting means.

22. The apparatus of claim 21, wherein said first conveying means includes an intake section from where said plurality of documents are fed to said image reading section; and said pressing member applies a pressing force onto said conveyed document until said conveyed document is conveyed to said intake section of said first conveying means.

* * * * *

UNITED STATES PATENT AND TRADEMARK OFFICE

CERTIFICATE OF CORRECTION

PATENT NO. : 5,436,715

DATED : July 25, 1995

INVENTOR(S) : Yasushi YAMADA et al.

It is certified that error appears in the above-indentified patent and that said Letters Patent is hereby corrected as shown below:

CLAIM 21, COLUMN 42, LINE 45, CHANGE "said-surface" TO --said surface--.

Signed and Sealed this

Twenty-fourth Day of September, 1996

*Attest:*

Bruce Lehman

BRUCE LEHMAN

*Attesting Officer*

*Commissioner of Patents and Trademarks*